US011389003B2

(12) United States Patent
Winterhalter et al.

(10) Patent No.: US 11,389,003 B2
(45) **Date of Patent: *Jul. 19, 2022**

(54) PORTABLE CHAIR

(71) Applicant: YETI Coolers, LLC, Austin, TX (US)

(72) Inventors: Andrew J. Winterhalter, Austin, TX (US); Michael Cieszko, Austin, TX (US); Evan Goldberg, Austin, TX (US); Derek Sullivan, Austin, TX (US); Donald Edward Desroches, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/135,535

(22) Filed: Dec. 28, 2020

(65) Prior Publication Data

US 2021/0112987 A1 Apr. 22, 2021

Related U.S. Application Data

(63) Continuation of application No. 16/797,964, filed on Feb. 21, 2020, now Pat. No. 10,874,219, which is a (Continued)

(51) Int. Cl.
*A47C 4/28* (2006.01)
*A47C 4/48* (2006.01)
(Continued)

(52) U.S. Cl.
CPC ..... *A47C 4/286* (2013.01); *A47C 4/30* (2013.01); *A47C 4/32* (2013.01); *A47C 4/38* (2013.01); *A47C 4/42* (2013.01); *A47C 4/48* (2013.01)

(58) Field of Classification Search
CPC ..... A47C 1/0265; A47C 1/14; A47C 1/024; A47C 4/286; A47C 4/20; A47C 4/28;
(Continued)

(56) References Cited

U.S. PATENT DOCUMENTS 2,088,644 A 8/1937 Erpelding et al.
3,736,021 A 5/1973 MacLaren
(Continued)

FOREIGN PATENT DOCUMENTS

BE 484542 A 5/1854
CN 2102679 U 4/1992
(Continued)

OTHER PUBLICATIONS

US 6,214,270 B1, 04/2001, Branum (withdrawn)
(Continued)

*Primary Examiner* — Chi Q Nguyen
(74) *Attorney, Agent, or Firm* — Banner & Witcott, Ltd.

(57) ABSTRACT

A folding chair can include a seat pan being formed by a pair of seat bars. The seat pan can be tensioned by a pair of vertical legs. The chair can also include a backrest formed by a pair of diagonally extending backrest bars, a front frame formed by a pair of cross bars, a rear frame formed by rear cross bars, and a pair of armrests. The vertical legs can each be provided with a lower leg and an upper leg. The inner leg can be configured to telescope out of the outer leg and at least one of the vertical legs can be provided with a latch for locking the outer leg to the inner leg. The latch can include a trigger and a projection can be configured to rotate the projection out of a slot formed in the inner leg.

20 Claims, 48 Drawing Sheets

Related U.S. Application Data continuation of application No. 16/247,121, filed on Jan. 14, 2019, now Pat. No. 10,722,034.

(60) Provisional application No. 62/638,879, filed on Mar. 5, 2018, provisional application No. 62/617,160, filed on Jan. 12, 2018.

(51) Int. Cl.

| | |
|---|---|
| ***A47C 4/30*** | (2006.01) |
| ***A47C 4/38*** | (2006.01) |
| ***A47C 4/32*** | (2006.01) |
| ***A47C 4/42*** | (2006.01) |

(58) Field of Classification Search

CPC .... A47C 4/30; A47C 4/32; A47C 4/38; A47C 4/42; A47C 4/48; A47C 5/10; A47C 7/54

USPC .. 297/28, 35, 42, 16.1, 16.2, 20, 56, 55, 45, 297/46, 47

See application file for complete search history.

(56) References Cited

U.S. PATENT DOCUMENTS 3,881,739 A 5/1975 Laune
4,029,279 A 6/1977 Nakatani
4,077,641 A 3/1978 Perego et al.
4,122,227 A 10/1978 Dean
4,216,974 A 8/1980 Kassai
4,232,897 A 11/1980 Maclaren et al.
4,335,893 A 6/1982 Carmichael et al.
4,469,739 A 9/1984 Gretzinger et al.
4,545,599 A 10/1985 Kassai
4,596,484 A 6/1986 Nakatani
4,761,092 A 8/1988 Nakatani
4,932,622 A 6/1990 Hayakawa
5,058,950 A 10/1991 Mann
5,106,678 A 4/1992 Abu-Isa
5,348,415 A 9/1994 Carlsson
5,397,627 A 3/1995 Dunbar et al.
5,769,447 A 6/1998 Huang
5,775,352 A 7/1998 Obitts
5,819,999 A 10/1998 Tennant
5,851,052 A 12/1998 Gustafsson
5,863,061 A 1/1999 Ziegler et al.
5,888,915 A 3/1999 Denton et al.
5,927,798 A 7/1999 Ahn
5,955,385 A 9/1999 Schobesberger et al.
6,082,813 A 7/2000 Chen
D431,382 S 10/2000 Eloge et al.
D432,325 S 10/2000 Zheng et al.
6,247,749 B1 6/2001 Yu
6,270,156 B1 8/2001 Metzger et al.
6,287,690 B1 9/2001 Land
6,302,479 B1 10/2001 Zheng
D455,897 S 4/2002 Jones
6,371,553 B1 4/2002 Tang
6,402,230 B1 6/2002 Tang
6,419,311 B1 7/2002 Tang
6,454,348 B1 9/2002 Wu
6,471,287 B1 10/2002 Liu
6,536,723 B1 3/2003 Nakatani
6,598,841 B2 7/2003 Erickson et al.
6,601,912 B1 8/2003 Chen
6,629,722 B1 10/2003 Tang
6,644,731 B2 11/2003 Tang
D485,061 S 1/2004 Noell et al.
6,705,070 B2 3/2004 Schwartz
D500,605 S 1/2005 Schmidt et al.
6,840,574 B1 1/2005 Wu
6,869,679 B1 3/2005 Negola
6,908,249 B2 6/2005 Tomm
6,913,231 B2 7/2005 Speggiorin
7,017,985 B2 3/2006 Chen
7,100,975 B1 9/2006 Zheng
D532,621 S 11/2006 Lin
7,157,388 B2 1/2007 Langley et al.
7,201,024 B2 4/2007 Hirayama et al.
7,219,955 B2 5/2007 Lu et al.
7,247,585 B2 7/2007 Bascom et al.
7,300,691 B2 11/2007 Callaway et al.
7,458,642 B1 12/2008 Spicer
7,500,715 B1 3/2009 Chen
7,641,276 B1 1/2010 Chen
D612,624 S 3/2010 Lovley et al.
7,682,994 B2 3/2010 Van Emden et al.
7,696,110 B2 4/2010 Taniguchi et al.
7,851,390 B2 12/2010 Salzmann et al.
7,887,131 B2 2/2011 Chadwick et al.
7,892,989 B2 2/2011 Schwartz et al.
8,100,429 B2 1/2012 Longenecker et al.
8,104,838 B2 1/2012 Tsai
D660,585 S 5/2012 McDonald et al.
8,207,071 B2 6/2012 Susa et al.
8,251,442 B2 8/2012 Grace
8,459,741 B2 6/2013 Mazzola et al.
8,460,790 B2 6/2013 Ochi et al.
D685,584 S 7/2013 Ammann, Jr.
8,506,865 B2 8/2013 Wangenheim
8,678,490 B2 3/2014 Chen
8,696,052 B2 4/2014 Zhu
8,714,643 B2 5/2014 Obolewicz et al.
8,727,655 B2 5/2014 Lu et al.
8,820,497 B1 9/2014 Goldsmith et al.
8,820,825 B2 9/2014 Yang
8,864,222 B2 10/2014 Grace
8,979,192 B2 3/2015 Miller
9,095,216 B2 8/2015 Miller
9,121,131 B2 9/2015 Underwood et al.
9,315,926 B2 4/2016 Date et al.
9,451,829 B2 9/2016 Chen
9,545,773 B2 1/2017 Hansen
D783,296 S 4/2017 Robinson
9,771,675 B2 9/2017 Altshuler et al.
D806,423 S 1/2018 Silva et al.
9,913,537 B2 3/2018 Piretti
9,974,388 B1 * 5/2018 Lv ..... A47C 4/42
9,993,082 B2 6/2018 Choi
9,993,083 B2 6/2018 Choi
10,104,971 B1 10/2018 Yang
10,292,503 B2 5/2019 Brown
10,321,750 B2 6/2019 Solomon et al.
D855,343 S 8/2019 Haingaertner
10,631,619 B2 4/2020 Alphin
10,631,648 B1 4/2020 Tsai
D888,425 S 6/2020 Wang
10,722,034 B2 * 7/2020 Winterhalter ..... A47C 4/38
D891,808 S 8/2020 Zhu
10,758,047 B2 9/2020 Brensinger et al.
10,758,054 B2 9/2020 Wang
D897,712 S 10/2020 Hu
D902,617 S 11/2020 Sullivan et al.
10,842,236 B2 11/2020 McMichael
D903,345 S 12/2020 Chen
10,874,219 B2 * 12/2020 Winterhalter ..... A47C 4/32
D911,057 S 2/2021 Jacobsen
D912,423 S 3/2021 Sullivan et al.
D922,790 S 6/2021 Wang
2003/0025360 A1 2/2003 Liu
2003/0025361 A1 2/2003 Liu
2006/0186712 A1 8/2006 Lu et al.
2007/0228780 A1 10/2007 Grace
2009/0146468 A1 6/2009 Schneider
2009/0174230 A1 7/2009 Chen
2010/0032998 A1 2/2010 Eckman et al.
2010/0171342 A1 7/2010 Chen
2010/0295338 A1 11/2010 Crowe
2010/0314914 A1 * 12/2010 Mazzola ..... A47C 3/34 297/16.2
2011/0169305 A1 7/2011 Ayre et al.
2013/0106145 A1 * 5/2013 Chen ..... A47C 4/283 297/42
2014/0097647 A1 4/2014 Grace
2014/0217784 A1 8/2014 Chen

(56) References Cited

U.S. PATENT DOCUMENTS

| | | | | |
|---|---|---|---|---|
| 2014/0227474 | A1 | 8/2014 | Cramer | |
| 2014/0252817 | A1 | 9/2014 | Lovley, II et al. | |
| 2014/0306493 | A1 | 10/2014 | Obolewicz et al. | |
| 2015/0038040 | A1 | 2/2015 | Gabbay | |
| 2015/0054314 | A1* | 2/2015 | Grace | A47C 7/62 297/45 |
| 2015/0360159 | A1 | 12/2015 | Lee et al. | |
| 2016/0081479 | A1 | 3/2016 | Lin | |
| 2016/0100688 | A1 | 4/2016 | Grace | |
| 2016/0135600 | A1 | 5/2016 | Chen | |
| 2017/0202355 | A1 | 7/2017 | Reed | |
| 2017/0311723 | A1 | 11/2017 | Lenhart | |
| 2018/0002839 | A1 | 1/2018 | Liao et al. | |
| 2018/0073169 | A1 | 3/2018 | Chou | |
| 2018/0245248 | A1 | 8/2018 | Buffington et al. | |
| 2019/0090644 | A1 | 3/2019 | Mason et al. | |
| 2019/0090667 | A1 | 3/2019 | Mason et al. | |
| 2019/0104850 | A1 | 4/2019 | Frankel et al. | |
| 2019/0216222 | A1 | 7/2019 | Winterhalter et al. | |
| 2019/0298066 | A1 | 10/2019 | Zhu et al. | |
| 2021/0015263 | A1 | 1/2021 | Lah | |
| 2021/0059418 | A1 | 3/2021 | Reed, II et al. | |
| 2021/0145178 | A1 | 5/2021 | Riley | |
| 2021/0145179 | A1 | 5/2021 | Kong | |

FOREIGN PATENT DOCUMENTS

| | | | |
|---|---|---|---|
| CN | 201001527 | Y | 1/2008 |
| CN | 201492050 | U | 6/2010 |
| CN | 301297394 | | 8/2010 |
| CN | 102230248 | A | 11/2011 |
| CN | 301800654 | | 1/2012 |
| CN | 202236165 | U | 5/2012 |
| CN | 202515069 | U | 11/2012 |
| CN | 202858412 | U | 4/2013 |
| CN | 302684929 | | 12/2013 |
| CN | 104643681 | A | 5/2015 |
| CN | 204393167 | U | 6/2015 |
| CN | 105615364 | A | 6/2016 |
| CN | 303763101 | | 8/2016 |
| CN | 106617546 | A | 5/2017 |
| CN | 107348734 | A | 11/2017 |
| CN | 30468640 | | 1/2018 |
| CN | 207349221 | U | 5/2018 |
| CN | 207421059 | U | 5/2018 |
| CN | 207653880 | U | 7/2018 |
| CN | 304803670 | | 9/2018 |
| CN | 208708874 | U | 4/2019 |
| CN | 305151099 | | 5/2019 |
| CN | 305730506 | | 4/2020 |
| CN | 306305745 | | 7/2020 |
| DE | 1080176 | B | 4/1960 |
| DE | 1267945 | B | 5/1968 |
| EP | 2108284 | A1 | 10/2009 |
| EP | 2123198 | A1 | 11/2009 |
| EP | 2145036 | A1 | 1/2010 |
| EP | 2674629 | A2 | 12/2013 |
| ES | 279347 | A1 | 1/1963 |
| GB | 4025689 | | 8/2012 |
| GB | 6117897 | | 2/2021 |
| JP | 3046457 | U | 3/1998 |
| JP | 2001078851 | A | 3/2001 |
| JP | 2003033260 | A | 2/2003 |
| JP | 2003159141 | A | 6/2003 |
| JP | 2005118214 | A | 5/2005 |
| JP | 2009022498 | A | 2/2009 |
| JP | 2010099238 | A | 5/2010 |
| JP | 2013244909 | A | 12/2013 |
| JP | D1550241 | | 5/2019 |
| JP | D1550242 | | 5/2019 |
| KR | 300686541.0000 | | 3/2013 |
| KR | 20170099158 | A | 8/2017 |
| KR | 300993886.0000 | | 2/2019 |
| KR | 300993887.0000 | | 2/2019 |
| KR | 301091620.0000 | | 1/2020 |
| NL | 1001847 | C1 | 6/1997 |
| WO | 0040122 | A1 | 7/2000 |
| WO | 13029089 | A1 | 3/2013 |
| WO | 2016150254 | A1 | 9/2016 |
| WO | 17133369 | A1 | 8/2017 |

OTHER PUBLICATIONS

Mar. 21, 2019—(PCT) International Search Report and Written Opinion—App PCT/US2019/013511.

Alpha Camp, Alpha Camp Oversized Camping Folding Chair Heavy Duty Steel Frame,Date first available May 3, 2019,[onlinel] retrieved Jun. 1, 2020, available from internet, www.amazon.com (Year: 2019).

Fundango,Fundango Lumbar Support Strong Stable Heavy Duty Folding Deluxe Camping Chair, [online] retrieved Jun. 1, 2020, available from internet, www.amazon.com (Year: 2020).

Yeti, Trailhead Camp Chair,[online]retrieved Jun. 4, 2020, available from internet, https://www.fieldandstreamshop.com/p/yeti-trailhead-camp-chair-20yetutrlhdcmpchrrec/20yetutrlhdcmpchrrec(Year: 2020).

Alpha Camp, Oversized Camping Folding Chair, Date first available Jan. 8, 2018, [online] retreived Mar. 8, 2020, available from https://www.amazon.com/Alpha-Camp-Oversized-Collapsible-Portable/dp/B0759V8NWK/ref=sr_1_55_sspa?crid=156UFWOJUVFC8&dchild=1&keywords=portable+beach+chairs&qid=1591033770&sprefix=p (Year:2018).

Fundango Store, Folding Deluxe Camping Chair, Date first available Jun. 24, 2019, [online] retreived Mar. 8, 2020, available from https://www.amazon.com/dp/B07THBZKV/ref=sspa_dk_details5?psc=1&pd_rd_i=B07THBZKVB&pd_rd_w=XSVfh&pf_rd_p=48d372c1-f7e1-4b8b-9d024bd86f5158c5&pd_rd_wg=adY88&pf_rd_r=XQC2XN3B8TFH (Year:2019).

Sep. 16, 2020—(CA) Examination Report—App. No. 188594.

Sep. 3, 2021—(JP) Office Action—App. No. 2020538143.

Pacific Play Tents Store, Sapphire Blue Super Children's Chair, Date first available Nov. 8, 2018, [online] retrieved Sep. 23, 2021, available from https://www.amazon.com/Pacific-Play-Tents-Sapphire-Folding/dp/B07KBSBV7T/ref=sr_1_115?dchild=1&keywords=foldable+chair&qid=1632406749&sr=8-115 (Year:2018).

* cited by examiner

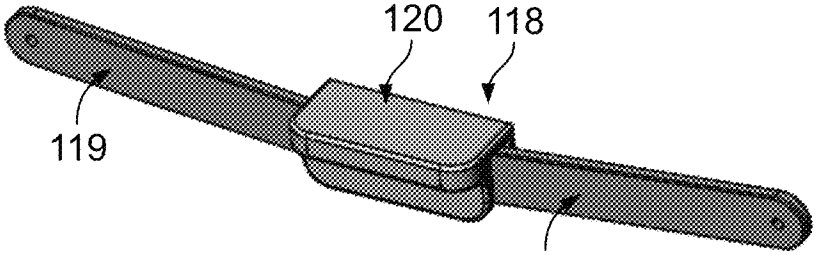
FIG. 12A2
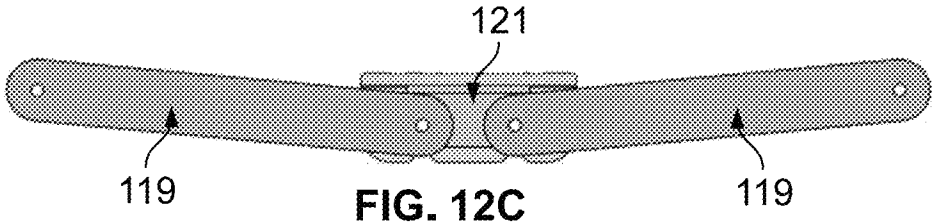
FIG. 12C
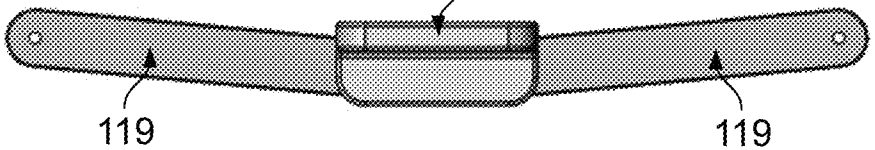
FIG. 12D
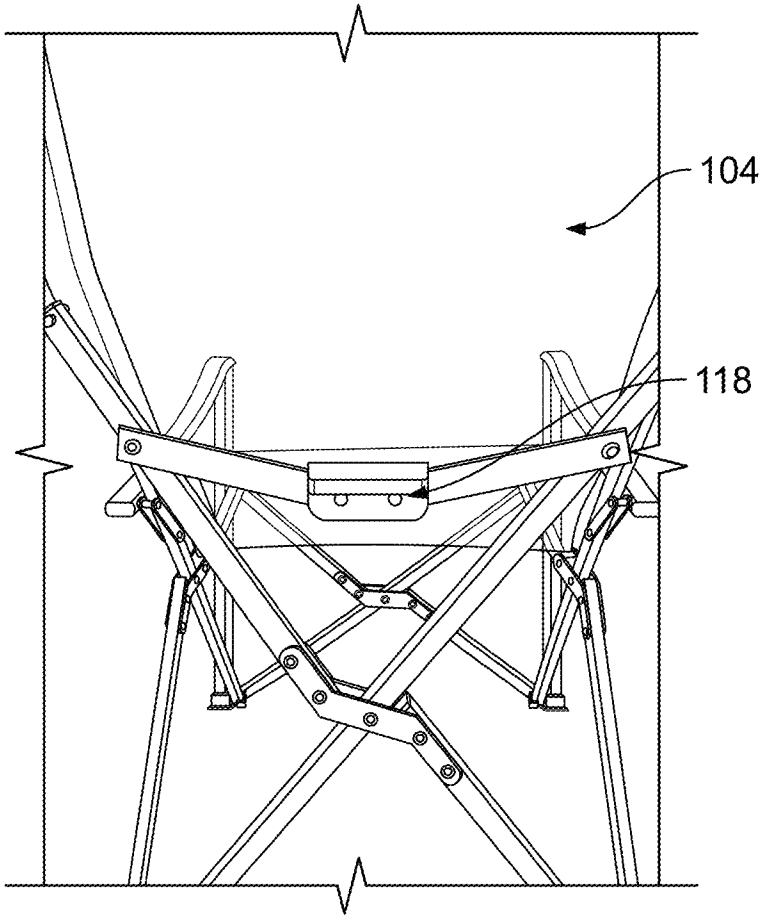
FIG. 12A1

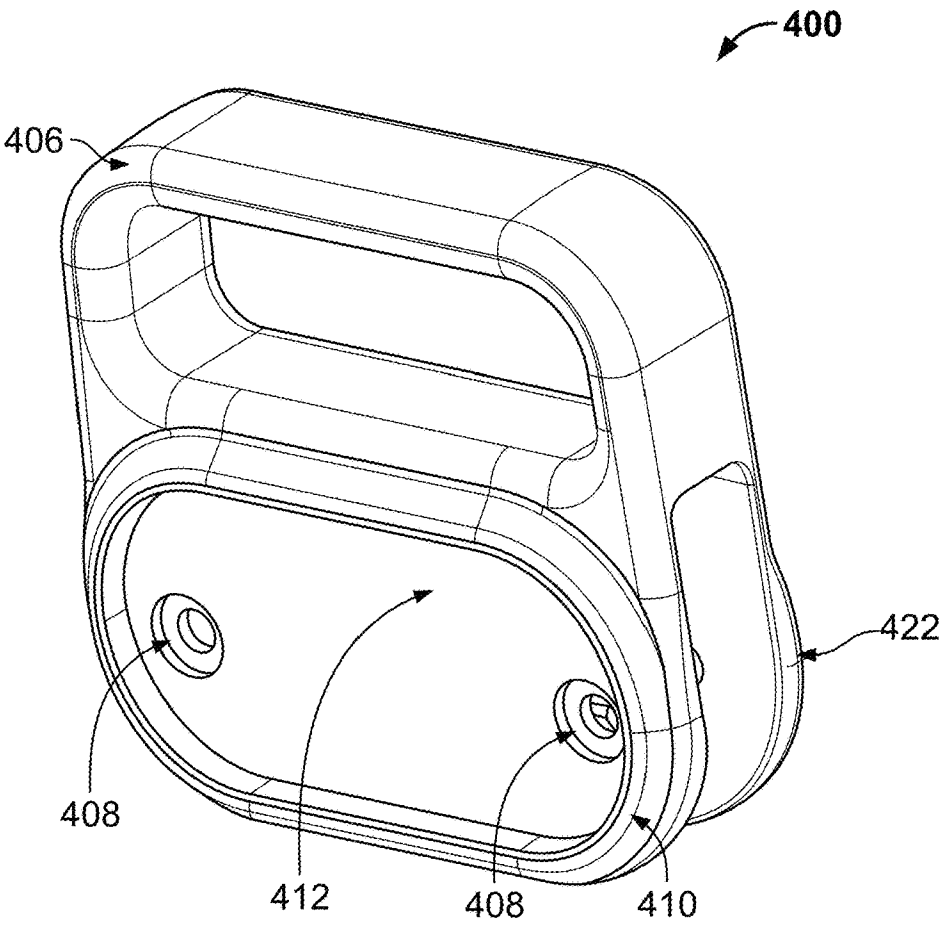
FIG. 24A
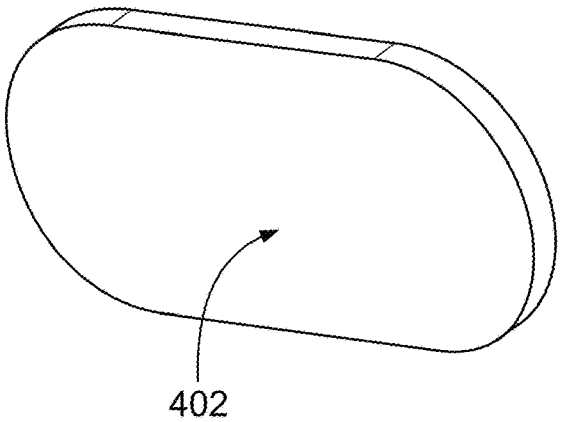

PORTABLE CHAIR

CROSS REFERENCE TO RELATED APPLICATIONS

This application is a continuation of U.S. application Ser. No. 16/797,964, filed Feb. 21, 2020, now U.S. Pat. No. 10,874,219, which is a continuation-in-part of U.S. application Ser. No. 16/247,121, filed Jan. 14, 2019, now U.S. Pat. No. 10,722,034, which claims the benefit U.S. Provisional Patent Application No. 62/617,160, filed on Jan. 12, 2018, and U.S. Provisional Application No. 62/638,879, filed on Mar. 5, 2018; all of which are hereby incorporated by reference in their entireties.

BACKGROUND

Folding chairs are a very popular seating option. Such chairs may be used everywhere from spectator sports on the sidelines to camping in woods. Although they are affordable to a large part of the population, the affordability often means that the best materials are not always used in the construction of the chairs. In some instances, folding chairs can be slung over the user's shoulder and carried by the user. Also in some instances, folding chairs may have certain pressure points on the seating surface, which can be uncomfortable to the user. Additionally, certain folding chairs may require the weight of the user to keep the folding chairs in the opened position. For instance, once the user gets out of the chair and tries to move it, the chair may awkwardly fold up. In addition, certain chairs may have a particular fabric that fades in color or appearance over time.

BRIEF SUMMARY

This Summary provides an introduction to some general concepts relating to this disclosure in a simplified form that are further described below in the Detailed Description. This Summary is not intended to identify key features or essential features of the invention.

Aspects of the disclosure pertain to folding chairs and locking mechanisms for folding chairs.

In certain examples, a folding chair leg locking system is disclosed that may include a housing configured to mount to an outer leg, a trigger pivotably mounted to the housing, the trigger having an actuation surface, a latch comprising a latch projection, the latch received in the trigger and pivotably mounted to the housing, and a bushing configured to mount to an inner leg, the bushing comprising a slot for receiving the projection of the slot, the bushing defining a longitudinal axis. Other examples may also include a biasing member for biasing the trigger into engagement with the slot of the bushing in which an upward force on the actuation surface may cause the trigger and the latch to rotate and the latch projection to move away from the slot in the bushing. In some examples, the trigger and the housing may define a co-planar angular shape. In still other examples, the angular shape may be greater than 90 degrees. In yet other examples, the bushing may define a frustoconical shape. In certain examples, the trigger and the latch may rotate on the same pivot. In yet other examples, the bushing may define a longitudinal axis that is neither parallel nor perpendicular to the actuation surface of the trigger.

In some examples, the folding chairs may include a seat pan formed by a pair of seat bars. The seat pan may be tensioned by a pair of vertical legs. In some examples, the folding chair may also include a backrest that is formed by a pair of diagonally extending backrest bars. In other examples the folding chair may include a front frame formed by a pair of cross bars, and a rear frame formed by rear cross bars. In still other examples, the folding chair may include a pair of armrests. In other examples, the seat pan and the backrest are formed of a suspension fabric. In some examples, the suspension fabric may be constructed of a first yarn, a second yarn, and a thermoplastic polyurethane film. In other examples the first yarn may be a polymer and the second yarn may be more elastomeric than the first yarn, and the thermoplastic polyurethane film can be heat pressed to the first yarn and second yarn.

In some arrangements, the folding chairs may include vertical legs that are provided with a lower leg or lower tube and an upper leg or upper tube, and the inner leg or inner tube is configured to telescope out of the outer leg or outer tube. In yet other examples, at least one of the vertical legs is provided with a latch for locking the outer leg to the inner leg. In still other examples, the latch included a rocker and a projection configured to rotate the projection out of a slot formed in the inner leg. In other examples, the backrest may include a tensioner for maintaining the backrest in an unfolded position. In some examples, the tensioner may include a pair of linkages and an insert configured to hold the pair of linkages in a tensioned position. In other examples, the backrest may include a tensioner configured to maintain the backrest in an unfolded position or a tensioned position, and the tensioner may further include a rear tensioner handle and a pair of tensioner arms.

In still other arrangements, the folding chair includes a latch that also includes a first biasing member configured to maintain the projection in the slot of the inner leg. In other examples, folding chair includes a tensioner with a pair of pivots for linkages and a pair of pins for receiving notches located in the linkages when the linkages are in the tensioned position. In another example, the tensioner also includes a release mechanism, and the release mechanism further includes a pair of angled slots for receiving the pair of pins. The angled slots may be angled such that when the user presses the release mechanism, the pins move away from the receiving notches allowing the linkages to rotate and the backrest to become un-tensioned.

In some examples, the folding chair includes a seat that includes a flange that is configured to both receive a second biasing element and to engage the insert, and the basing element, through the flange, places the insert in a release position. In other examples, receiving notches are located at proximal ends of the linkages. In other examples, angled slots are positioned at approximately 45 degrees from a plane defined by a lower portion of the tensioner. In yet other examples, the angled slots are symmetrically placed on the release mechanism. In other examples, the insert includes a pair of insert slots, and the insert slots may be configured to receive the pins, and located inward on the insert, and the pivots may be located outward of the insert slots. In some examples, the insert may include slots for receiving pins on the pair of linkages and a notch may be configured to receive a boss on at least one of the pair of linkages, and the user may slide a release mechanism to release the tensioner.

In other examples, the rear tensioner may include at least one internal stop and a plurality of pivot points. In still other examples, the rear tensioner may also include a safety gap between a bottom of the rear tensioner handle and the rear tensioner arms. In another example, the tensioner further comprises a safety gap between a surface within the tensioner and one of the rear tensioner arms. In other examples, the rear tensioner arms each include a cam guided in slots defined in a tensioner housing. And during release of the tensioner, the slots can limit the movement of the tensioner arms to maintain the safety gap. In still other examples, the tensioner defines a housing having a pair of pivots for receiving the tensioner arms in which the pair of pivots are located internally within the housing such that the pivots are not exposed to the user. In some examples, the tensioner is configured to engage in the tensioned position when a user applies an increasing downward force to the rear tensioner handle until the tensioner exceeds an over-center point and contacts the stop. In other examples, the tensioner is configured to disengage the tensioned position when a user applies an increasing upward force to the rear tensioner handle until the tensioner exceeds an over-center point and the tensioner is disengaged from the tensioned position into a folded position. In yet other examples, when the tensioner is in the tensioned position, the pair of tensioner arms form a bottom angle greater than 180 degrees and a top angle less than 180 degrees. In certain examples, the tensioner is retained in the tensioned position solely by the suspension fabric. In some examples, the backrest includes a tensioner configured to maintain the backrest in the unfolded position or a tensioned position.

In some examples, the folding chair may include a backrest formed of a suspension fabric, and the suspension fabric may include an overlap containing a core in the overlap. In other examples, the overlap includes a hollow section and the core is placed into the hollow section. The core in the overlap hollow section may be secured in a notch asymmetrically located in the top of the pair of diagonally extending backrest bars. In other examples, the suspension fabric may be constructed of a first yarn, a second yarn, and a thermoplastic polyurethane film. In some examples, the first yarn may be a polymer and the second yarn may be more elastomeric than the first yarn. In still other examples, the thermoplastic polyurethane film may be heat pressed to the first yarn and second yarn. In certain examples, the tensioner comprises a pair of arcuate slots and a pair of arms each having a projection or rivet in which the arcuate slots limit the movement of the pair of arms such that the pair of arms and a surface within the housing define a safety gap on the tensioner. In some examples, the tensioner may also include a pair of stops in which the suspension fabric solely biases the pair of arms against the pair of stops.

In other examples, the folding chair may include a seat pan being formed by a pair of seat bars, the seat pan being tensioned by a pair of vertical legs, a backrest being formed by a pair of diagonally extending backrest bars, a front frame formed by a pair of cross bars, a rear frame formed by rear cross bars, and a pair of armrests. In other examples the seat pan and the backrest may be formed of a suspension fabric. In other examples, the suspension fabric may have an overlap and a core placed into a hollow section created by the overlap. In still other examples, the core in the hollow section may be secured in a notch asymmetrically located in a top portion of the pair of diagonally extending backrest bars. In yet other examples, the vertical legs may each be provided with an inner leg and an outer leg and the inner leg is configured to telescope out of the outer leg. In other examples, each of the vertical legs may include a leg locking system for locking the outer leg to the inner leg when the chair is in an unfolded position. In some examples, the leg locking system may include a trigger housing, a trigger, and a latch, and the latch may be configured to engage a bushing on the inner leg. In yet other examples, the folding chair trigger and the trigger housing may be a substantially upside-down "L" shaped. In some examples, the bushing on the inner leg further may include a slot, and the latch may further include a lower projection configured to engage the slot in a locked position. In other examples, the trigger may be pressed upwards to rotate the latch projection out of the slot in the bushing thereby unlocking the inner leg. In still other examples, the slot may be generally rectangular shaped and may further include a plurality of notches configured to engage the lower projection, and the plurality of notches may correspond to a plurality of different telescoping leg positions. In other examples, the inner leg may telescope out of the outer leg when the leg locking system is in an unlocked position, and the chair may be folded and stored in the unlocked position.

In some examples, a leg locking system for a folding chair is described herein and may include a trigger housing, a trigger, a latch, and a pair of vertical legs for a folding chair. In some examples, the leg locking system may include at least one of the vertical legs including an inner leg and an outer leg and the inner leg may be configured to telescope out of the outer leg and at least one of the vertical legs may be provided with the leg locking system for locking the outer leg to the inner leg. In still other examples, the leg locking system may include a bushing on the inner leg with a slot. In other examples the latch may include a lower projection configured to engage the slot in a locked position. In some examples, the trigger may be pressed upwards by a user to rotate the latch projection out of the slot in the bushing thereby unlocking the inner leg. In still other examples, the inner leg telescopes out of the outer leg when the leg locking system is in an unlocked position, and the chair is foldable in the unlocked position. In other examples, the trigger and the trigger housing may be substantially an upside-down "L" shaped. In some examples, the trigger may be configured to fit substantially within the trigger housing when the trigger is engaged with the trigger housing. In yet other examples, the locking system may also include a spring configured to bias the lower projection in the locked position. In still other examples, the pair of vertical legs may both comprise an inner leg and an outer leg and the inner leg may be configured to telescope out of the outer leg and each of the pair of vertical legs may be provided with the leg locking system for locking the outer legs to the inner legs.

In other examples, a foldable chair described herein may include a seat pan formed by a pair of seat bars, the seat pan may be tensioned by a pair of vertical legs, a backrest being formed by a pair of diagonally extending backrest bars, a front frame formed by a pair of cross bars, a rear frame formed by rear cross bars, and a pair of armrests. In some examples, the seat pan and the backrest may be formed of a suspension fabric. In other examples, the suspension fabric may have an overlap and a core placed into a hollow section created by the overlap and the core in the hollow section may be secured in a notch asymmetrically located in a top portion of the pair of diagonally extending backrest bars. In some examples, the vertical legs may each be provided with an inner leg and an outer leg and the inner leg may be configured to telescope out of the outer leg. In yet other examples, each of the vertical legs may include a leg locking system for locking the outer leg to the inner leg when the chair is in an unfolded position. In some examples, the leg locking system may include an trigger housing, a trigger, and a latch, and the latch may be configured to engage a bushing on the inner leg, and the bushing on the inner leg may further include a slot, and the latch may further include a lower projection configured to engage the slot in a locked position. In other examples, the backrest may include a tensioner configured to maintain the backrest in a tensioned position, the tensioner may also include a rear tensioner handle, and a pair of rear tensioner arms.

These and various other features will be described more fully herein.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing Summary, as well as the following Detailed Description, will be better understood when considered in conjunction with the accompanying drawings in which like reference numerals refer to the same or similar elements in all of the various views in which that reference number appears.

FIG. 12A1 shows a rear view of another example chair with a backrest locking mechanism;

FIGS. 12A2-12D show various views of the locking mechanism of FIG. 12A1;

FIG. 24A illustrates the backrest tensioning mechanism rear tensioner with the rear tensioner cover separated from the rear tensioner.

Figure 1:
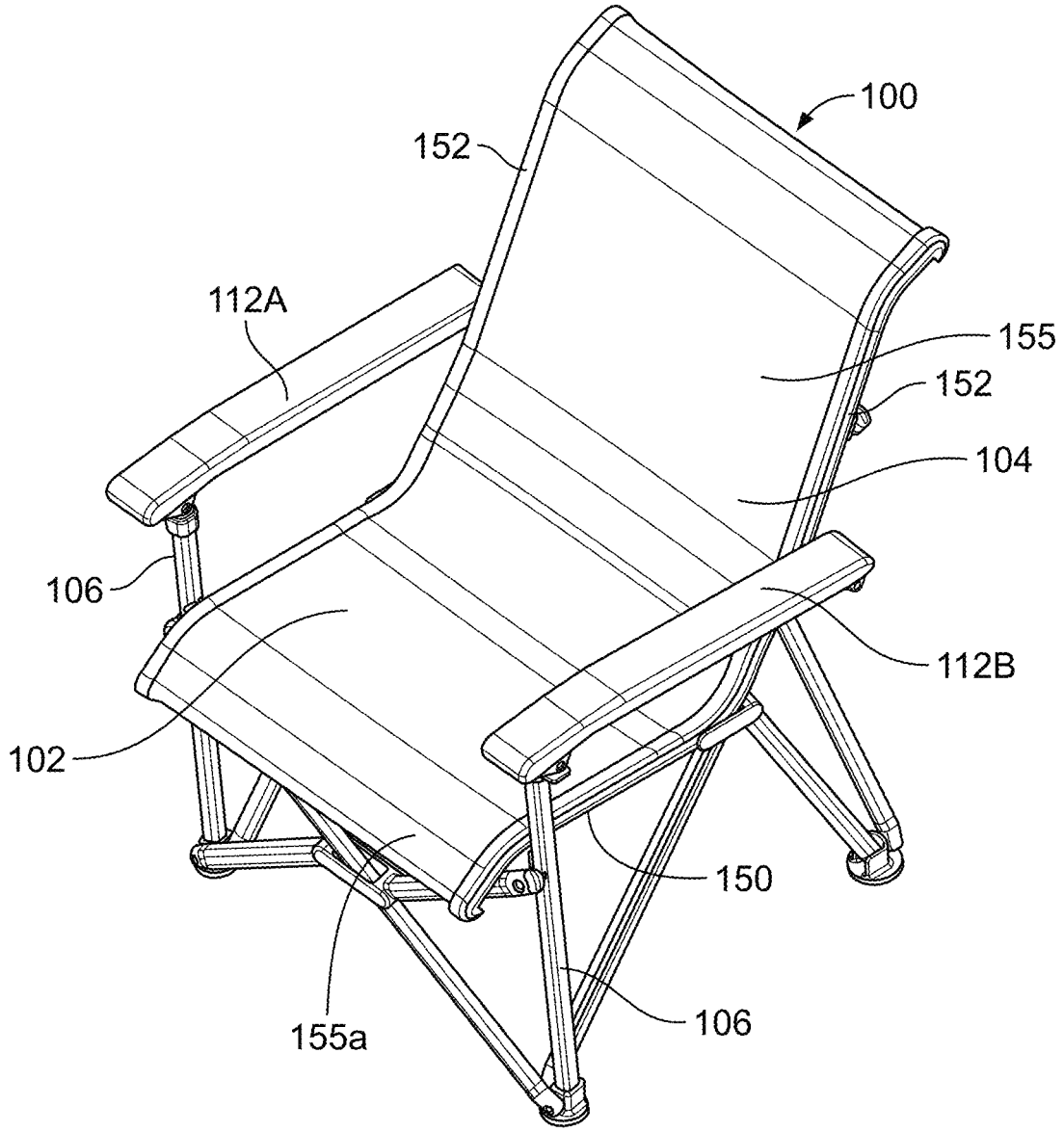
FIGS. 1-6 show various views of an example folding chair.

Further, it is to be understood that the drawings may represent the scale of different components of one single embodiment; however, the disclosed embodiments are not limited to that particular scale.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

FIG. 1-6 show an example chair. The chair 100 may include a seat pan 102 and a backrest 104. In one example, the seat pan 102 and the backrest 104 can be formed of an elastomeric suspension fabric 155 that is tensioned when the chair is in the unfolded position. When the user sits in the chair 100 the fabric conforms to their body and creates a comfortable seating surface that does not create any pressure points. Additionally, the seat pan 102 is tensioned by vertical legs 106.

The seat pan 102 can be formed by a pair of seat bars 150, which are connected together by an upper fabric 155. In one example, the lower fabric 155*a* can be provided with slots for receiving a core and the core can be placed into channels formed in the seat bars 150. The backrest can be formed by a pair of diagonally and/or parallel extending backrest bars 152. The upper fabric 155 can be provided with slots for receiving a core, and the core can be placed into asymmetrical channels formed in the backrest bars 152. The backrest bars 152 can extend to lower portions of the vertical legs 106 and front cross-bars 142, 144 the front of the chair 100. In certain examples, the fabric of the chair can be formed of an elastomeric suspension fabric is that is made to be UV resistant, which makes the chair less likely to fade over time.

Figure 33B:
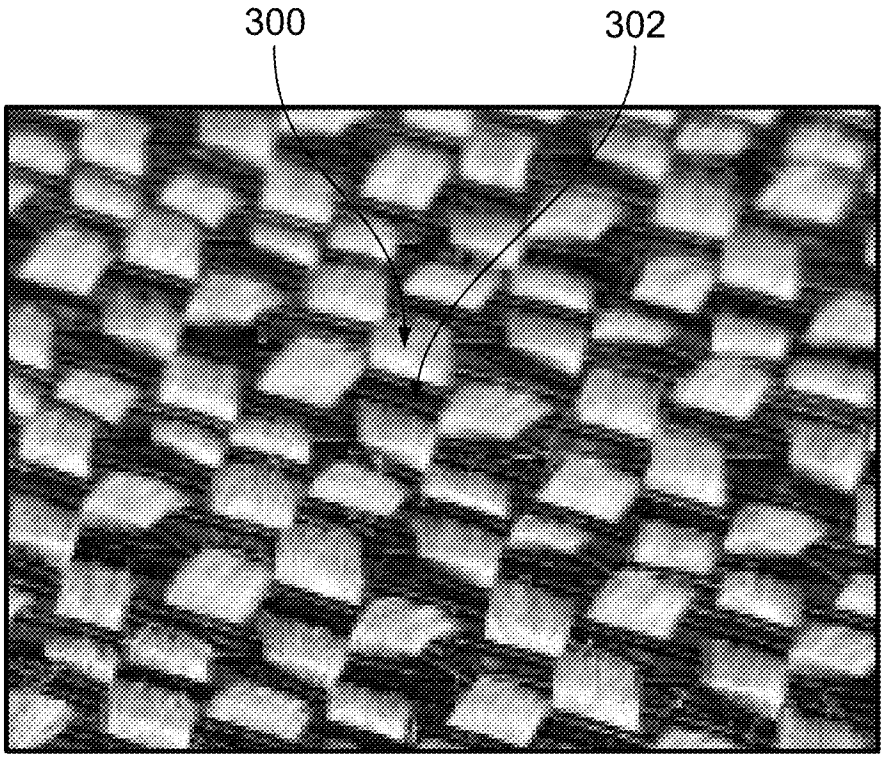
FIGS. 33A-33C illustrate the construction and materials of an example suspension fabric.
Figure 33A:
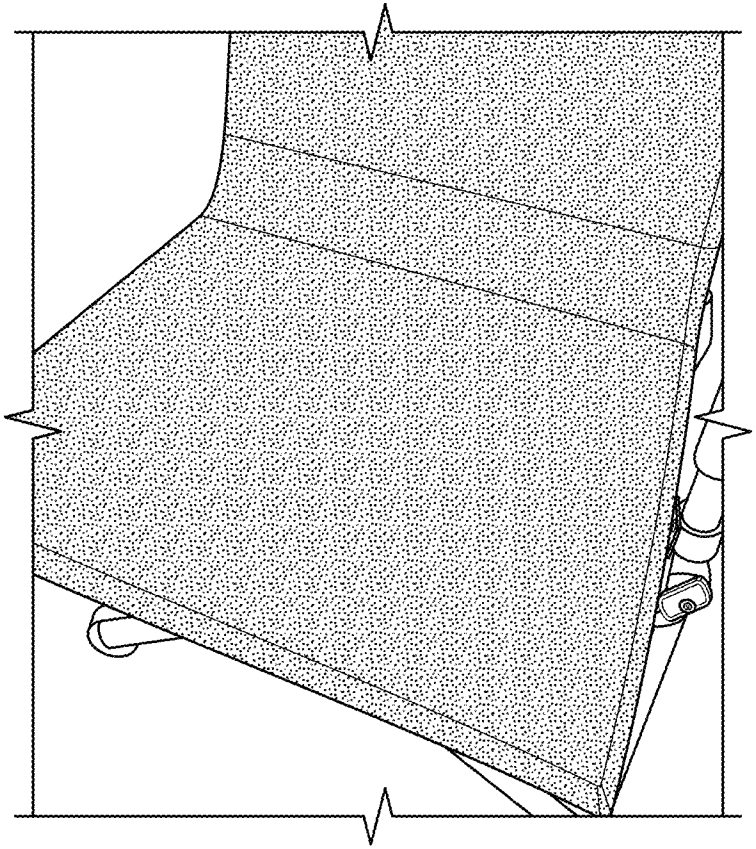

In certain examples, the seat pan 102 suspension material and/or the backrest 104 suspension material may be elastomeric. In other examples, the seat pan 102 suspension material and/or the backrest 104 suspension material may be constructed of a weaved material with yarn having elastomeric properties. The elastomeric properties include the ability to stretch and deform under stress (i.e., increased elasticity), such as tension or weight. The elastomeric properties allow the suspension material to return to its original form and the ability to resist creep and/or permanent deformation when the stress from the load is removed. In one example, as shown in FIGS. 33A and 33B, the suspension material can be formed as a first yarn 300, which can be formed of an acrylic or polymer and blends thereof, and a second yarn 302 that can be formed of an elastomeric material such that the second yarn is more elastomeric than the first yarn. The elastomeric properties of the second yarn can help to provide the elastomeric properties of the suspension material discussed above.

Figure 33C:
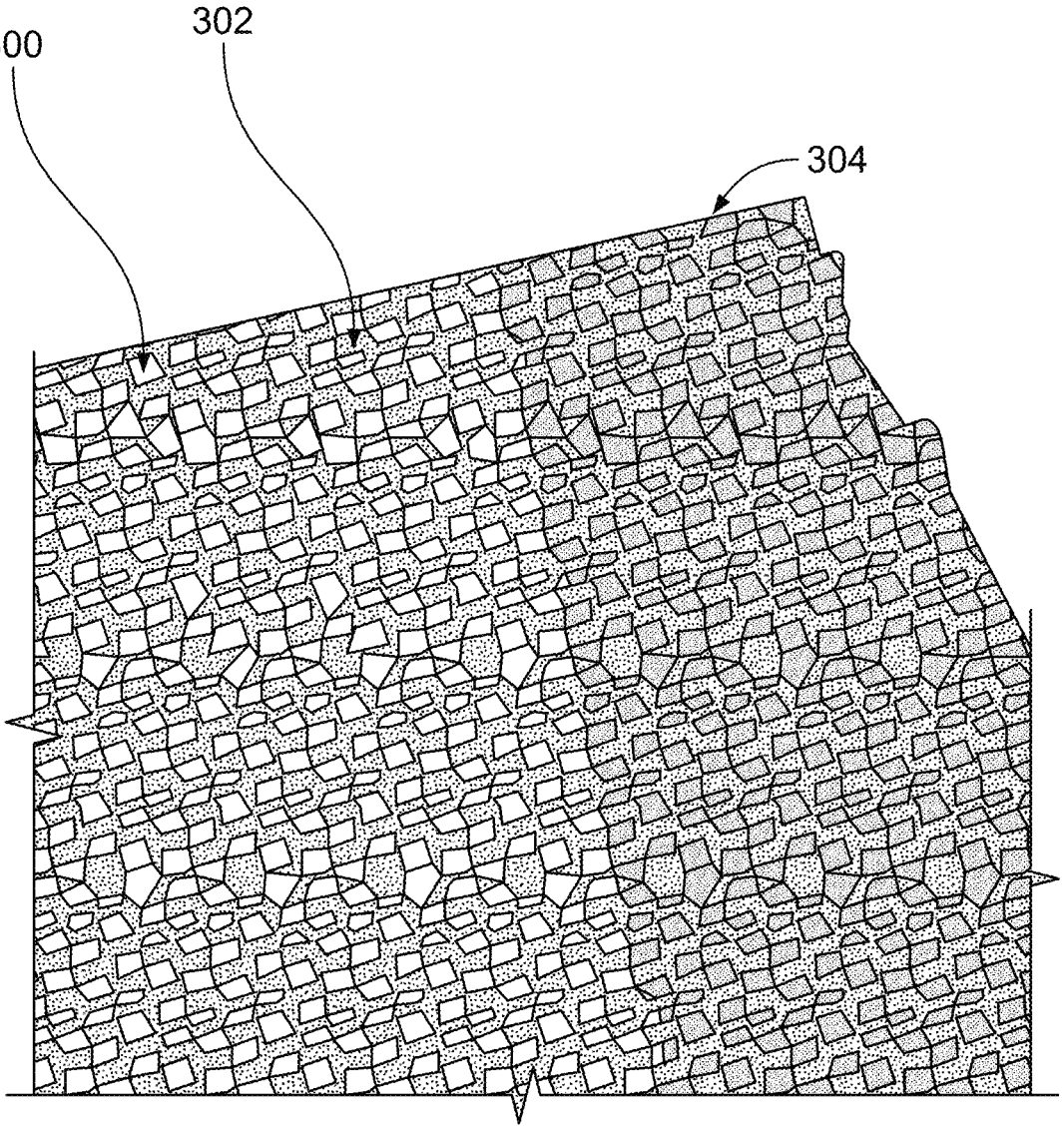
Figure 34:
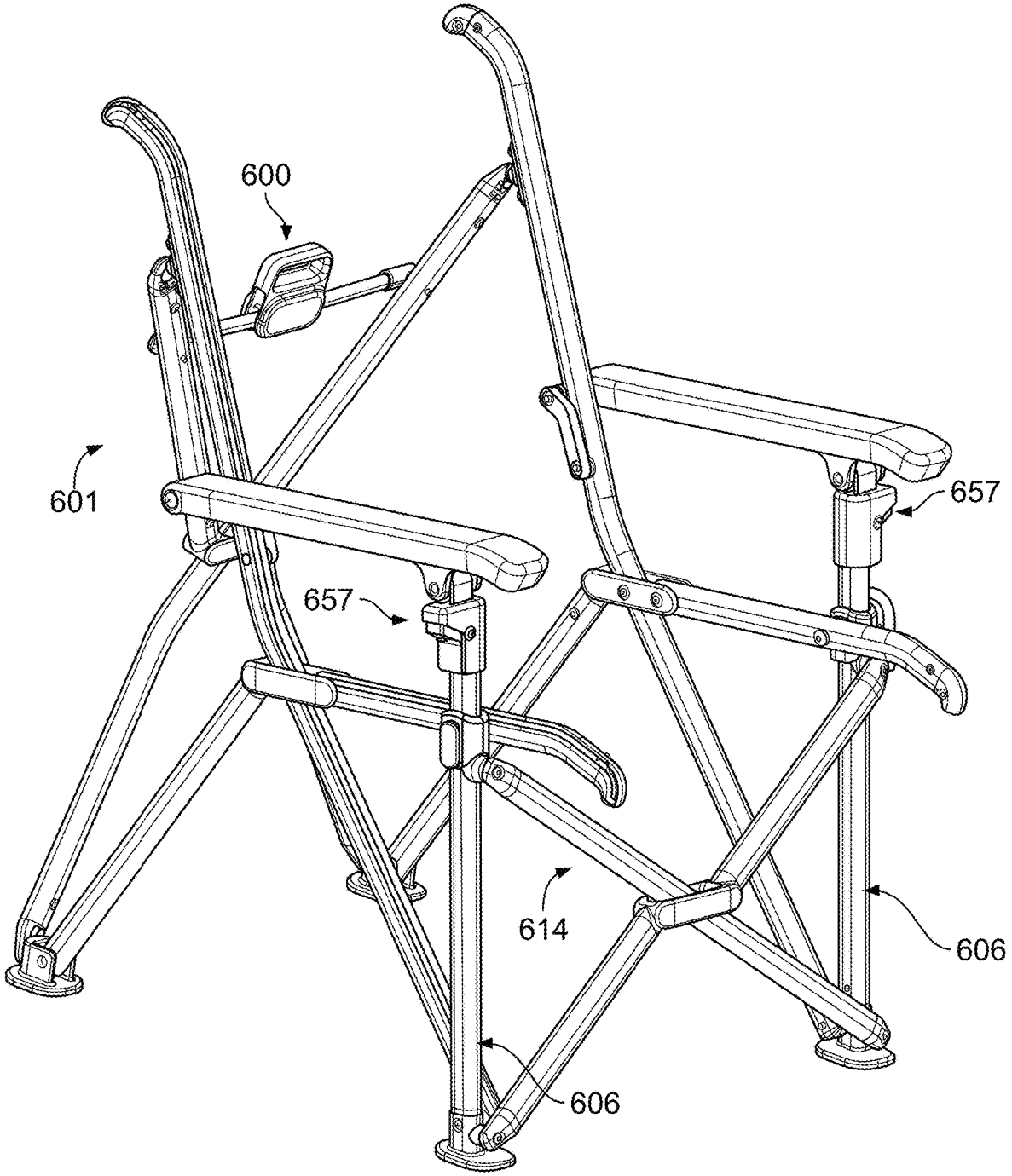
FIG. 34 illustrates another example folding chair disclosed herein.

In still other examples, as shown in FIG. 33C, the seat pan 102 suspension material and/or the backrest 104 suspension material may also include a thermoplastic polyurethane film (TPU) 304 that is heat pressed to one or both sides of the suspension material. For example, the TPU 304 can be added to the top side of the fabric, the bottom side of the fabric, or both sides of the fabric after the yarns are weaved. In yet other examples, the seat pan 102 suspension material and/or the backrest 104 suspension material may also include a TPU film heat pressed to the first polymer yarn and the second yarn, after the yarns are weaved. The addition of a TPU film heat pressed to the suspension material may be advantageous in certain applications. For example, the addition of TPU may create a mechanical bond that is resistant to combing and fraying once the material is sewn together and extend the life of the suspension material. In some examples, the TPU film may have a thickness of at least 0.1 mm, 0.02 mm, 0.03, 0.04 mm 0.05 mm, 0.06 mm, 0.07 mm, 0.08 mm, 0.09 mm, or 0.10 mm thick. In still other examples, the TPU layer or film may be substituted with any elastomeric material that has a melting point lower than the first and second yarn to allow the material to be heat pressed to the suspension fabric after the yarns are weaved.

Figure 2:
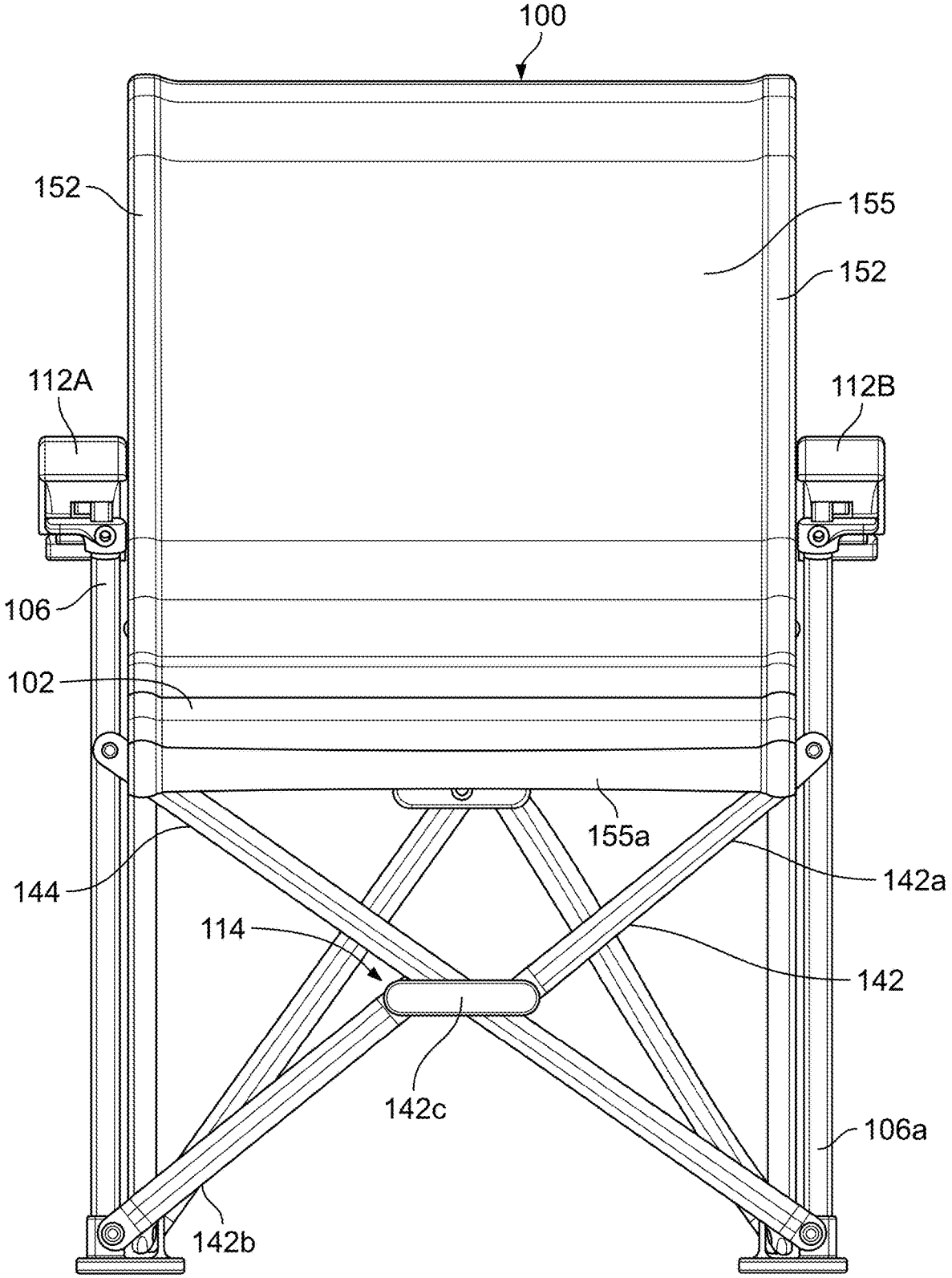
Figure 4:
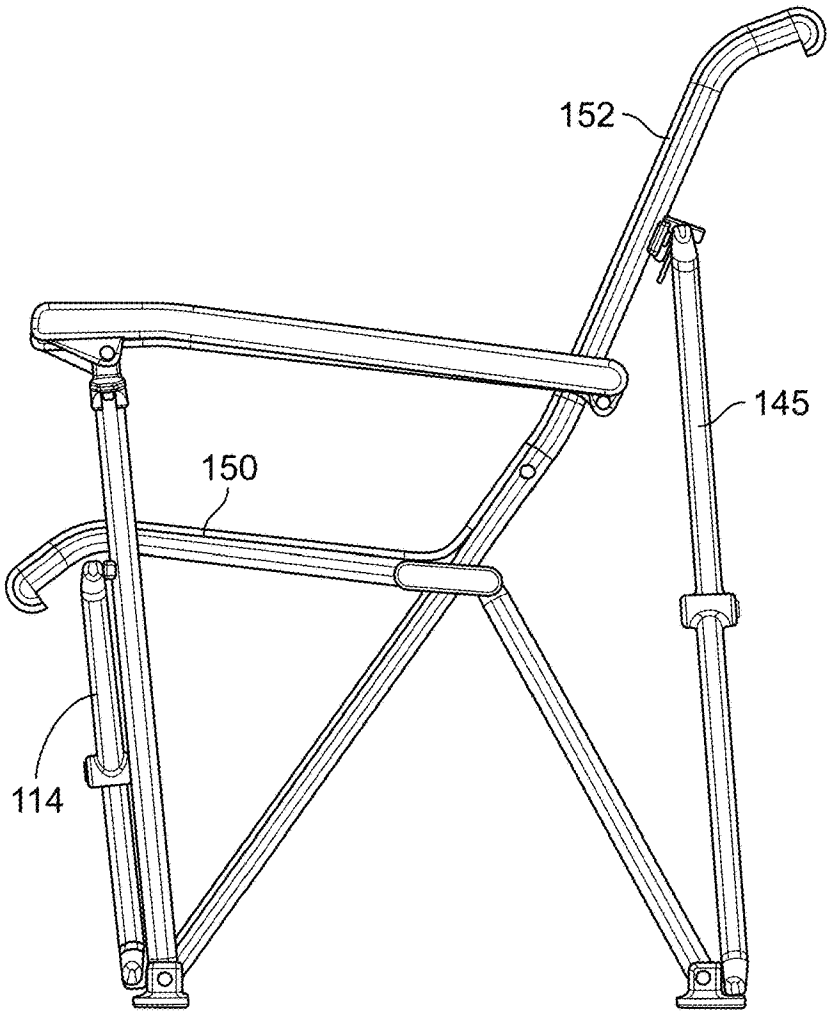
Figure 3:
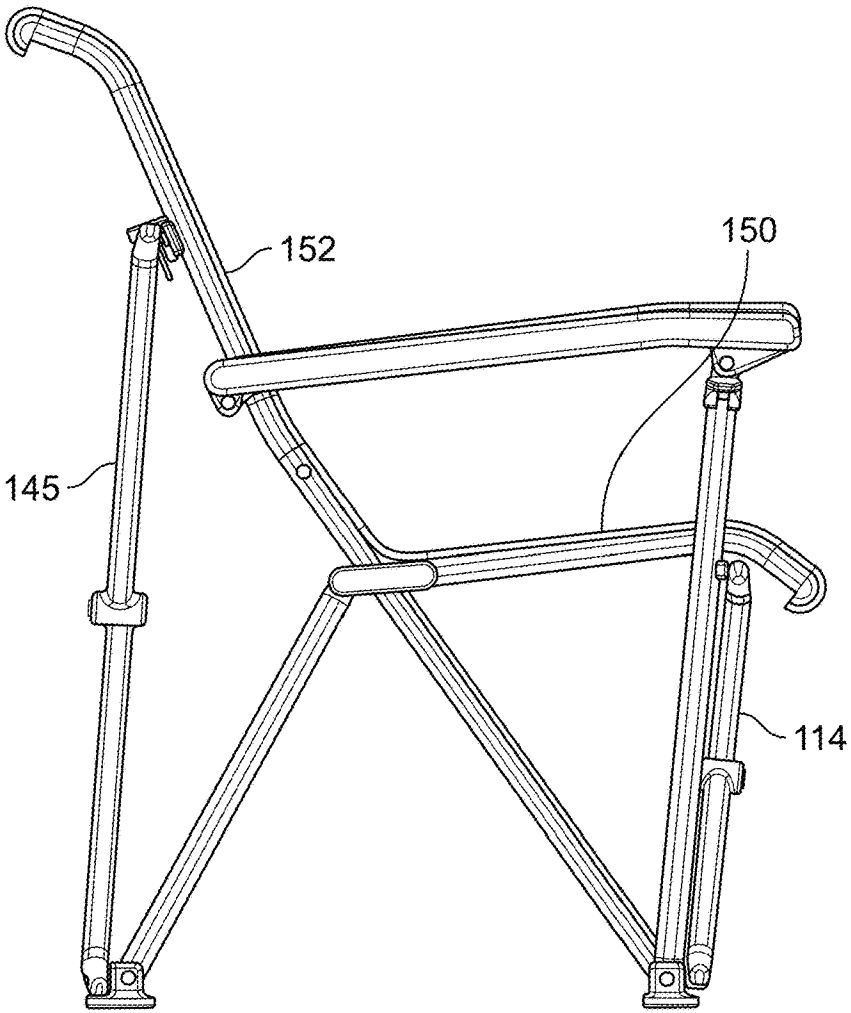
Figure 5:
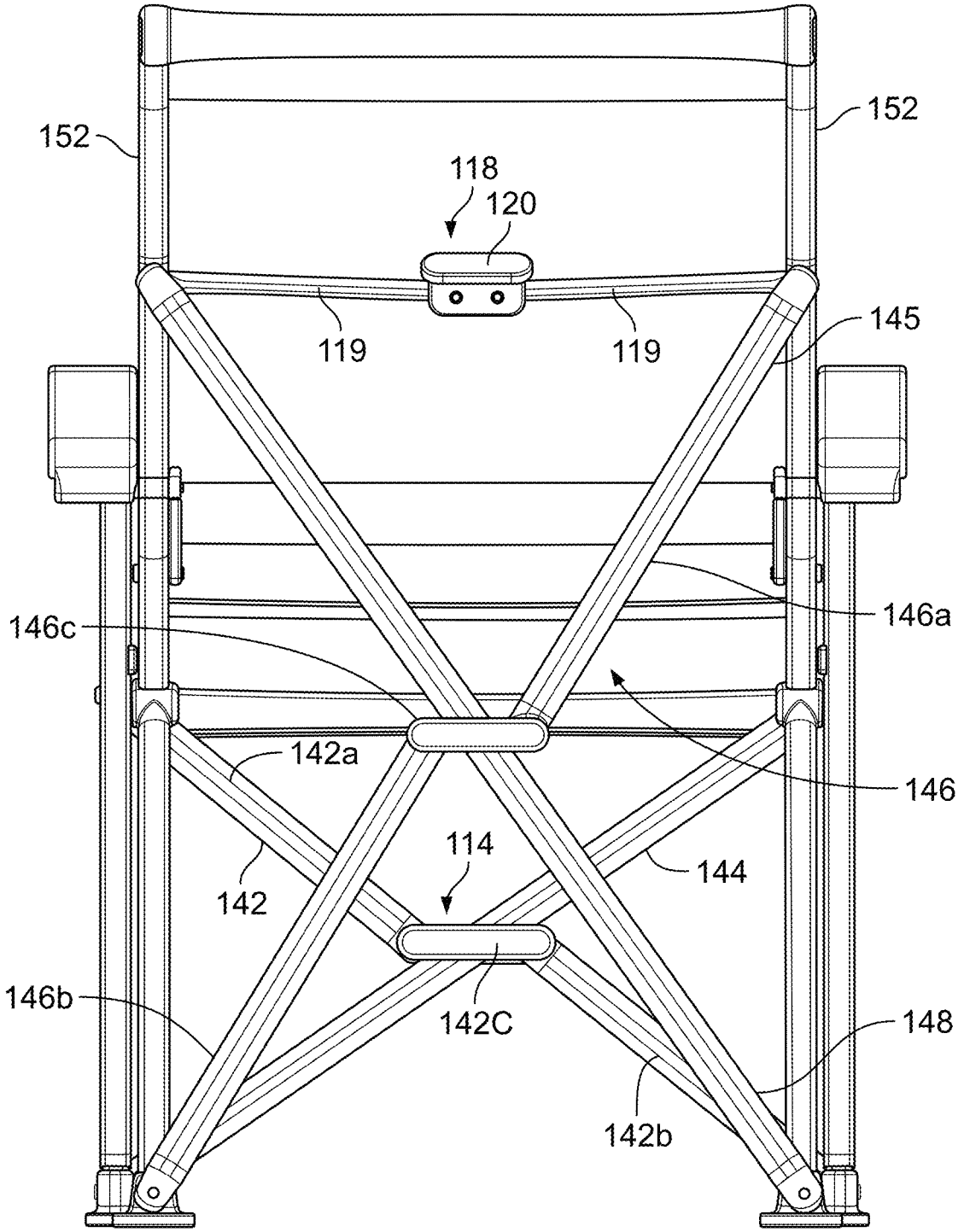
Figure 6:
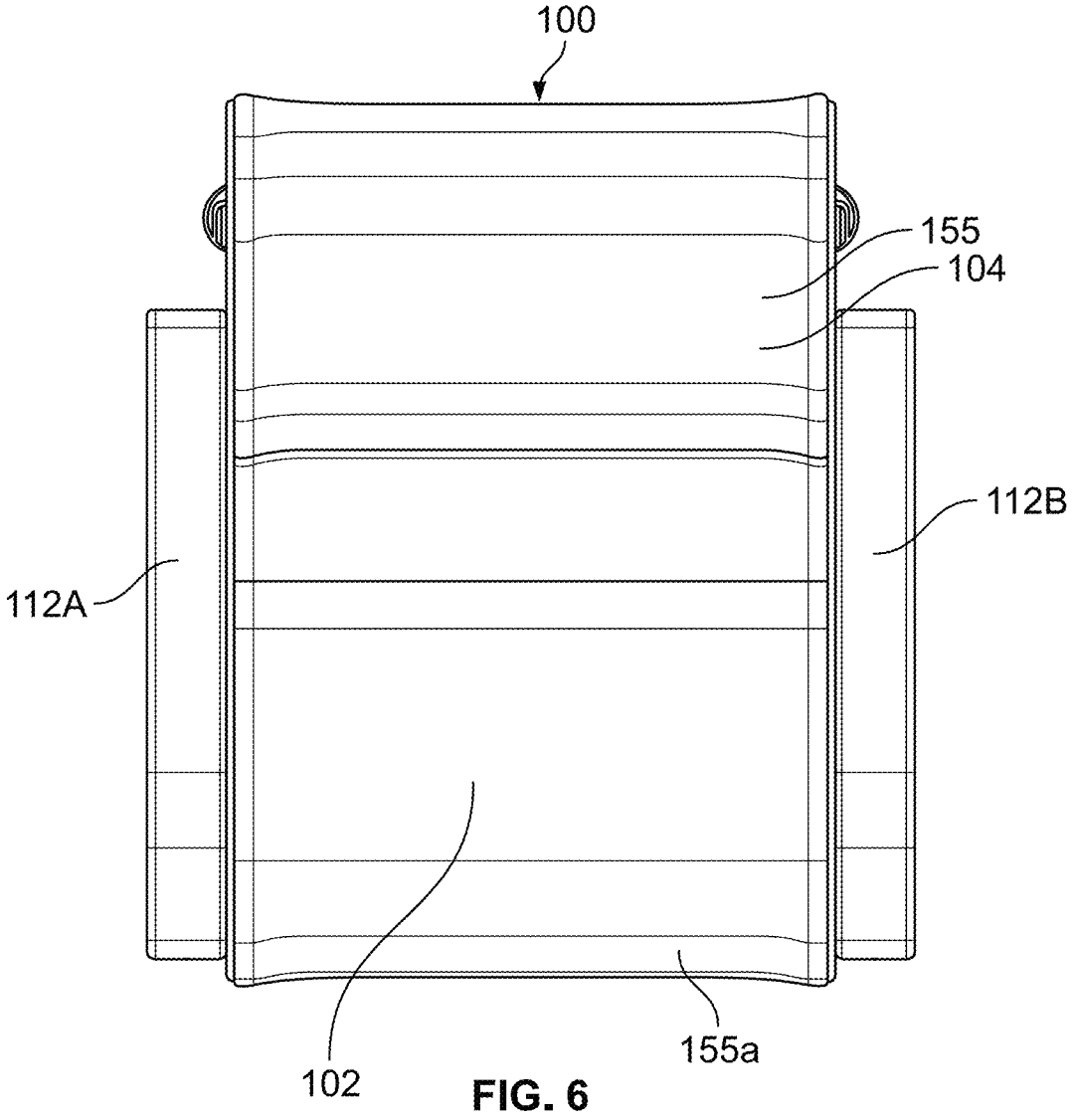

The chair 100, as shown in FIGS. 2 and 5, can include a front X frame 114 formed by the front cross-bars 142, 144. The front cross-bar 142 can be formed by separate front linkages 142*a* and 142*b* connected by front bracket 142*c*. Likewise, the chair 100 can include a rear X frame 145 formed by rear cross-bars 146 and 148. The rear cross-bar 146 can be formed by separate rear linkages 146*a* and 146*b* connected by bracket 146*c*. The chair, as shown in FIG. 1, 100 may also include a pair of armrests 112A, 112B.

The chair 100 is configured to be folded for easy transport and storage. Cross-sectional views of an example vertical leg 106 is shown in FIGS. 7A and 7B. The vertical leg 106 is made up of a lower inner leg or tube 106*a* and an upper outer leg or tube 106*b*. The inner leg 106*a* telescopes out of the outer leg 106*b* as the chair 100 is folded. In this way, when the inner leg 106*a* moves out of the outer leg 106*b*, the front linkages 142*a* and 142*b* pivot about the front bracket 142*c* and the ends of the front linkages 142*a* and 142*b* move toward one another. Likewise, when the chair is folded, the rear cross-bar 146 separate rear linkages 146*a* and 146*b* pivot on bracket 146*c* and the ends of the linkages 146*a*, 146*b* move toward one another. This allows the chair to be in a folded or collapsed state where the chair folds into a rectangular or cylindrical profile and can be placed into a bag or case with a corresponding profile. In one example, the length of the folded profile can be defined as the length of the backrest bars 152.

Figure 7:
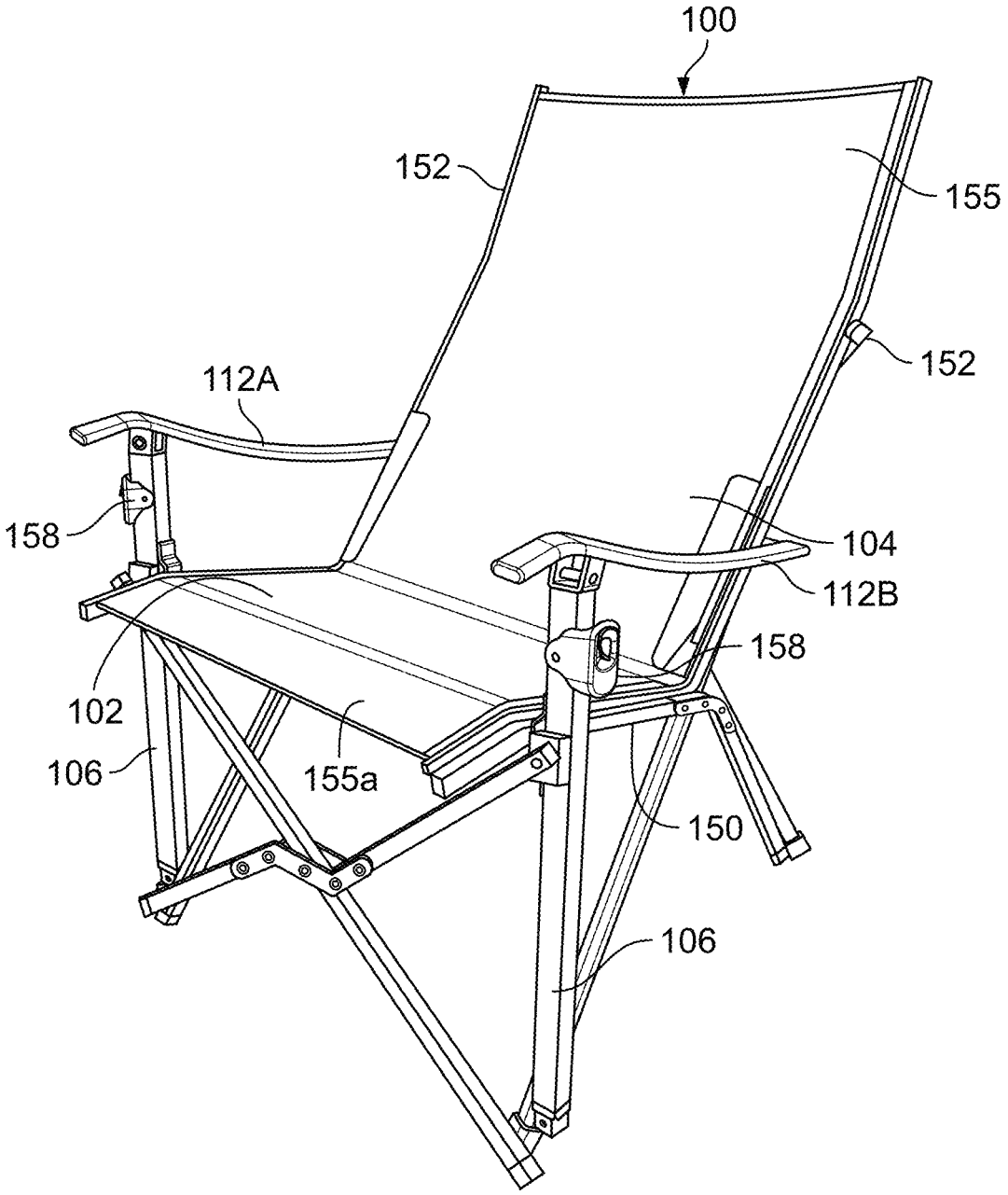
FIG. 7 shows another example folding chair.
Figure 7B:
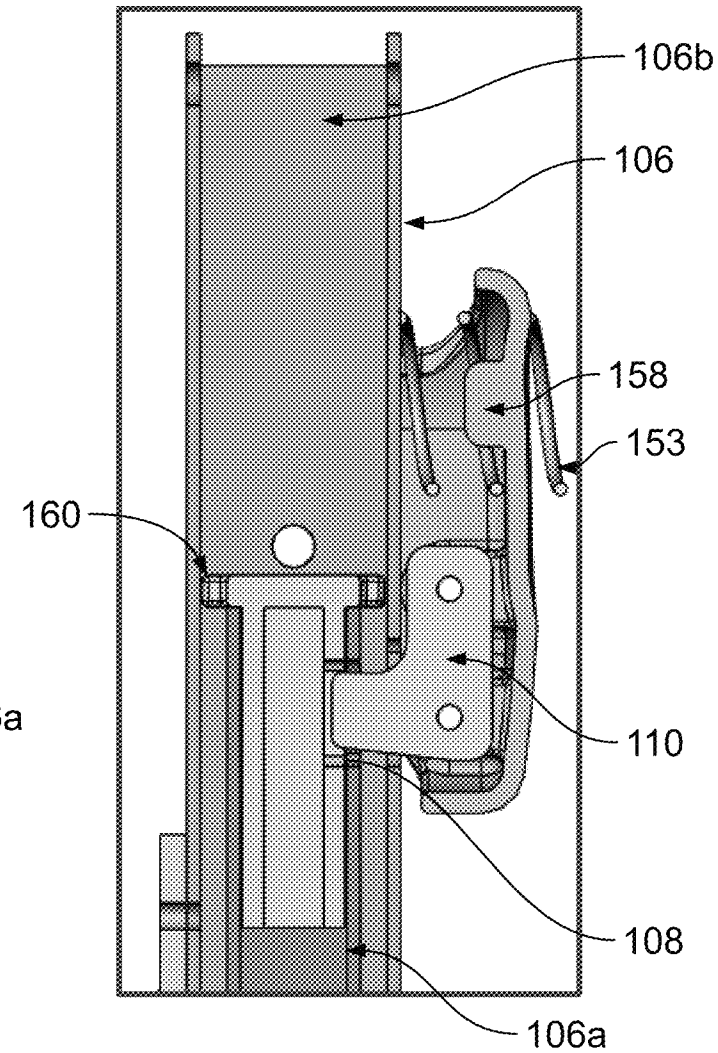
FIGS. 7A and 7B show cross-sectional views of a portion of an example front leg and associated locking mechanism.
Figure 7A:
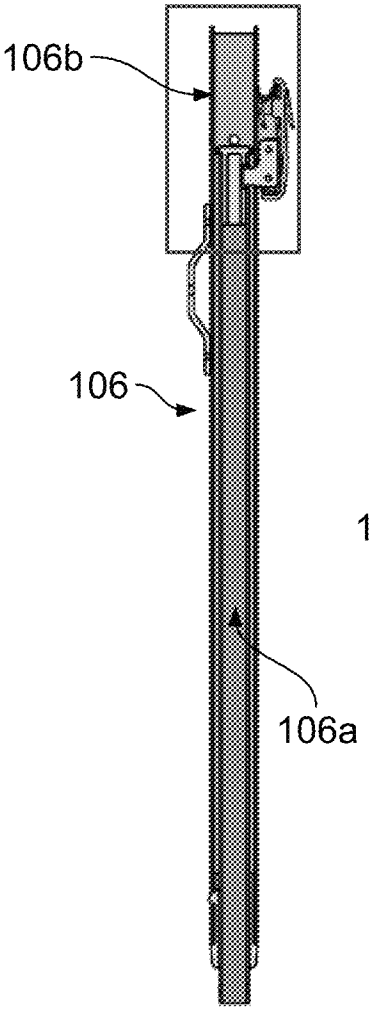

FIGS. 7, 7A, and 7B also show an exemplary latch 110 for locking the outer leg 106*b* to the inner leg 106*a*. The inner leg 106*a* can include a slot 108, and the outer leg 106*b* can include a latch 110 that can be positioned in the slot 108 to lock the outer leg 106*b* to the inner leg 106*a* when the chair is fully opened. When the user presses downwardly on the front of the armrests 112A, 112B, the latch 110 locks into the slot 108. The latch 110 prevents the inner leg 106*a* from telescoping outward toward the folding position. Because the vertical leg 106 is attached to the top and bottom of the front X frame 114, it expands the X frame 114 to widen the seat pan 102 and tensions the fabric. In this example, both sides of the chair can have the latch 110 to maintain the chair in the unfolded position during use. However, in other examples, only one latch may be provided. The vertical leg can also be provided with a rocker 158 for releasing the latch 110. The latch 110 is solidly attached to and pivots on the rocker 158 so the rocker can move the latch 110 out of the slot 108 of the inner leg 106*a* and unlatches the mechanism allowing the inner leg 106*a* to telescope and for the chair to fold. A spring 153 can also be included to bias the rocker 158 such that it holds the latch 110 in place in the slot 108. To un-latch the vertical leg, the user simply presses the top of the rocker 158. The upper ends of the inner leg 106*a* may also be provided with stops 160 that prevent the inner leg 106*a* from moving out of the outer leg 106*b*. In other examples, the latch 110 for locking the outer leg 106*b* to the inner leg 106*a* may consist in part of a telescoping clamp, a button clip device, a quick release ball lock pin, a locking button, internal push button, a flip lever clamp, or similar device.

In one example, the inner leg 106*a* and the outer leg 106*b* can be formed of aluminum or any other suitable strong lightweight material. The latch 110 can be formed of stainless steel for strength and corrosion resistance or other suitable material with similar characteristics such as a plastic, glass filler nylon, carbon fiber, or other rigid composites or laminates. Likewise, the rocker 158 can, in certain instances, be made out of glass filler nylon, plastic, carbon fiber, or other rigid composites or laminates for strength.

Figures 9, 10, 11, 12:
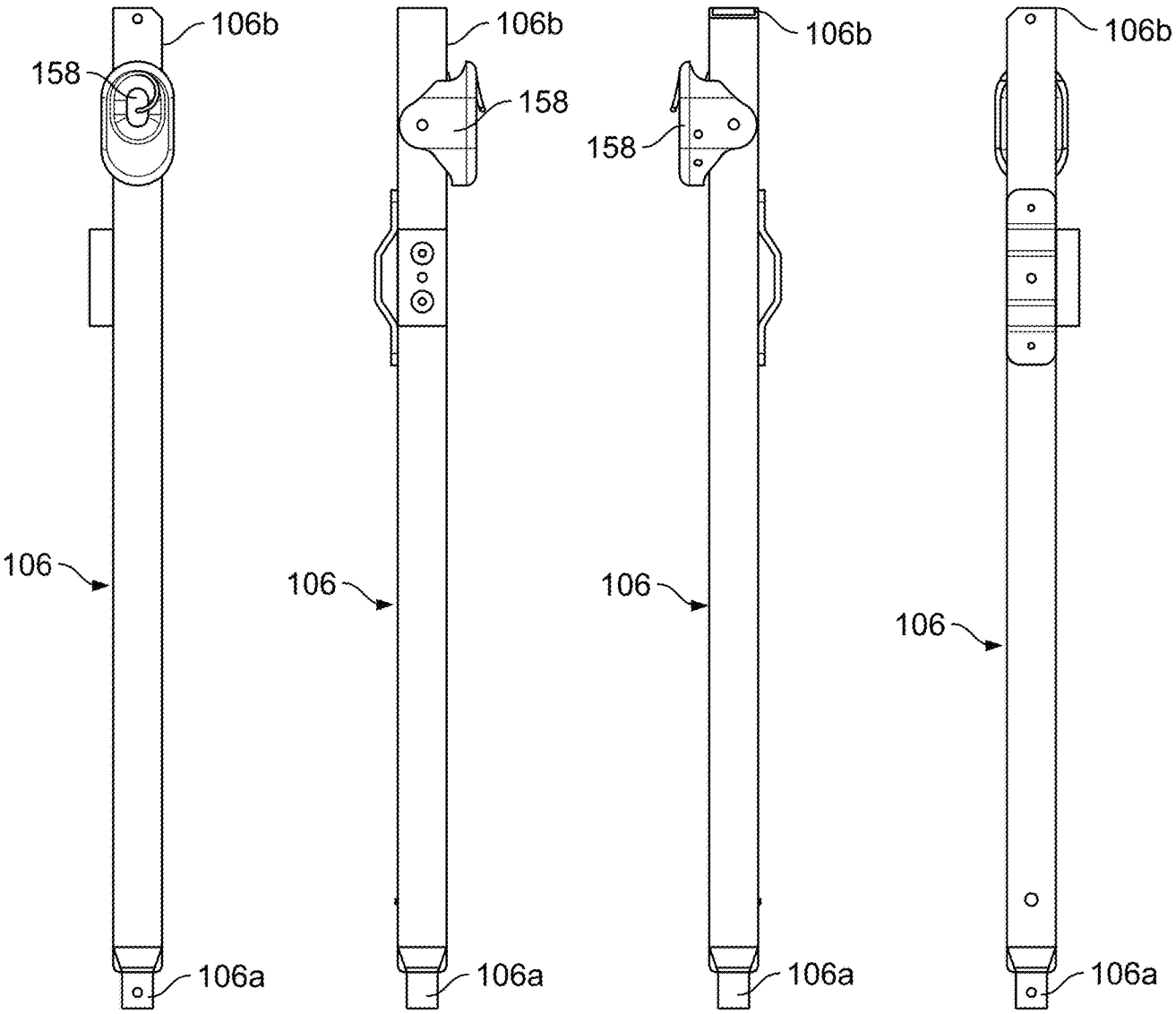

In one example, the backrest 104 can be tensioned by an over-center latch 118 that is made out of four separate components: a center handle 120, two links 119, and an insert 121. The over-center latch 118 can be seen on the chair in FIG. 12A1. A perspective view of the over-center latch 118 is shown in FIG. 12A1, a cross-sectional view is shown in FIG. 12C, and a rear view is shown in FIG. 12D. The over-center latch 118 is activated by the use by pressing down on the center handle 120. The latch 118 is disengaged when the user pulls up on the center handle 120. The latch 118 tensions the fabric by forcing it wider and then the latch 118 goes over center to maintain the width. The downward stop in the latch is accomplished when ends of the links 119 contact the upper portion of the insert 121.

To engage the over-center latch the user simply presses downwardly on the handle 120 such that the links 119 force the rear X frame 145 outward so that the fabric 155 is tensioned in the backrest 104. To release the over-center latch 118, the user simply pulls upwardly on the handle 120 such that the tension by the links 119 on the fabric 155 is released.

Figure 13A:
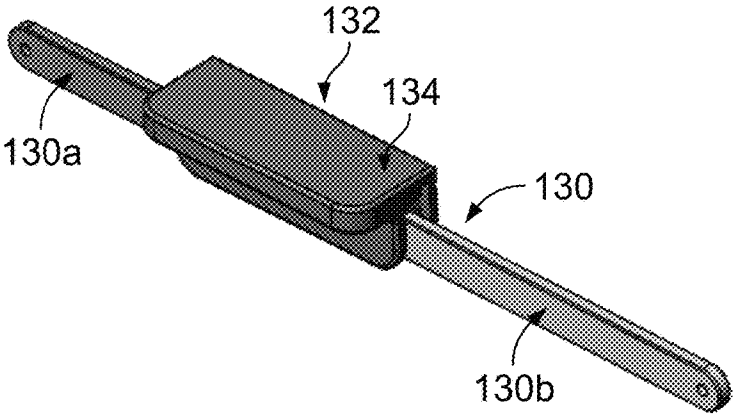
FIGS. 13A-13C show various views of the backrest locking mechanism of FIG. 13.
Figure 13B:
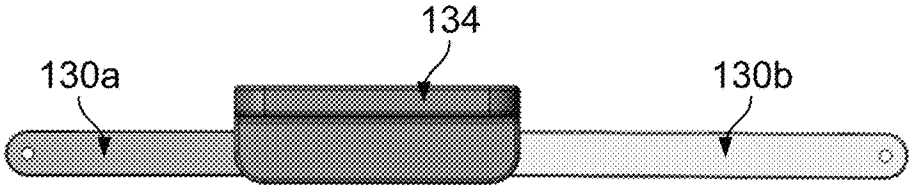
Figure 13C:
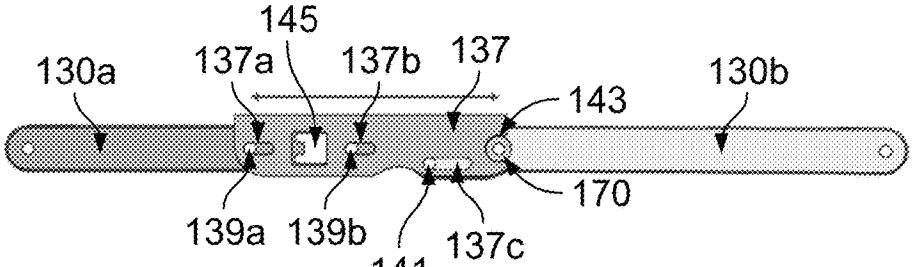
Figure 13:
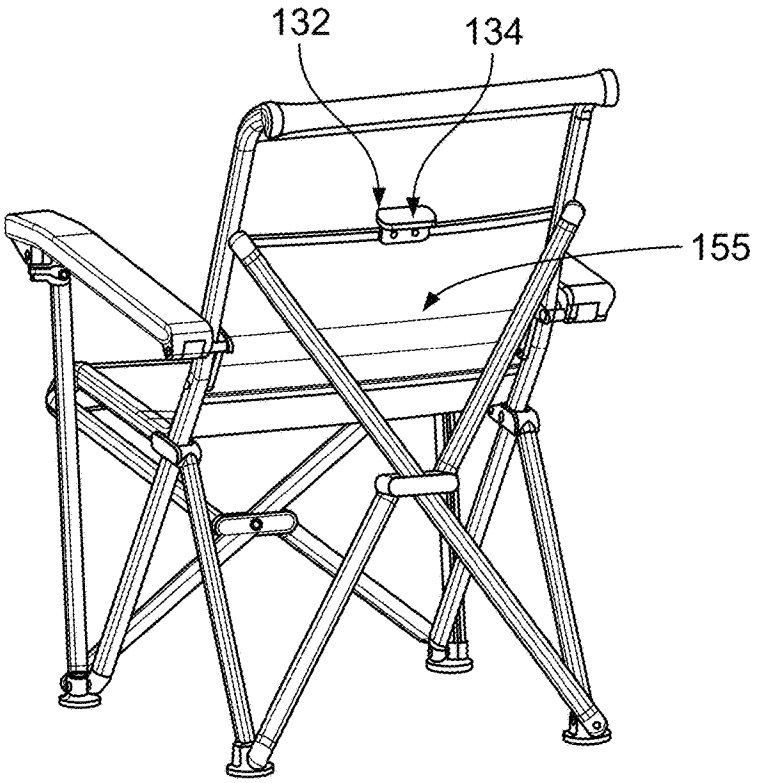
FIG. 13 shows a rear perspective of another example chair with an alternative backrest locking mechanism.

FIGS. 13-13C show another method of tensioning the backrest 104. In this example, a latch 132 is formed of a two bar linkage 130 comprising links 130*a*, 130*b* that latch when the user pushes a handle 134 connecting the two-bar linkage 130 downward and aligns the links 130*a*, 130*b* in a straight line. The handle 134 can include an insert 137. The insert 137 includes slots 137*a*, 137*b* for receiving pins 139*a*, 139*b* on link 130*a* and slot 137*c* for receiving pin 141 located on link 130*b*. The insert 137 can also include a notch 143 that receives a cam or boss 170 located on link 130*b*. A spring not shown can be included in recess 145 that biases the insert 137 against the link 130*a* to lock the two bar linkage 130 and tension the fabric 155.

The user presses down on the handle 134 to engage the latch 132. This causes the links 130*a*, 130*b* to rotate until they are aligned in a straight line, and the notch 143 is locked into place in the cam 170 located on the link 130*b*. To disengage the latch 132, the user slides the handle 134 to the left. The handle 134 is attached directly to the latch 132. As the handle 134 and insert 137 are moved to the left both slide on the link 130*a*, and the handle 134 and insert 137 disengage from the cam or boss that is attached to the link 130*b*. This allows the link 130*b* to rotate relative to the link 130*a* and allows the chair to fold.

Figure 15B:
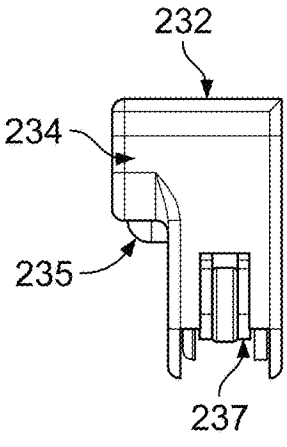
FIG. 15B shows a side view of the example backrest locking mechanism of FIG. 15A.
Figure 15A:
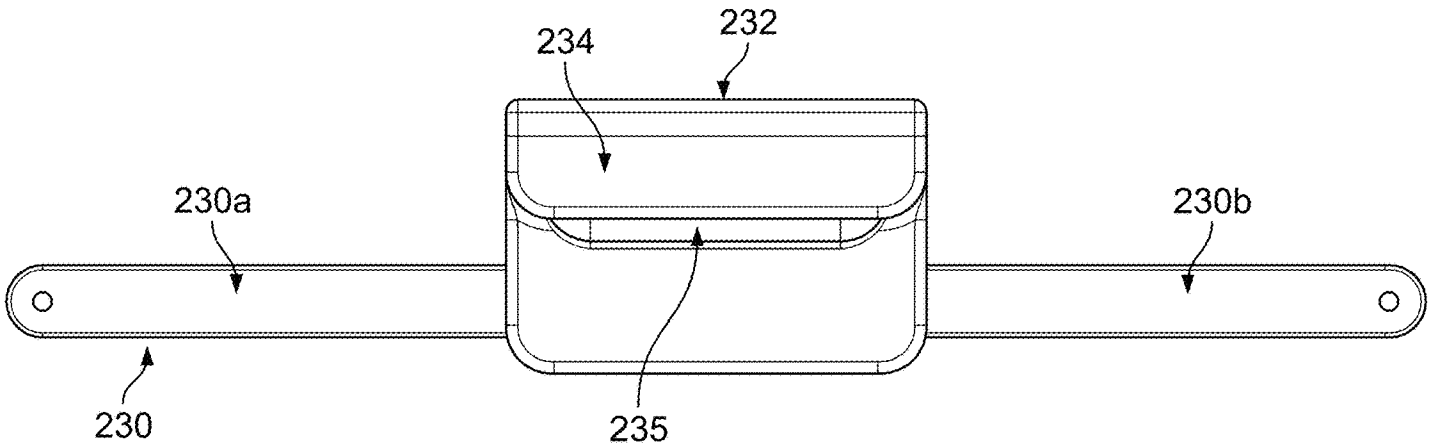
FIG. 15A shows a rear view of another example backrest locking mechanism.

FIGS. 15A-18B show another method of tensioning the backrest 104 in which like reference numerals refer to the same or similar elements having the same or similar functionality in all of the various views in which that reference number appears. In this example, a latch 232 is formed of a two bar linkage 230 comprising links 230*a*, 230*b* that latch when the user pushes a handle 234 connecting the two-bar linkage 230 downward and aligns the links 230*a*, 230*b* in a straight line as shown in FIG. 15A. The handle 234 may include a latch release mechanism 235 that is configured to release the latch from the tensioned position.

Figure 16C:
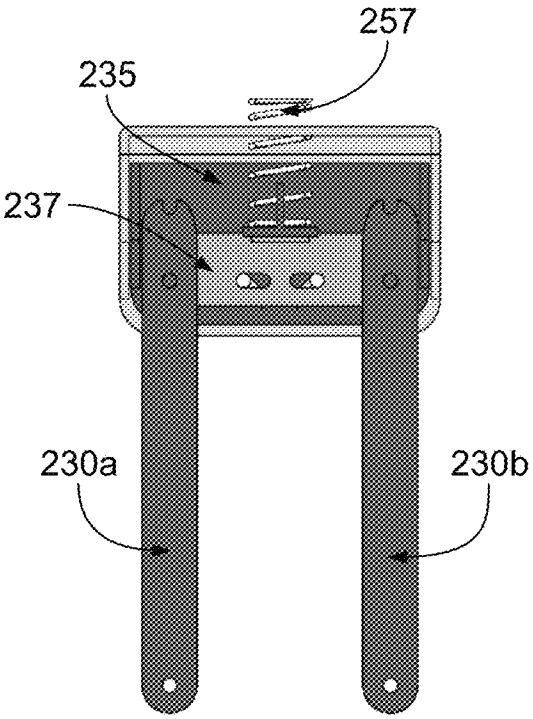
FIG. 16C shows a cross-sectional view of the example backrest locking mechanism of 15A in the folded-up position.
Figure 16A:
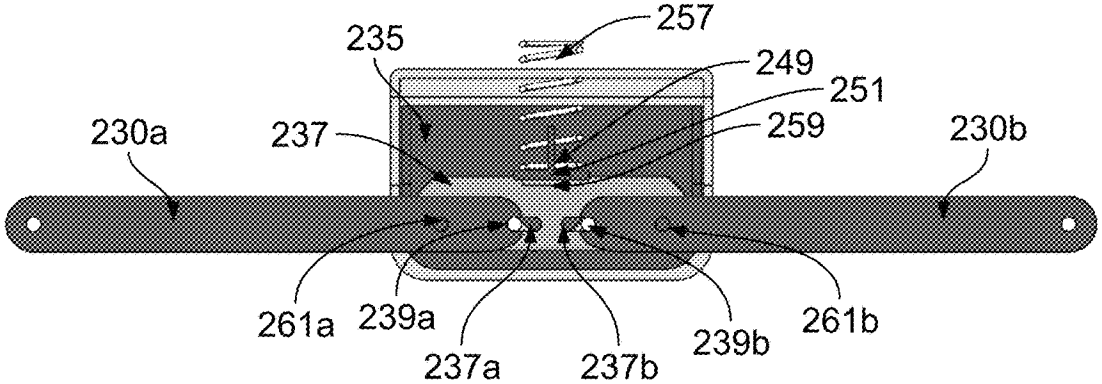
FIG. 16A shows a cross-sectional view of the example backrest locking mechanism of 15A in the tensioned position.
Figure 16B:
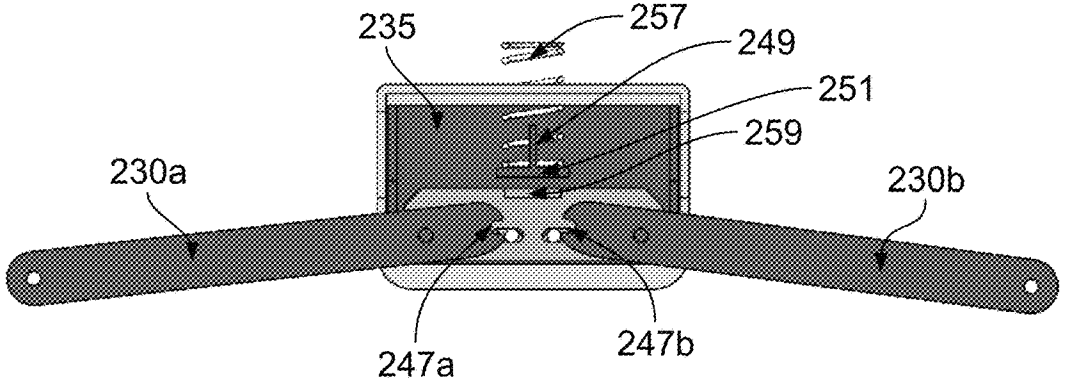
FIG. 16B shows a cross-sectional view of the example backrest locking mechanism of 15A in the released position.

The links 230*a*, 230*b* are configured to hold the backrest of the chair in the unfolded position or sitting position. The links 230*a*, 230*b* are configured to rotate on the backrest frame. As shown in FIGS. 16A-16C, the links 230*a*, 230*b* are also configured to rotate about pivots 261*a*, 261*b* on the insert 237. The links 230*a*, 230*b* can also include a notches 247*a*, 247*b* for receiving the pins 239*a*, 239*b* of the insert. In one example, the receiving notches 247*a*, 247*b* can be located at proximal ends of the links 230*a*, 230*b*.

Figure 15C:
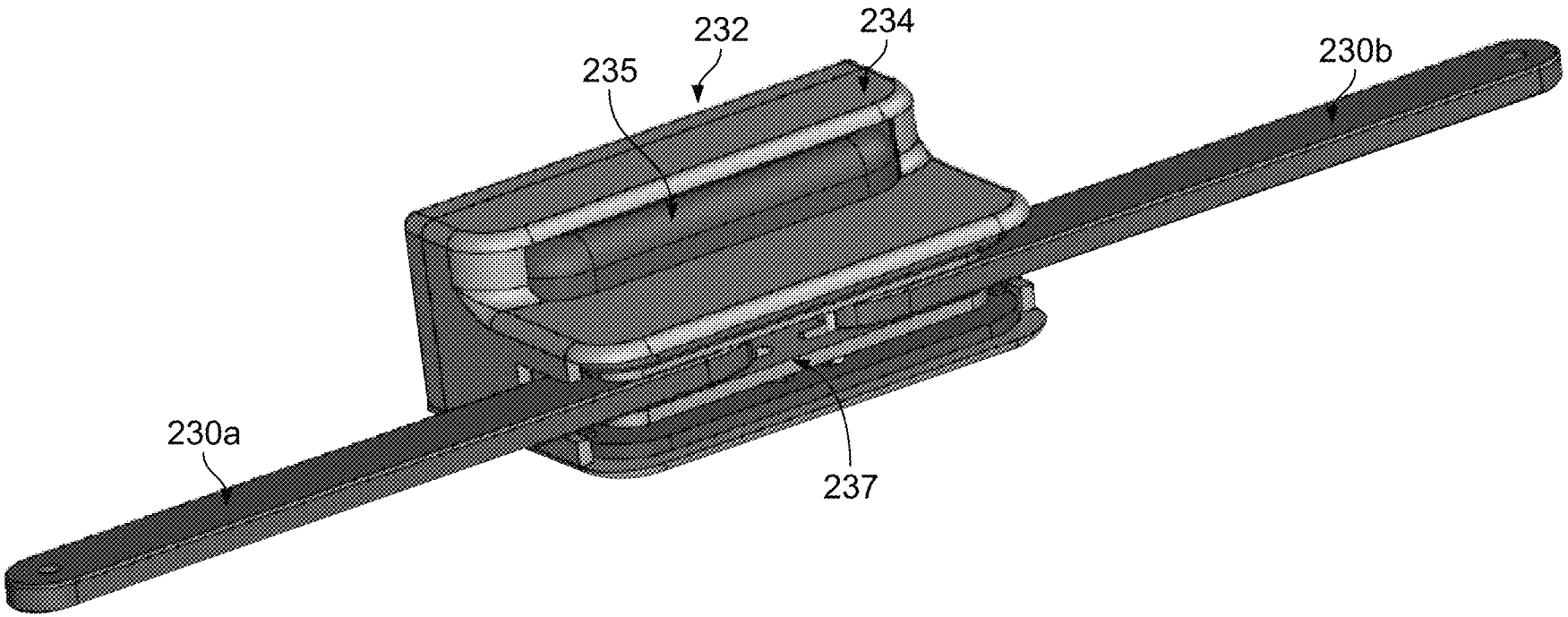
FIG. 15C shows a bottom perspective view of the example backrest locking mechanism of FIG. 15A.

Also shown in FIGS. 16A-18B, the handle 234 can include an inner bracket or insert 237. The insert 237 includes slots 237*a*, 237*b* for receiving pins 239*a*, 239*b*. The slots 237*a*, 237*b* can be located inwardly on the insert. The insert 237 can also include a pair of pivots 261*a*, 261*b* located on the insert outwardly from the slots 237*a*, 237*b* for receiving the links 230*a*, 230*b*. The insert 237 can also include a projection 259 for abutting the latch mechanism 235. In one example, as shown in FIG. 15C, the insert 237 can be formed of a pair of plates.

Figure 17B:
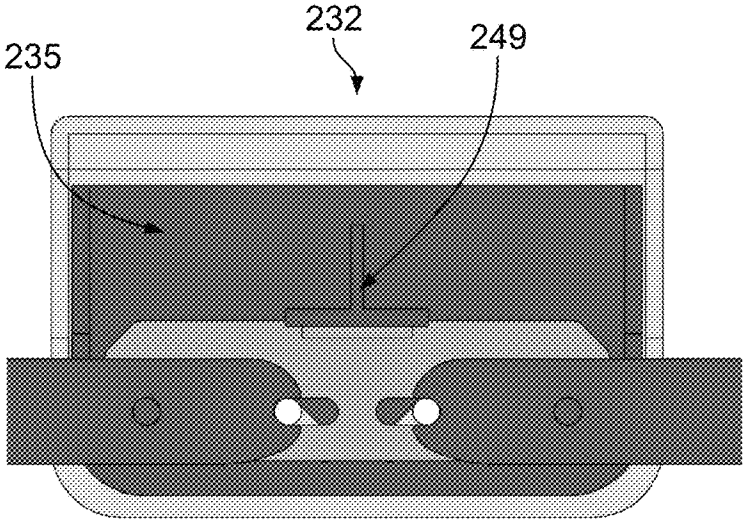
FIG. 17B shows a rear cross-sectional view of the example backrest locking mechanism of FIG. 15A in a tensioned configuration.
Figure 17A:
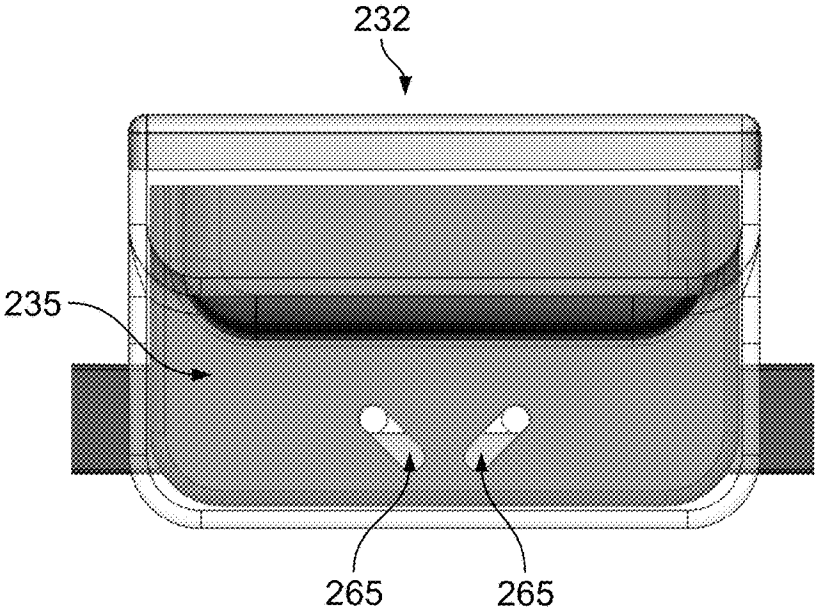
FIG. 17A shows a front cross-sectional view of the example backrest locking mechanism of FIG. 15A in a tensioned configuration.
Figure 18B:
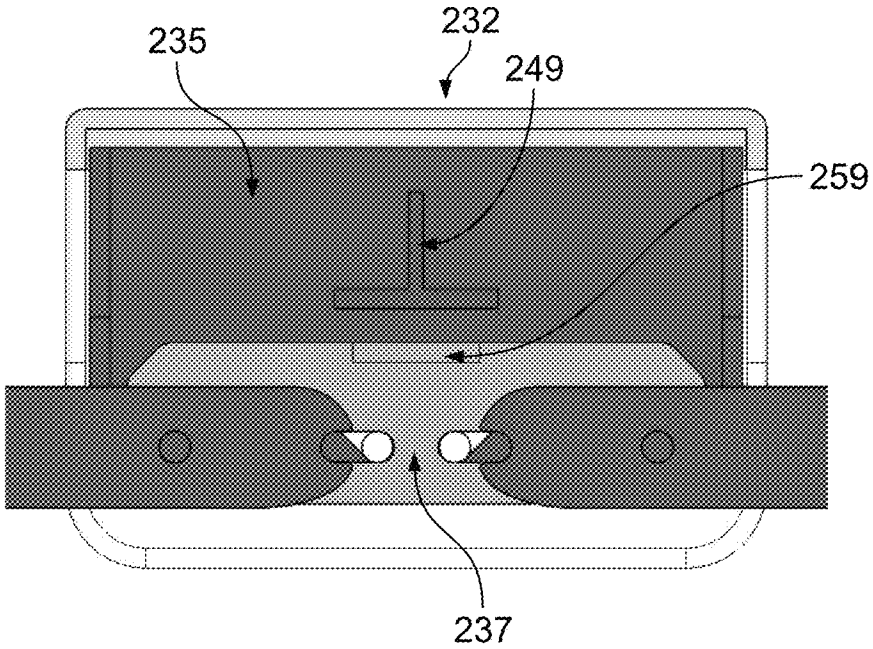
FIG. 18B shows a rear cross-sectional view of the example backrest locking mechanism of FIG. 15A in a released configuration.
Figure 18A:
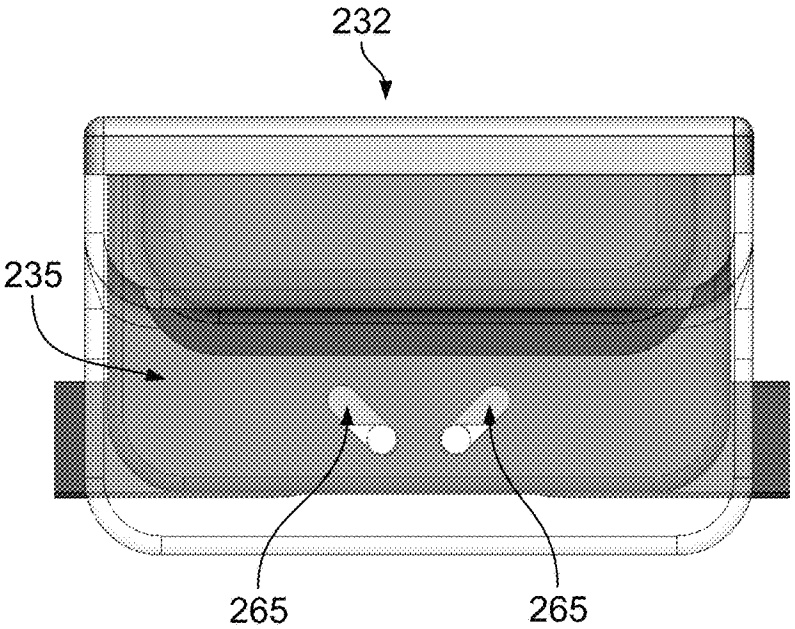
FIG. 18A shows a front cross-sectional view of the example backrest locking mechanism of FIG. 15A in a released configuration.

Referring again to FIGS. 16A-16C, the latch release mechanism 235 can include a spring support seat 249 for supporting spring 257. The spring support seat 249 includes a lower flange 251. The upper portion of the flange supports the spring 257 and the lower portion of the flange is configured to abut against the projection 259 on the insert 237. The latch release mechanism 235 may also include a pair of angled slots 265, which are shown in FIGS. 17A and 18A. In one example, the angled slots 265 are positioned at approximately 45 degrees from a plane defined by a lower portion of the tensioner and can be symmetrically placed on the release mechanism.

The operation of the latch 232 will now be described in relation to FIGS. 16A-18B. FIG. 16A depicts the latch 232 in the tensioned position. In the tensioned position, the latch 232 holds the backrest of the chair in the unfolded or sitting position. To release the latch 232, the user simply pushes up on the latch release mechanism 235 against spring 257 causing the angled slots 265 to pull the pins 239*a*, 239*b* away from notches 247*a*, 247*b* of links 230*a*, 230*b* as shown in FIG. 16B where the latch 232 is in the released position. As the backrest is folded the links 230*a*, 230*b* continue to rotate about pivots 261*a*, 261*b* into the position shown in FIG. 16C. The spring continuously biases the latch release mechanism 235 against the insert 237 so that once the chair is placed back into the unfolded position, the notches 247*a*, 247*b* are allowed to engage the pins 239*a*, 239*b* again to hold the links 230*a*, 230*b* in the tensioned position.

Figure 19A:
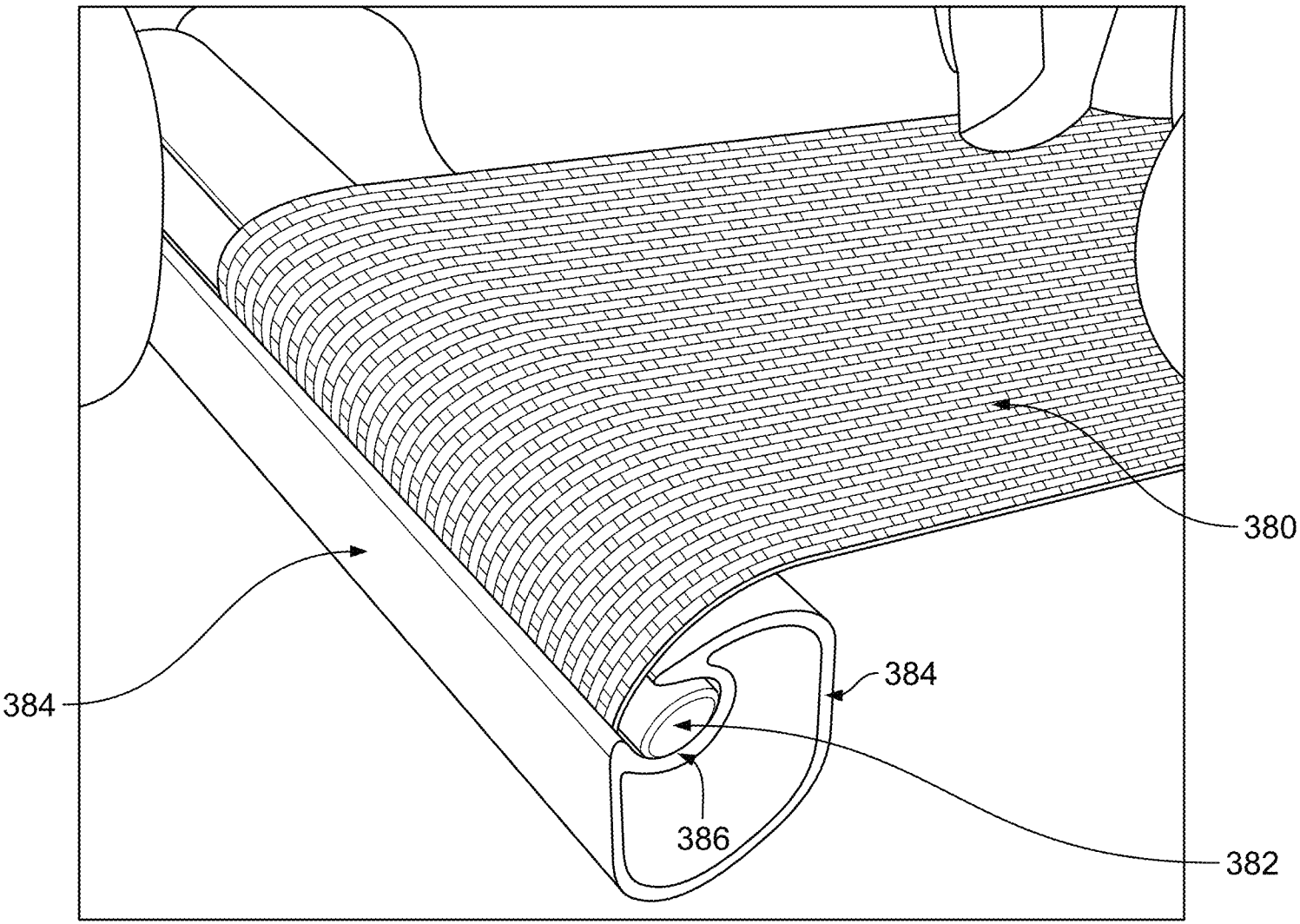
FIGS. 19A and 19B illustrate an attachment method for securing suspension fabric to a frame.
Figure 19B:
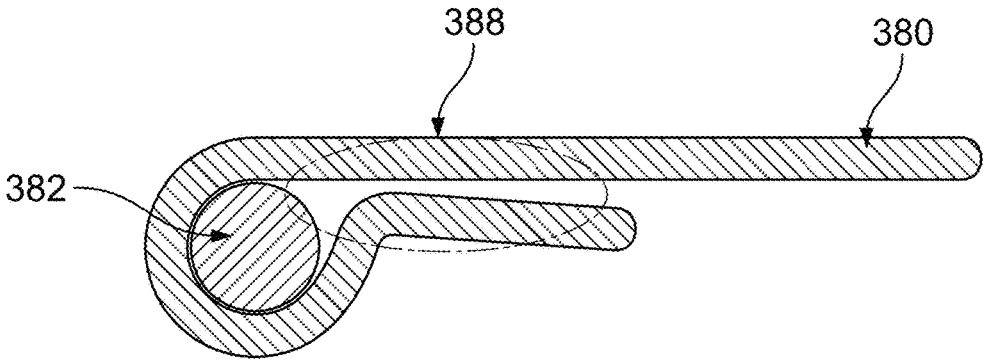

FIGS. 19A and 19B depict a technique for securing a suspension fabric 380 to a frame or extrusion 384. In this example, the fabric 380 can be wrapped around a core 382 and then folded back on itself to create an overlap 388. The overlap 388 of the fabric can them be ultra-sonically welded together. The overlap 388 may also include an adhesive to aid in holding the fabric together. In still other examples, the overlap 388 may be sewn together. The core 382 can then be fed into a hollow section or tube that makes up the frame 384. In certain examples, the frame could be for a number of consumer products such as a chair, table, shelter, tent or stool.

Figure 20:
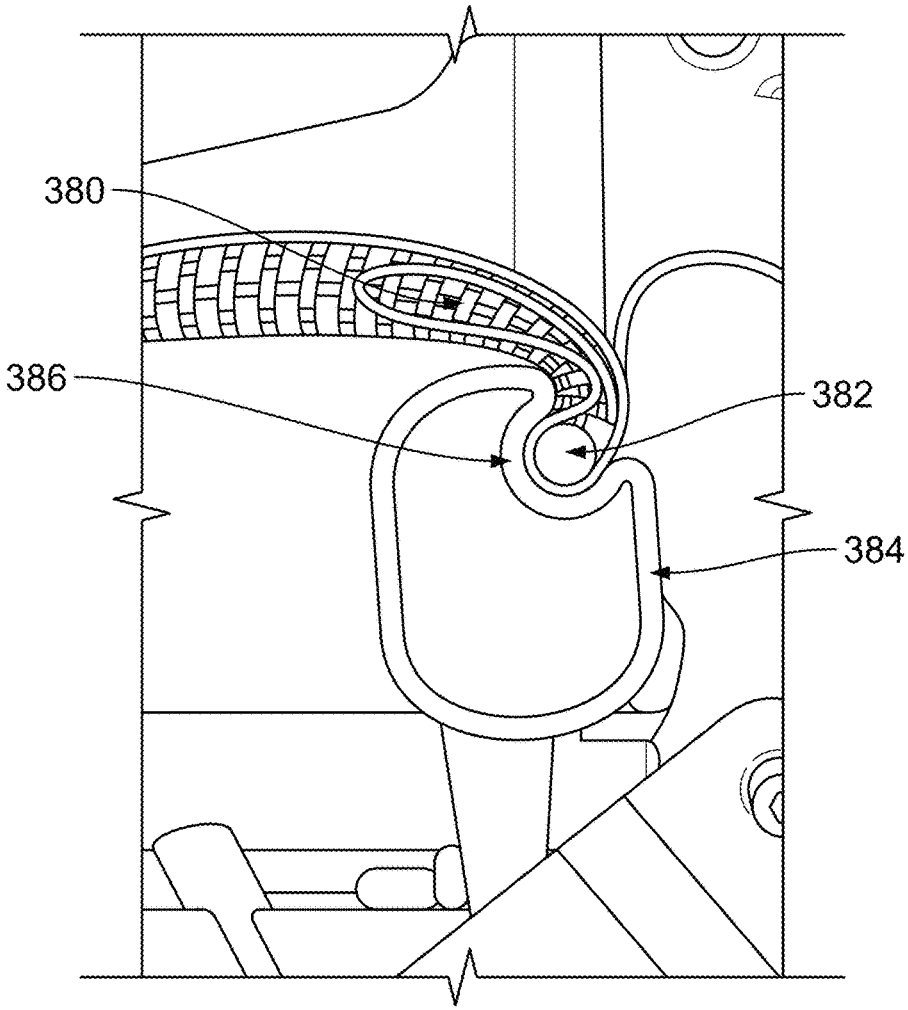
FIG. 20 is an expanded top view illustrating the attachment method for securing suspension fabric to a frame as shown in FIGS. 19A and 19B.
Figure 21B:
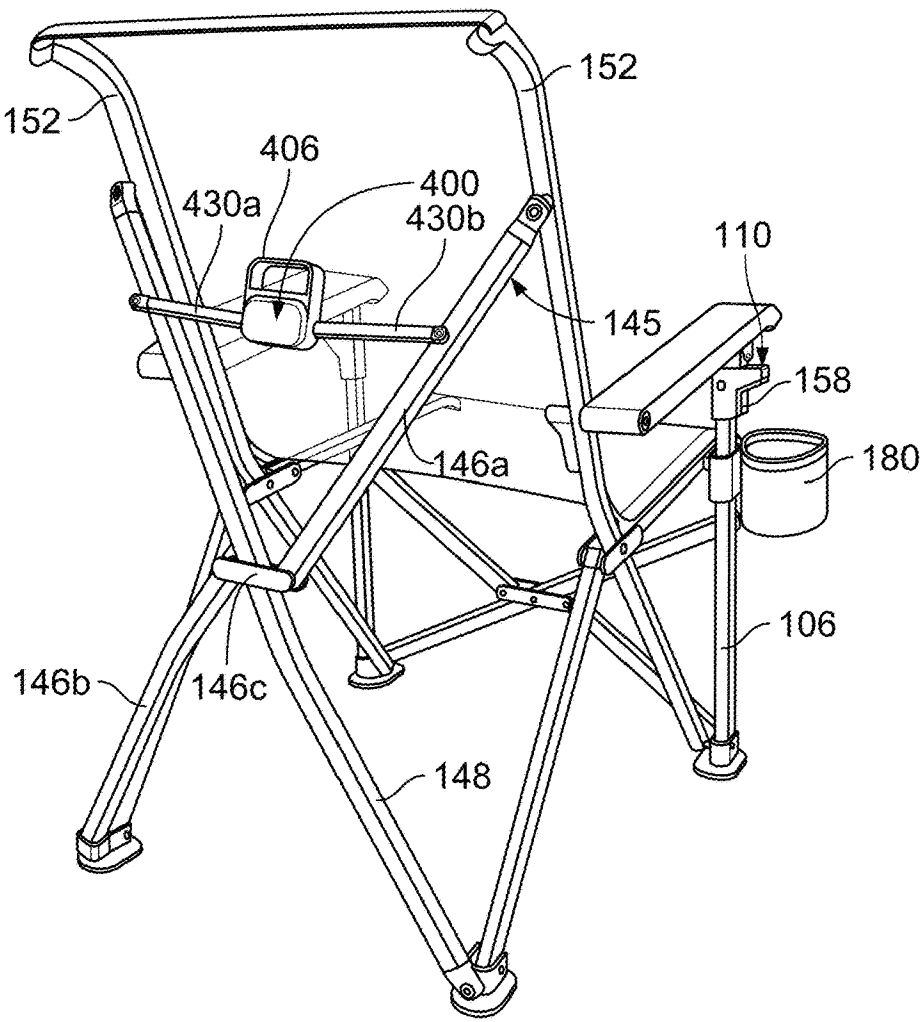
FIGS. 21A and 21B show another example folding chair formed with an integral cup holder and an example of a backrest rear tensioning mechanism.
Figure 21A:
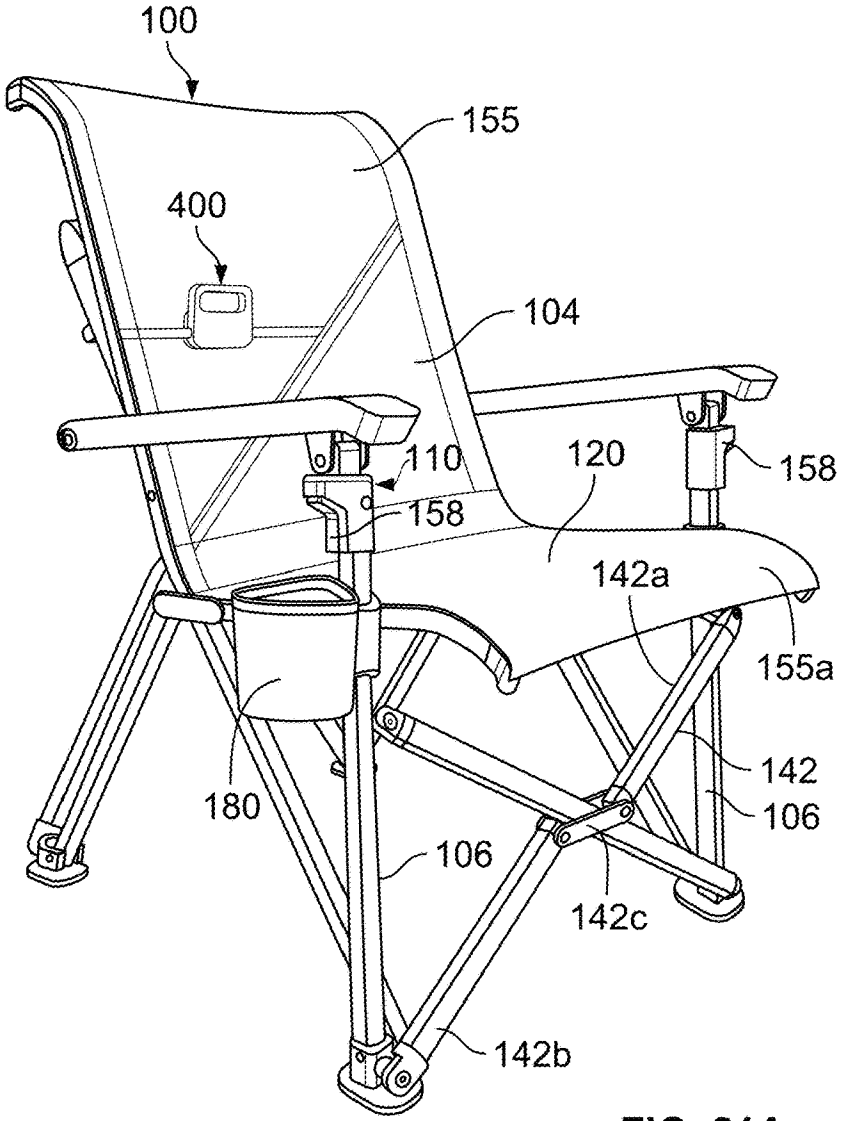

FIG. 20 depicts an alternative view of FIG. 19A and depicts the technique for securing the suspension fabric 380 to a frame or extrusion 384. The core 382 is fed into an asymmetrical notch 386 formed in the hollow section or tube that makes up the frame or extrusion 384. When the fabric 380 is wrapped around the core 382 and placed into the notch 386 asymmetrically located formed in the hollow section of the tube, frame, or extrusion 384, the configuration forms a friction fit. In other embodiments, the fabric 380, core 382, and the asymmetrical notch 386 may include an adhesive to assist in securing the suspension fabric 380 to the frame or extrusion 384. The asymmetrical notch 386 is uniquely positioned at a point on the frame or extrusion 384 that is not symmetrical with any point on the extrusion (i.e., top, side, middle, etc.). The notch 386 may be asymmetrically located or positioned "off-center" on the frame or extrusion 384. The notch 386 may be asymmetrically positioned in the hollow frame 384 at or about a 10 or 11 o'clock position or the 1 or 2 o'clock position if the top of the hollow frame 384 is the 12 o'clock position. In still other examples, the notch 386 may be positioned in a symmetrical position in the frame 384. For example, the notch 386 may be positioned at or about the 3, 6, 9, or 12 o'clock position. The notch 386 may be substantially semi-circular shaped, substantially circular shaped, or substantially oval shaped. The core 382 may be a flexible plastic, a rigid plastic, fabric, aluminum, wood, steel, composite, alloy, or other metal. In other examples, the core may be rigid, semi-rigid, or non-rigid. In some examples, the core may be substantially shaped like a rod or cylinder. In still other examples, the core can be a rod or cord, which can be formed of plastic, nylon, foam, braided fibers, fabric, aluminum, wood, steel, composite, alloy, metal, etc.

Securing the suspension fabric 380 to the frame 384 via the asymmetrical notch 386 may help to hide the connection between the suspension frame fabric and the frame to provide a cleaner look to the chair. Also, securing the suspension fabric 380 to the outer portion of the frame 384 via the positioning of the asymmetrical notch 386 creates a mechanical advantage due in part to the additional surface area that the suspension fabric 380 contacts of the frame 384. The resulting mechanical advantage provides additional strength to better secure the suspension fabric 380 to frame or extrusion 384. Also, the use of an asymmetrical notch may extend the life of the chair by reducing the amount of stress on the fabric. In particular, the asymmetrical notch helps to move the connection of the fabric to the frame away from direct loading. However, other methods for securing the fabric to the frame are also contemplated, such as overmolding the fabric to the frame as discussed in Ser. No. 15/602,841 filed on May 23, 2017, which is fully incorporated herein by reference.

With both of a tensioning mechanism for the seat and a tensioning mechanism for the backrest, the chair holds it form and does not fold up during the use of the chair, until desired by the user.

FIGS. 21-29 depict a folding chair with an alternative configuration for a tensioning mechanism that may include a rear tensioner for maintaining the backrest in the unfolded position or tensioned position. In one example, the backrest 104 can be tensioned by a rear tensioner 400, as shown in FIG. 22A. As shown in FIG. 22B, rear tensioner 400 may include at least two rear tensioner arms 430.

Figure 22B:
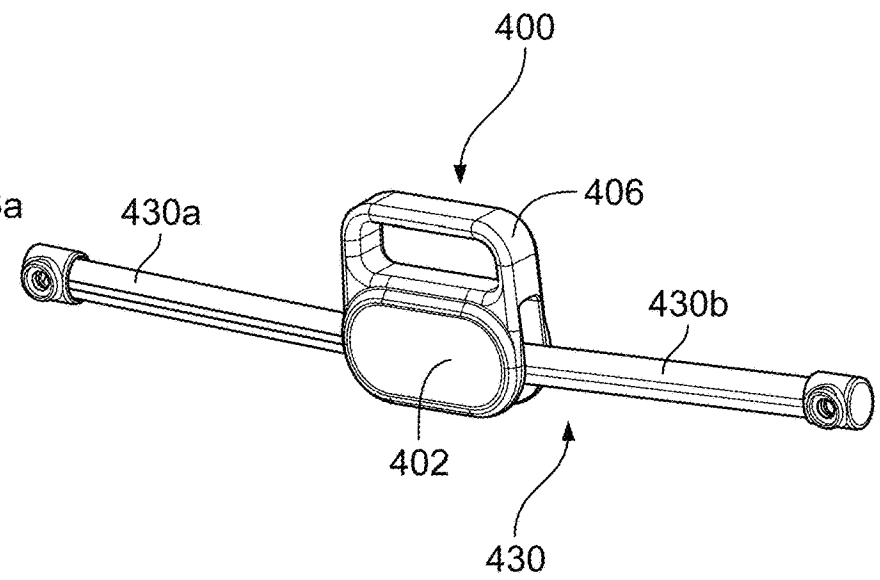
FIG. 22B illustrates shows a rear view of the example backrest rear tensioning mechanism from FIG. 22A.
Figure 22A:
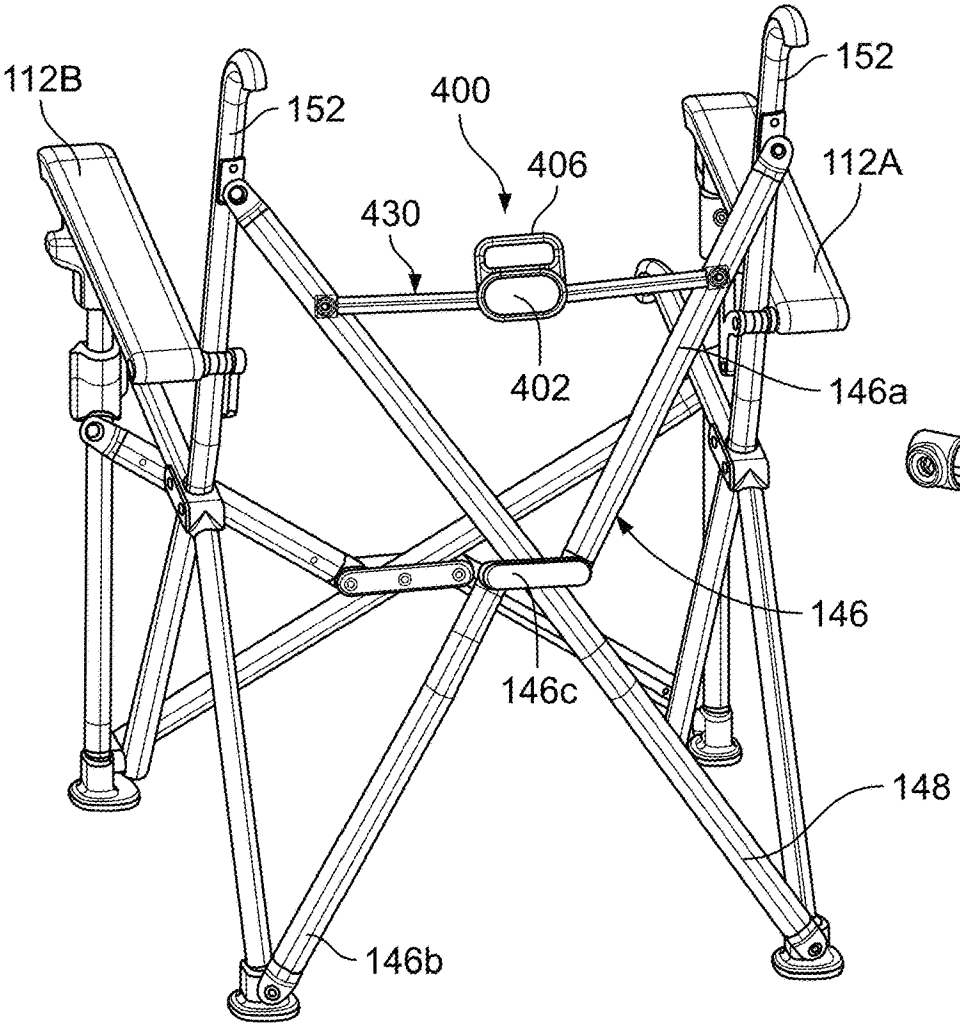
FIG. 22A illustrates another example folding chair frame, with the suspension fabric removed, with a backrest rear tensioning mechanism.
Figure 23:
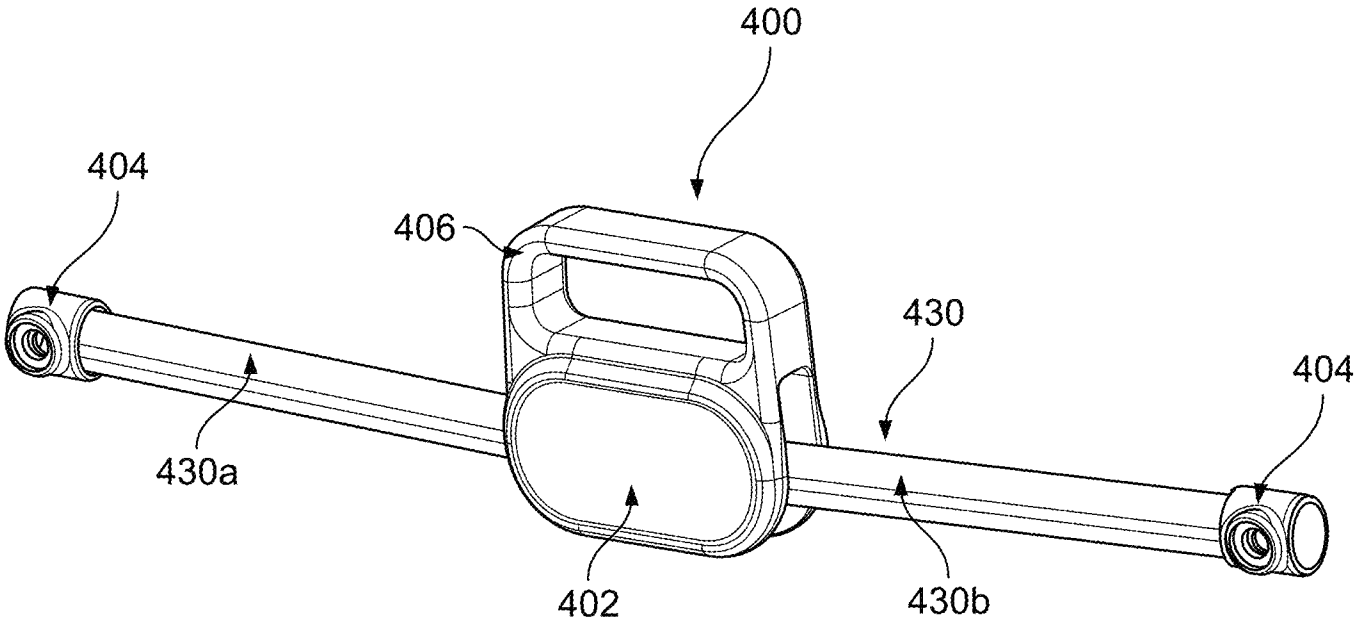
FIG. 23 illustrates an expanded assembly view of the example rear tensioning mechanism from FIG. 22A.

FIG. 23 illustrates an expanded assembly view of the example rear tensioning mechanism from FIG. 22A. In one example, as shown in FIG. 23, the rear tensioner 400 may include a handle and housing 422 below the grasping portion of the handle 406, rear tensioner arm 430*a*, rear tensioner arm 430*b*, and rear tensioner cap 404. Rear tensioner caps 404 may be connected to rear cross-bars 146 and 148. The rear tensioner caps 404 are configured to pivot in a manner that allows the rear tension to move from an unfolded position to a tensioned position. In other examples, the rear tensioner 400 includes rear tensioner cover 402. In one example, the rear tensioner arm 430*a* and 430*b* can be formed of aluminum or any other suitable strong lightweight material. The rear tensioner 400 and handle 406 and housing 422 can, in certain instances, be made out of glass filler nylon for strength, plastic, or other composite. As shown in FIG. 24A, access to the pivot points 408 may be provided when the rear tensioner cover 402 is removed. The pivot points 408 are seated in an oval or rectangular shaped reservoir 412. The rear tensioner cover 402 is shaped in a similar manner as the reservoir 412 (i.e., oval or rectangular shaped). The pivot points 408 are configured to hold pins 410 that run through the rear tensioner arms 430*a* and 430*b*, securing the arms to the rear tensioner 400. Rear tensioner cover 402 includes a plurality of flex fingers and easily snaps into the rear tensioner 400 to cover the reservoir 412.

Figure 24B:
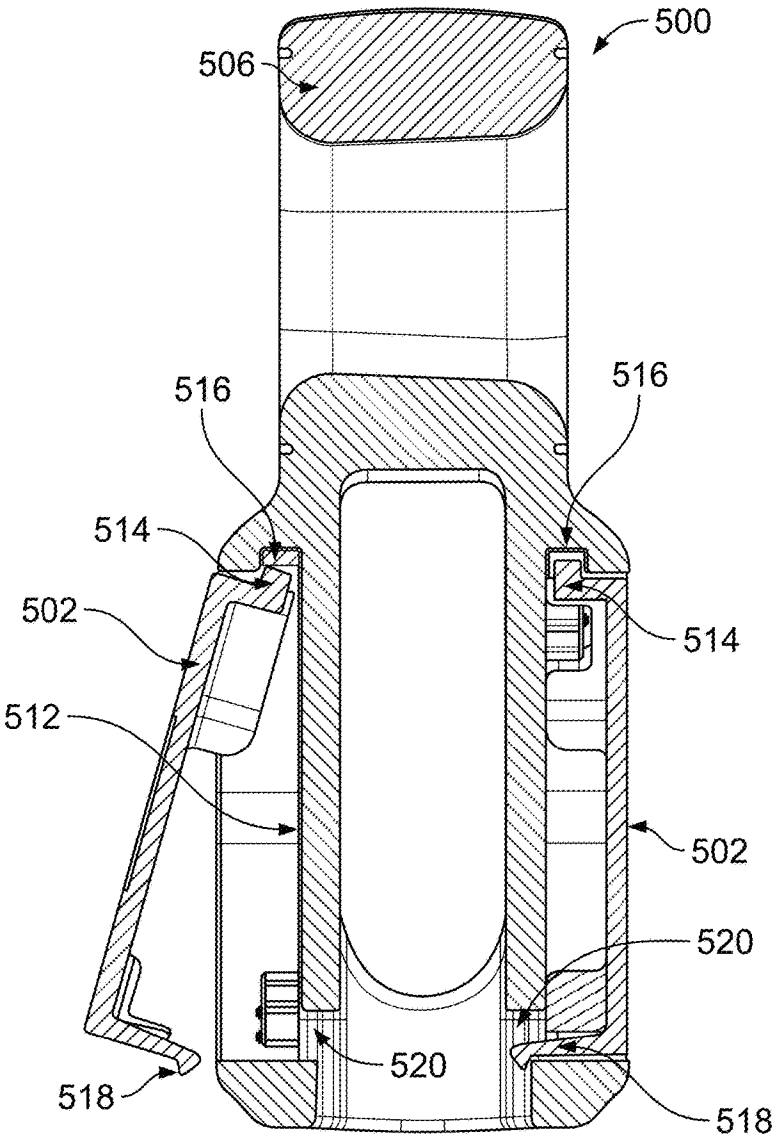
FIGS. 24B-24D illustrates another example backrest tensioning mechanism rear tensioner and rear tensioner cover as described herein.
Figure 24B:
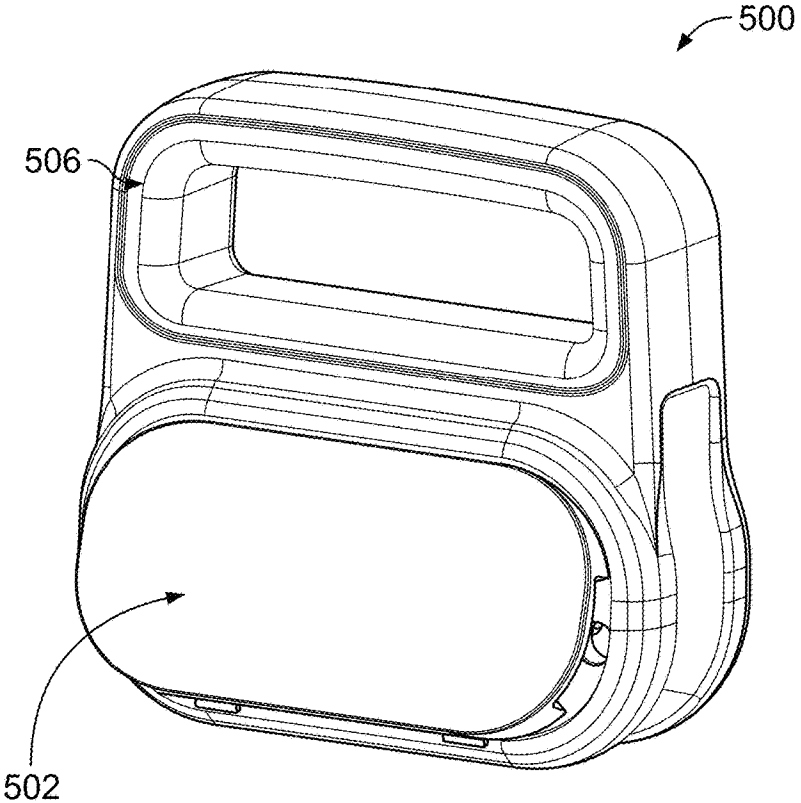
Figure 24C:
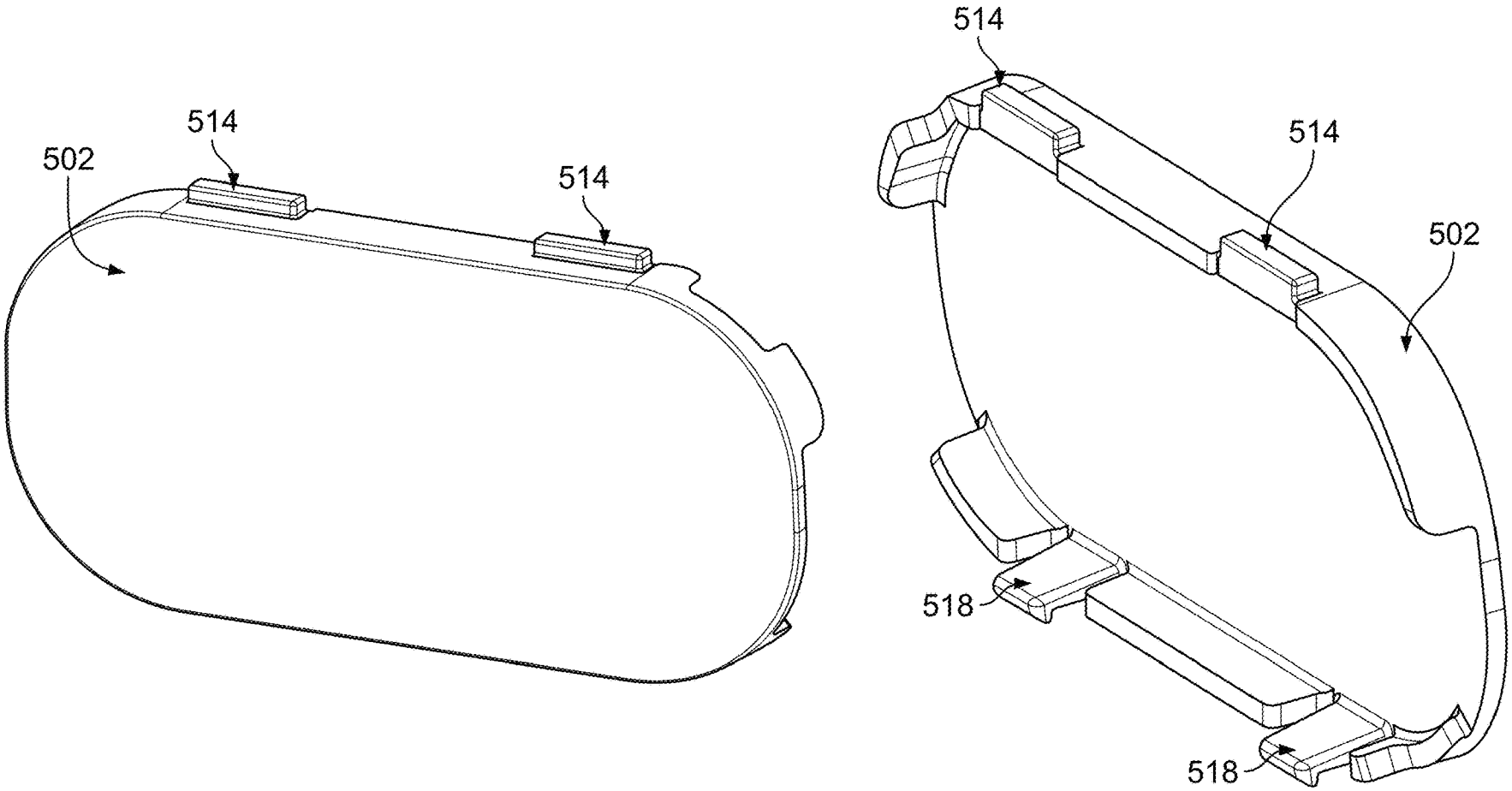
Figure 24D:
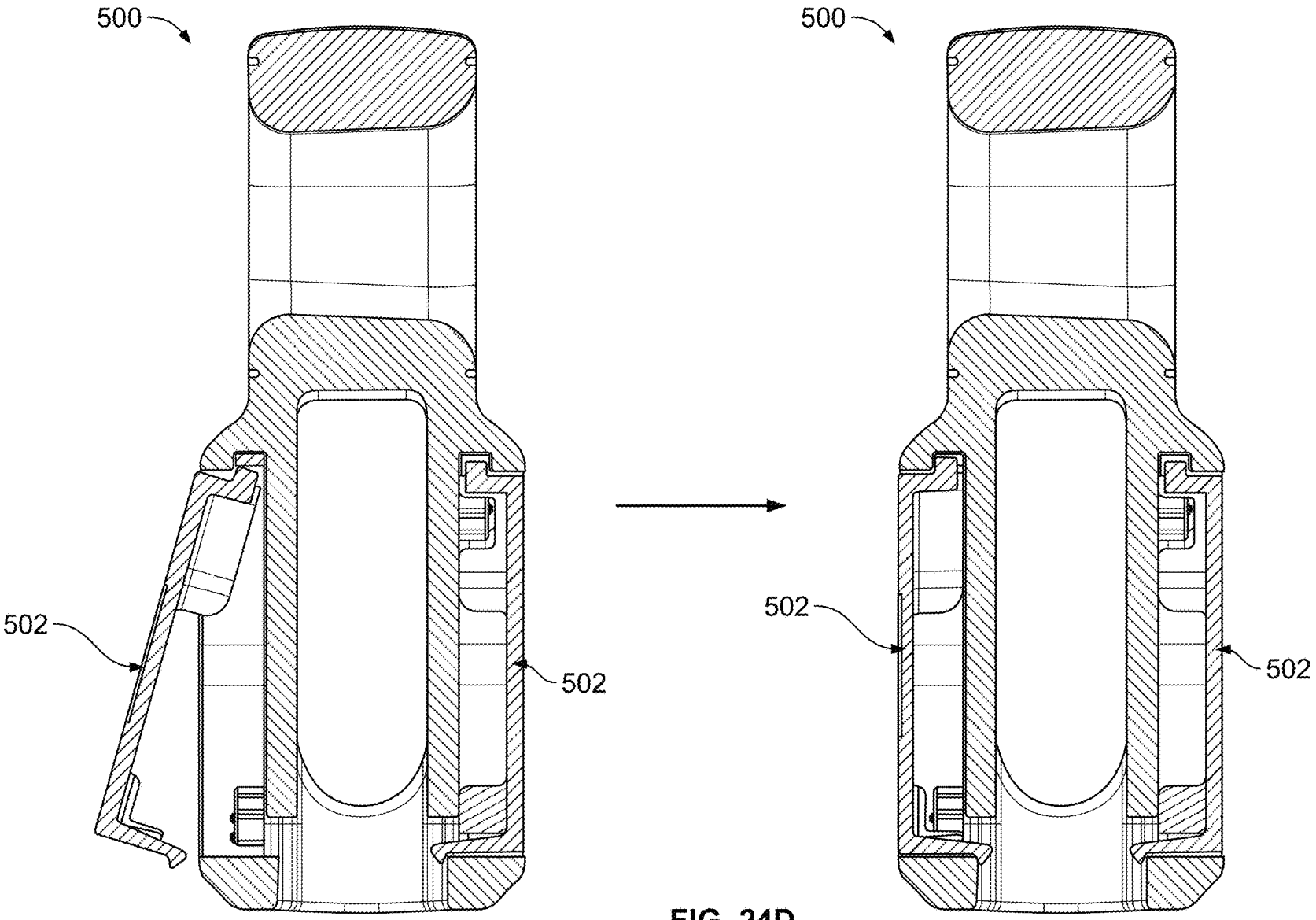
Figure 25B:
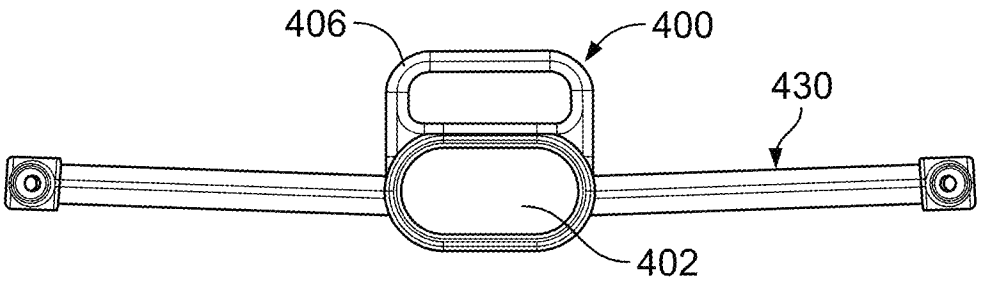
FIGS. 25A and 25B illustrate engagement of the rear tensioner when the user pushes down on the rear tensioner handle and increases the force until the rear tensioner goes over-center and hits an internal stop.
Figure 25A:
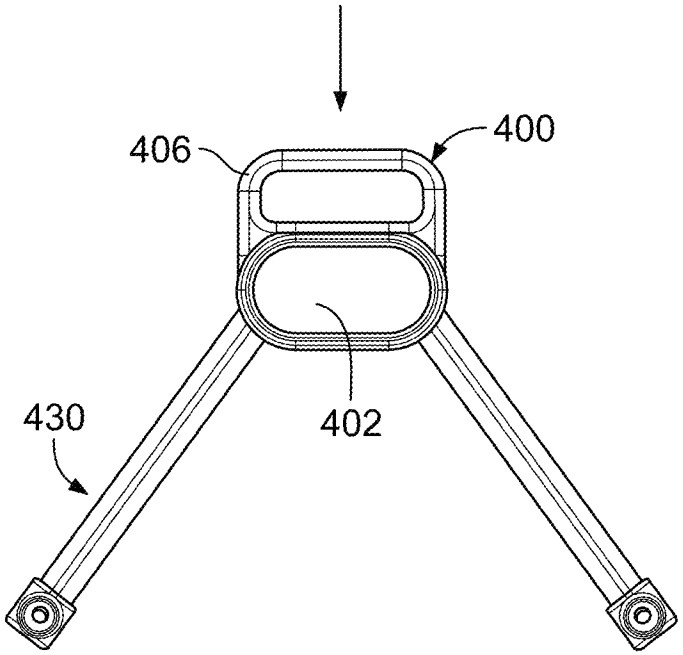

FIGS. 24B-24D illustrate another example rear tensioner 500. In one example, as shown in FIG. 24B, the rear tensioner 500 may include a handle 506, and rear tensioner covers 502*a* and 502*b*. Rear tensioner covers 502*a* and 502*b* may be shaped in a similar manner as the reservoir 512 (i.e., substantially oval or substantially rectangular shaped). In still other examples, the rear tensioner covers 502*a* and 502*b* include a plurality of flex fingers 518 configured at the bottom of the rear tensioner cover 502. The flex fingers 518 may also be configured to easily snap into the rear tensioner 500 to cover the reservoir 512. In other examples, the rear tensioner covers 502*a* and 502*b* may be configured with a plurality of top tabs 514. Top tabs 514 may be configured to engage upper recesses 516. In other examples, the flex fingers 518 may be configured to engage lower recesses 520. In other examples, the rear tensioner covers 502*a* and 502*b* may be attached to the rear tensioner 500 by placing the top tabs 514 into the upper recesses 516 and then rotating the rear tensioner covers 502*a* and/or 502*b* downward. The flex fingers 518 may then be snapped into lower recesses 520 thus securing the rear tensioner covers 502*a* and 502*b* to the rear tensioner 500, as shown in FIG. 24D. In certain examples, the rear tensioner covers 502*a* and 502*b* may be removed from the rear tensioner 500 by disengaging the flex fingers 518 from the lower recesses 520 (i.e., by using a screw driver or other device), then disengaging the top tabs 514 from the upper recesses 516, and then removing the rear tensioner covers 502*a* and 502*b*.

In one example, to engage the rear tensioner 400, the user simply presses downwardly on the rear tensioner handle 406 such that the pivot points 408, pins 410, and rear tensioner arms 430*a* and 430*b* force the rear X frame 145 outward so that the fabric 155 is tensioned in the backrest 104. The user increases the downward force until the rear tensioner 400 goes over-center and hits at least one internal stop 414. The stops 414 are internal to the rear tensioner 400 so that the user is not at risk of injuring a finger or other body part during engagement or disengagement of the rear tensioner. To disengage the rear tensioner 400, the user does the reverse of engagement process and pulls up on the handle 406. Initially the required force is high until the rear tensioner arms 430*a* and 430*b* pop over-center and the rear tensioner 400 is disengaged and the chair is in a folded configuration.

Figure 26B:
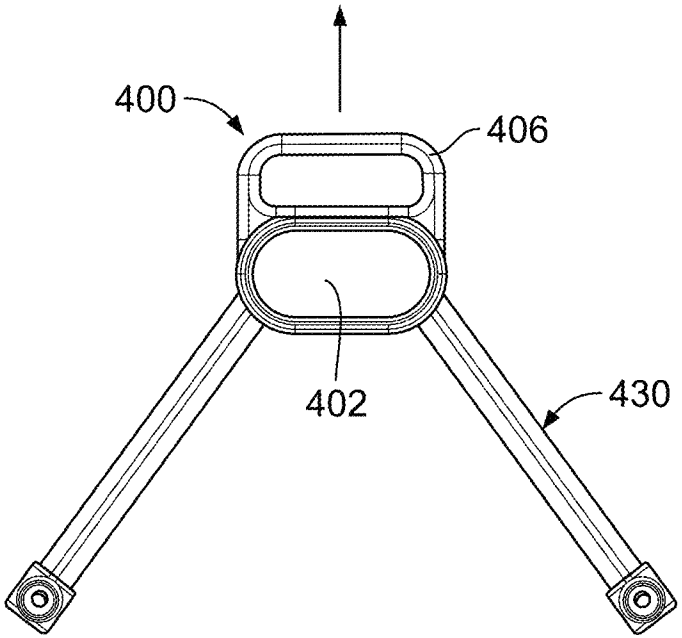
FIGS. 26A and 26B illustrate disengagement of the rear tensioner when the user pulls up on the handle until the tensioner is disengaged.
Figure 26A:
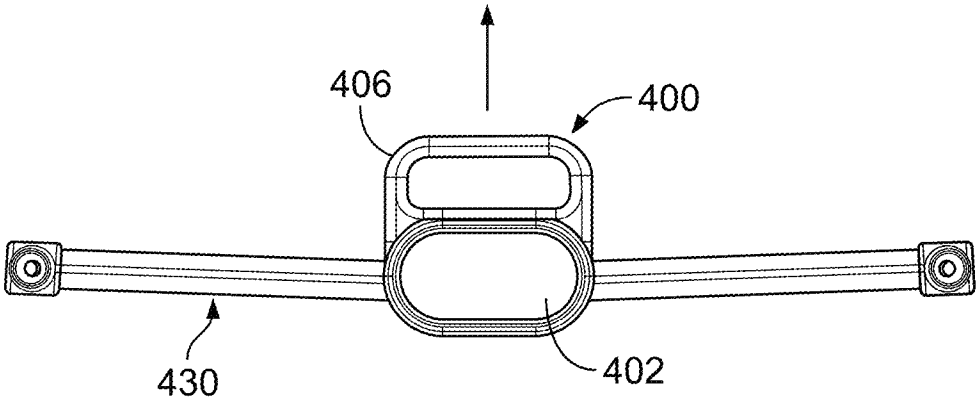
Figure 27:
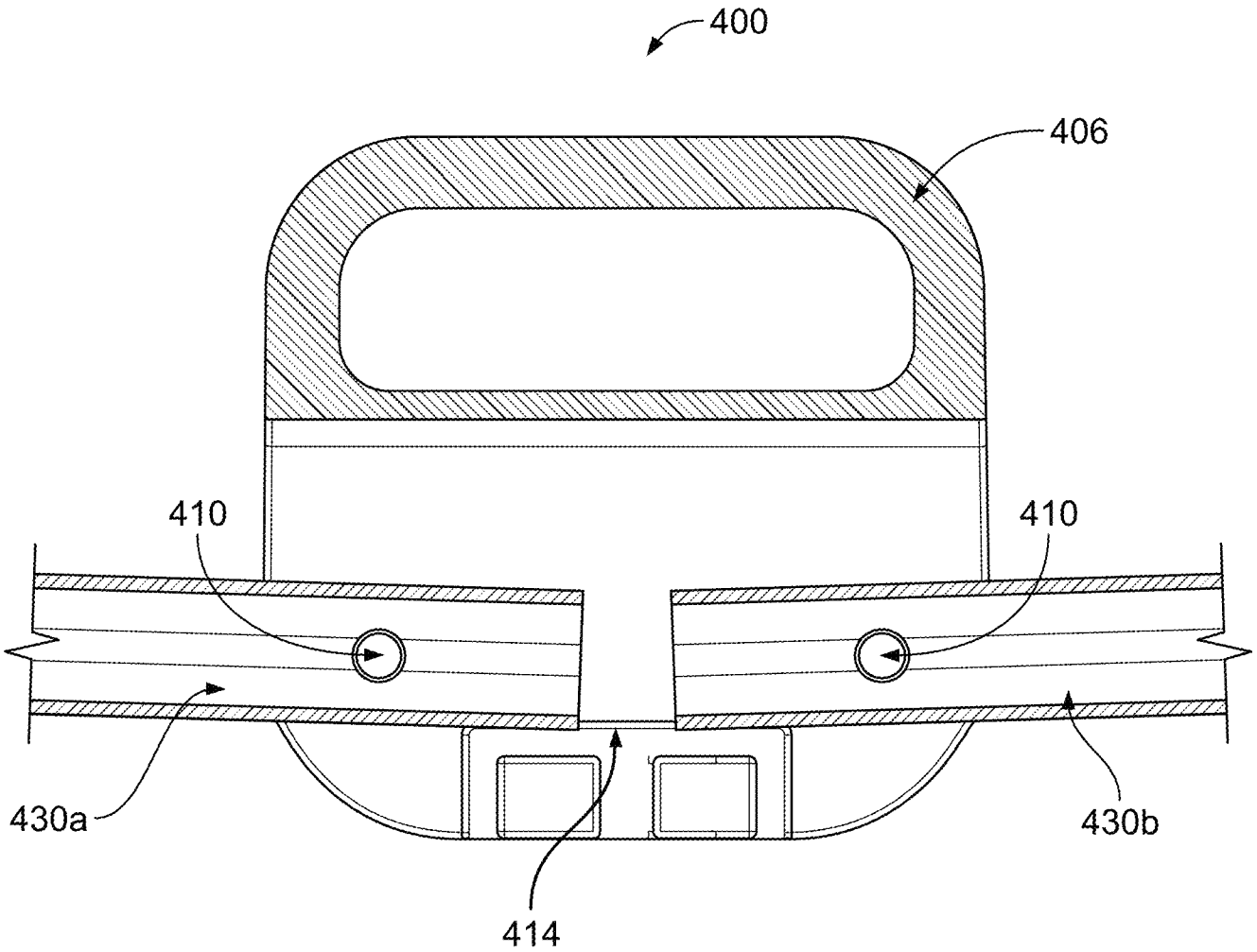
FIG. 27 illustrates a cross-section of the rear tensioner while under tension.
Figure 28:
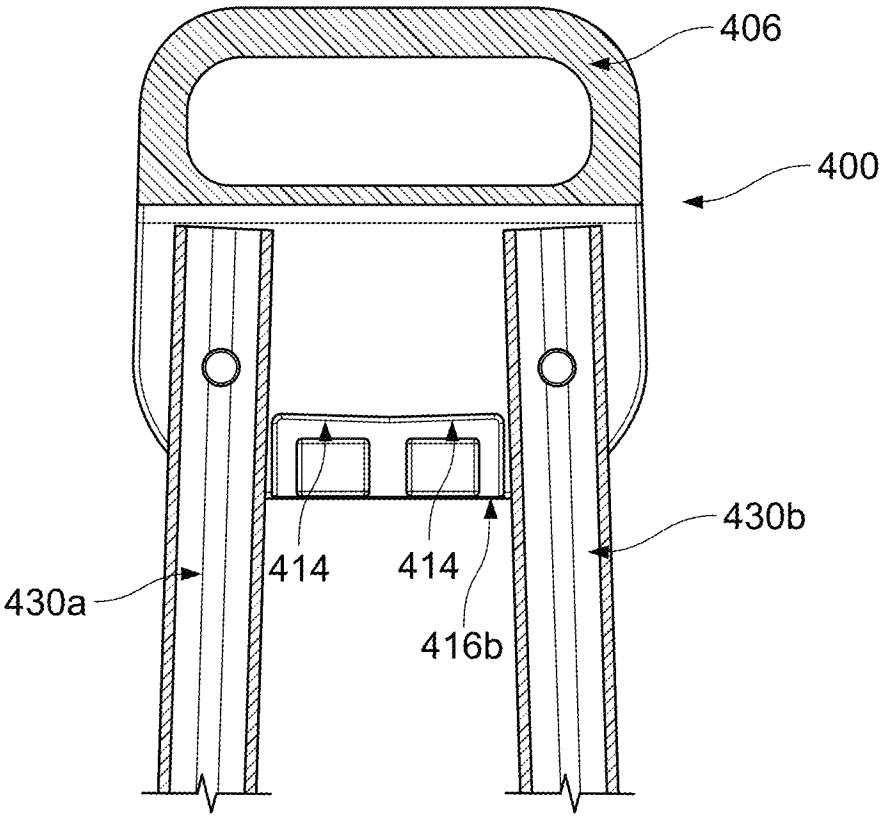
FIG. 28 illustrates a rear perspective and cross-section view of the rear tensioner in the folded position.
Figure 28:
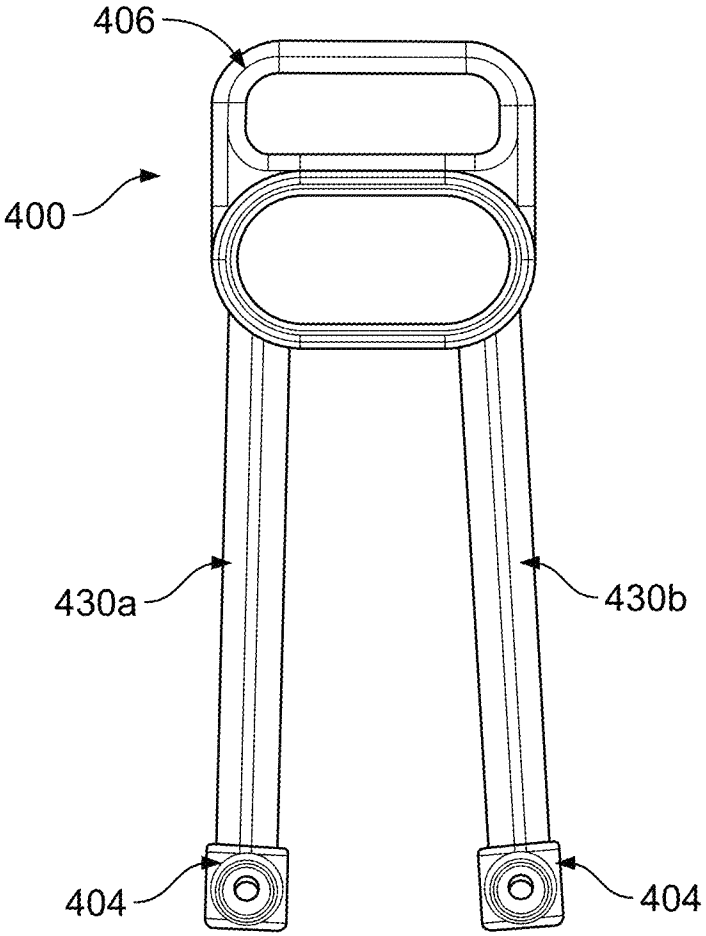

FIG. 27 illustrates a cross-section of the rear tensioner while under tension. The ends of the rear tensioner arms 430*a* and 430*b* engage stops 414 after the users applies the appropriate downward force on the rear tensioner handle 406 and the rear tensioner 400 goes over-center. When the rear tensioner 400 is engaged, an angle formed between the rear tensioner arms 430*a* and 430*b* is greater than 180 degrees as shown in FIG. 26A. When engaged with the stops 414, the arms 430*a* and 430*b* are in a substantially parallel position in relation to a top contact surface of the stops 414. Arms 430*a* and 430*b* are secured to the pivot points 408 and the rear tensioner 400 by pins 410. FIG. 28 illustrates the rear tensioner 400 in the disengaged or unfolded position. The rear tensioner arms 430*a* and 430*b* are substantially perpendicular to the top contact surface of the stops 414 when the rear tensioner is disengaged and in a substantially folded position. When the rear tensioner 400 is disengaged and in a substantially folded position, an angle formed between the rear tensioner arms 430*a* and 430*b* is less than 90 degrees and the rear tensioner arms 430*a* and 430*b* are substantially parallel as shown in FIG. 28.

Figure 29:
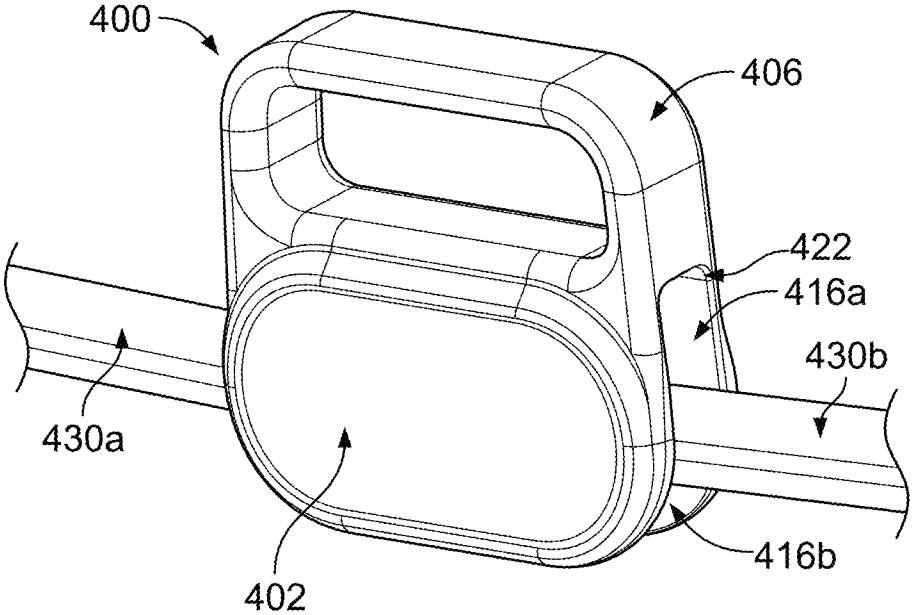
FIG. 29 illustrates a gap between the rear tensioner and the rear tensioner arms.

In other examples, as shown in FIG. 29, rear tensioner 400 includes safety gaps 416*a* and 416*b* below handle 406 at the top and in the underside of the rear tensioner 400. The gap 416*b* is sized so that the arms 430 does not pinch the user's skin or finger if their finger is between rear tensioner arms

430*a* and 430*b* and the tensioner 400. In some examples, the gap 416*b* may be at least 12 mm in width to prevent the pinching or crushing of an individual's finger or skin. In other examples, the gap 416*b* is approximately 12 mm in width. In other examples, the lower gap 416*b* is at least 5 mm in width. In still other examples, the gap 416*b* may be about 5 mm, 6 mm, 7 mm, 8 mm, 9 mm, 10 mm, 11 mm, 12 mm, 13 mm, 14 mm, or 15 mm in width. In some examples, the upper gap 416*a* allows a user's finger to be pushed out by the rear tensioner arms 430*a* and 430*b* when the tensioner is disengaged. The movement of the rear tensioner arms 430*a* and 430*b* forces an individual's finger out of gap 416*a* when the tensioner is disengaged thus preventing the user's finger or skin from getting squeezed or pinched. In still other examples, the upper wall of the handle 406 housing 422 below the grasping portion of the handle may be raised or extended in height thus creating a larger upper safety gap 416*a* to prevent pinching of the user's hand or fingers.

Figure 30A:
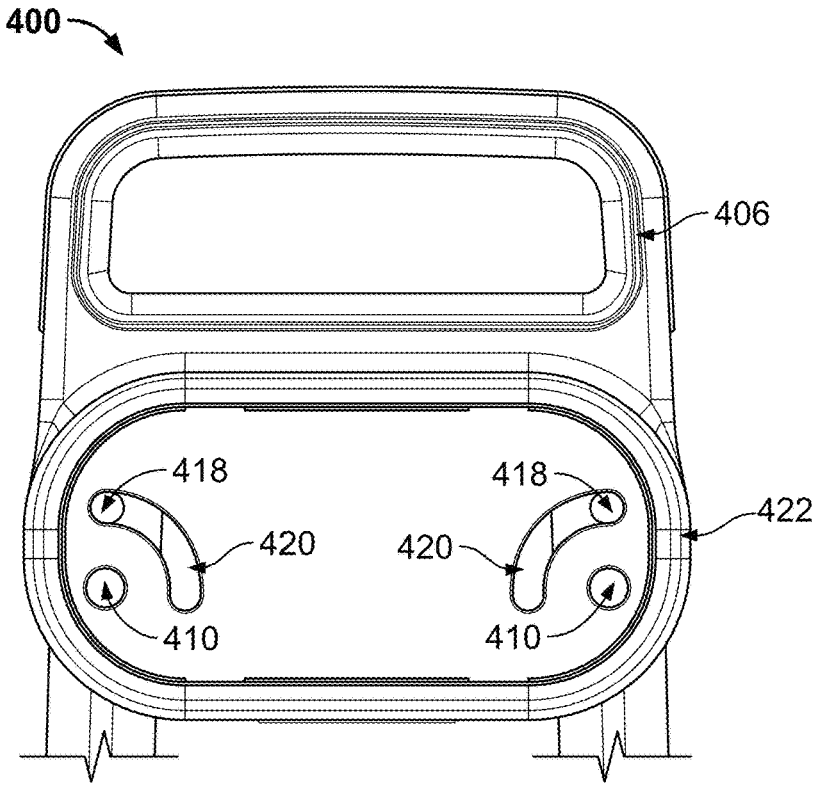
FIGS. 30A-30F illustrate another example rear tensioner.
Figure 30B:
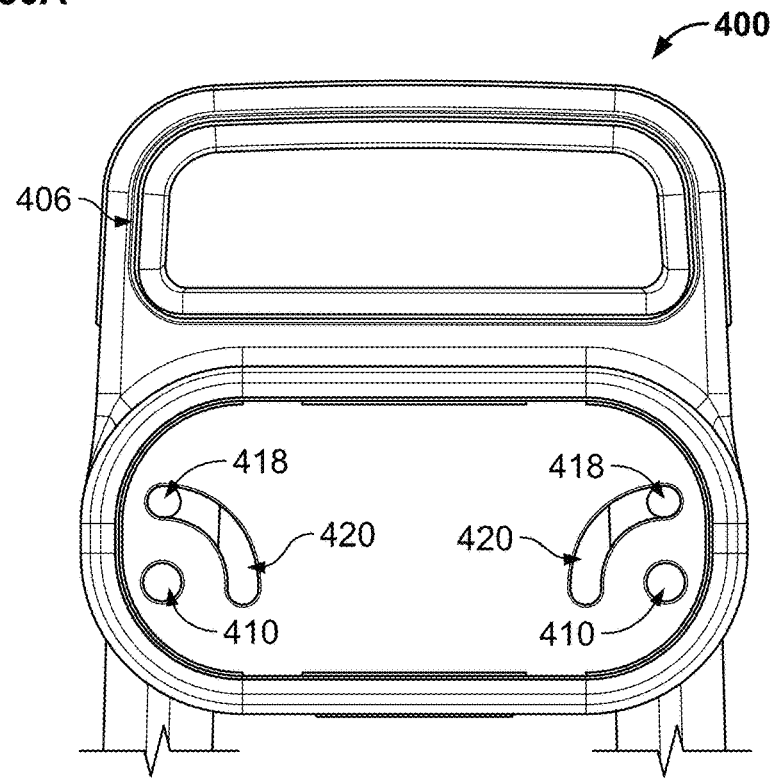
Figure 30C:
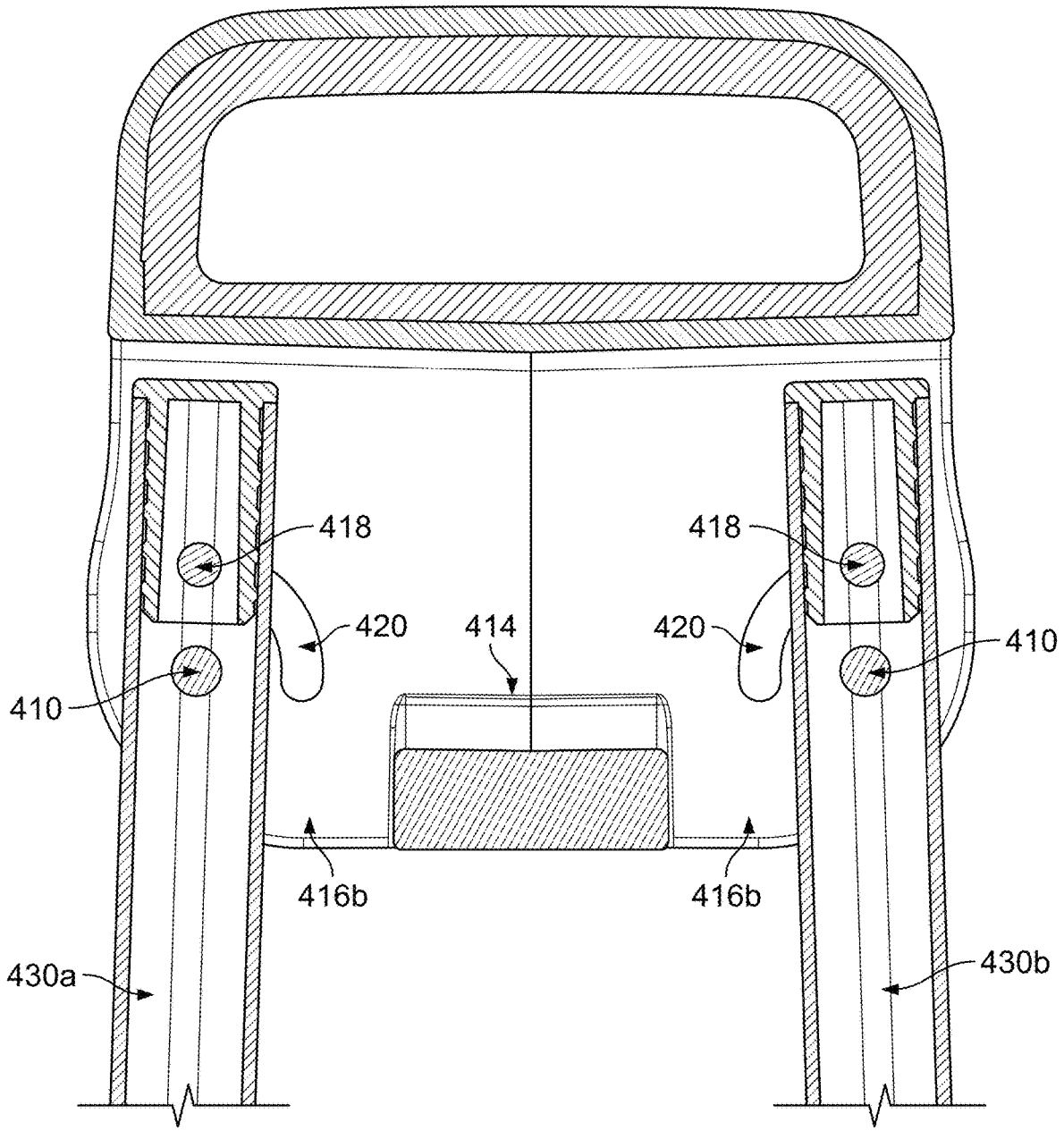
Figure 30D:
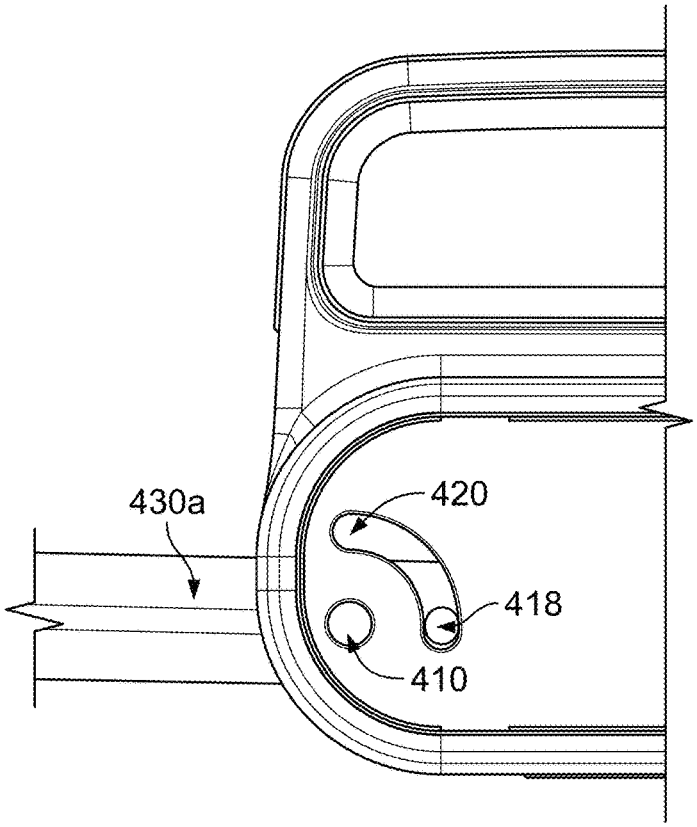
Figure 30E:
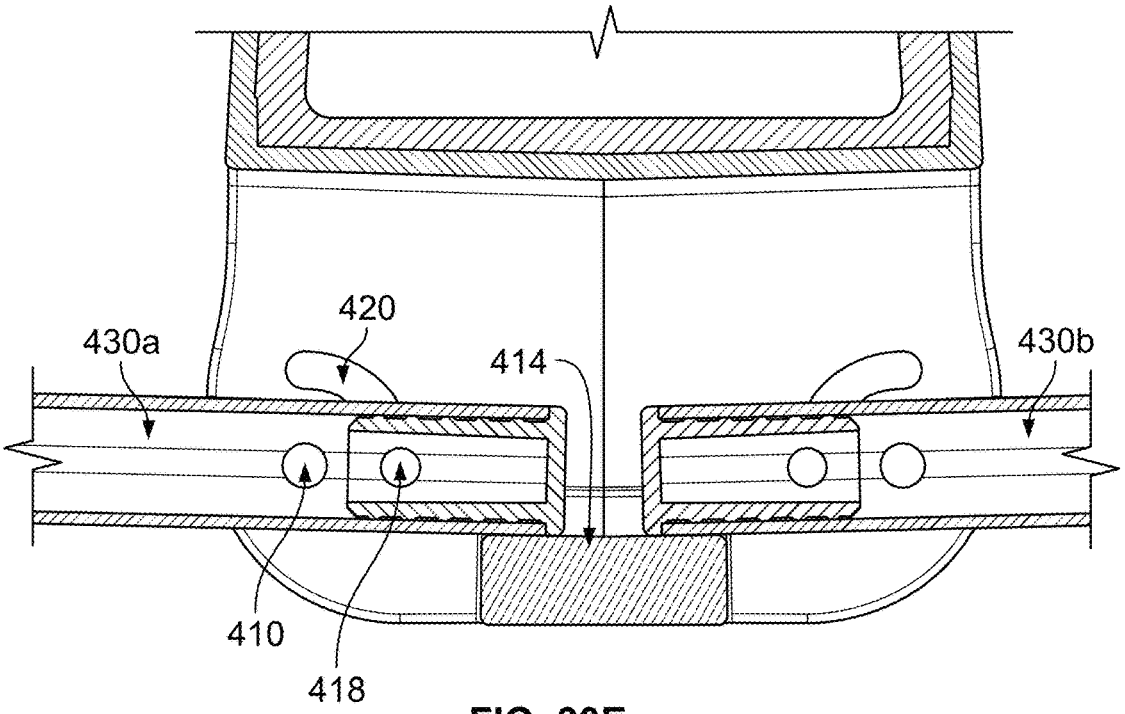
Figure 30F:
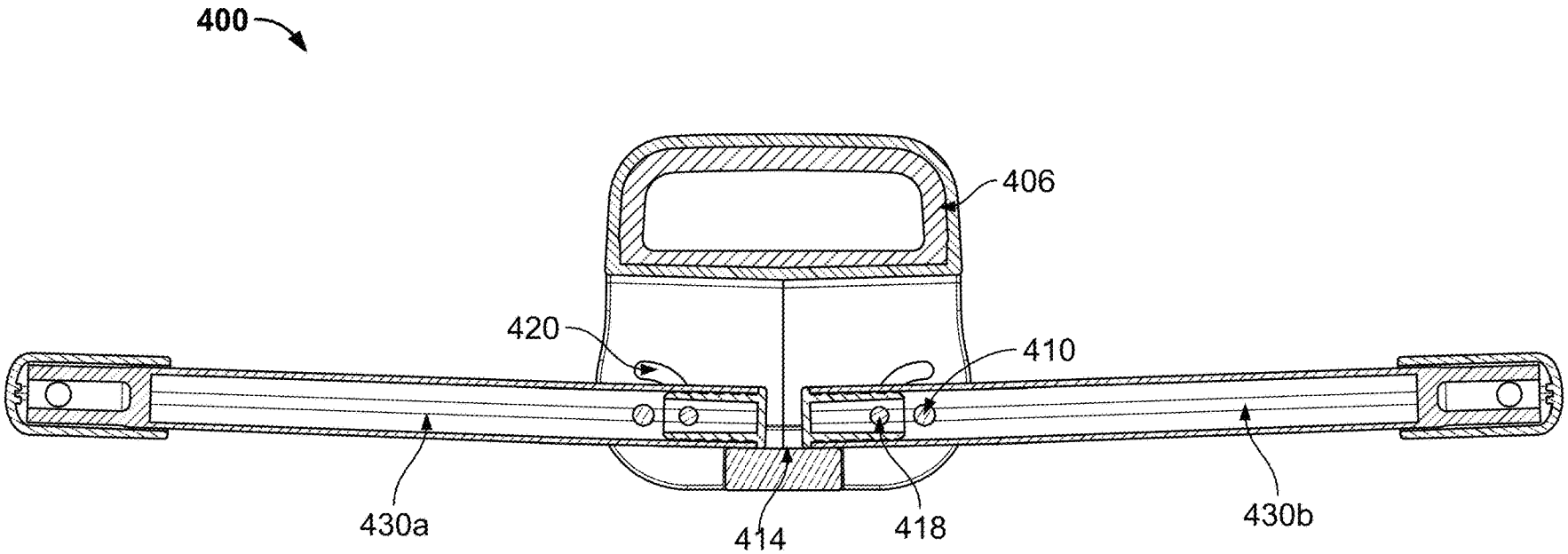

FIGS. 30A-30F illustrate another example rear tensioner 400. In some examples, as shown in FIGS. 30A and 30B, rear tensioner 400 may include a pair of slot rivets, projections, or cam 418 within the tensioner housing 422 configured to engage a pair of arcuate slots 420. The rear tensioner arms or arms 430*a* and 430*b* are connected to the rear tensioner via hold pins 410, which allow the rear tensioner arms to articulate or pivot on the rear tensioner. When the chair is in the folded position, as best shown in FIG. 30C, the rivets, cam, or projections 418 move to the end of the slots 420 which create stops to limit the travel of the rear tensioner arms 430*a* and 430*b*. As shown in FIG. 30C, the safety gap 416*a* provides clearance for a user's finger when the rear tensioner is in the folded position. As shown in FIGS. 30D, 30E, and 30F, when the rear tensioner is in the extended position to tension the suspension material of the chair, the ends of the rear tensioner arms 430*a* and 430*b*, guided by the slot rivets or projections 418 and the slots 420, are configured to engage stop 414. Stop 414 prevents further movement of the rear tensioner arms 430*a* and 430*b*. In the extended position, the elastic nature of the suspension fabric acts on the tensioner arms 430*a* and 430*b* to bias the ends of the tensioner tubes or arms 430*a* and 430*b* against the stop 414.

Figure 14:
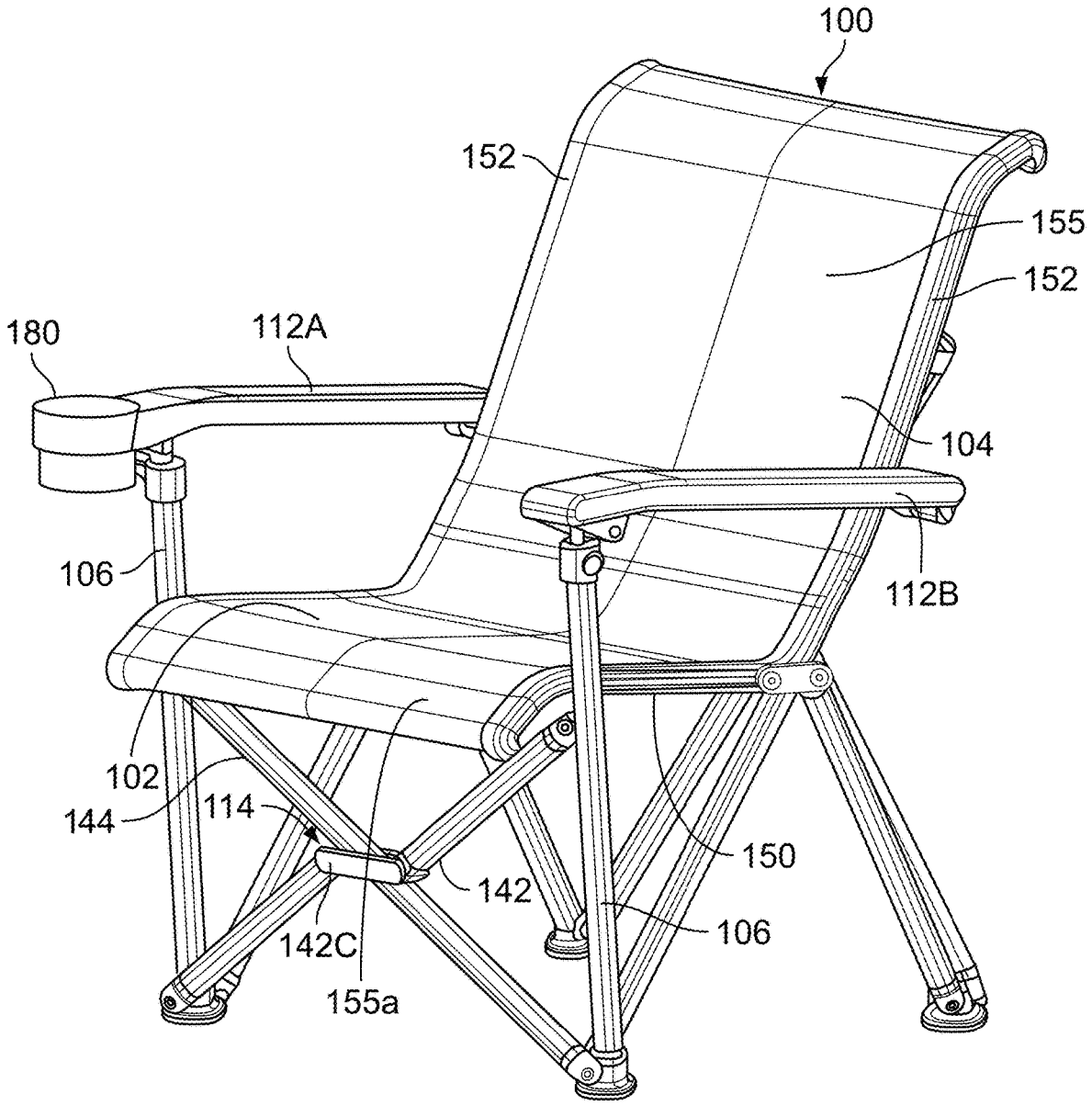
FIG. 14 shows another example folding chair formed with an integral cup holder.
Figure 31B:
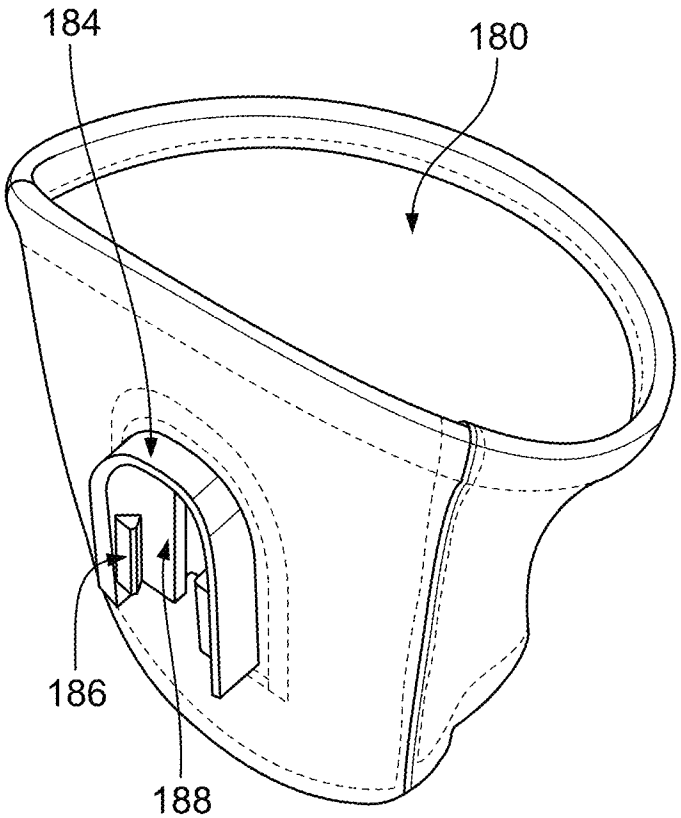
FIGS. 31A and 31B show another example folding chair formed with a removable and interchangeable cup holder.
Figure 31A:
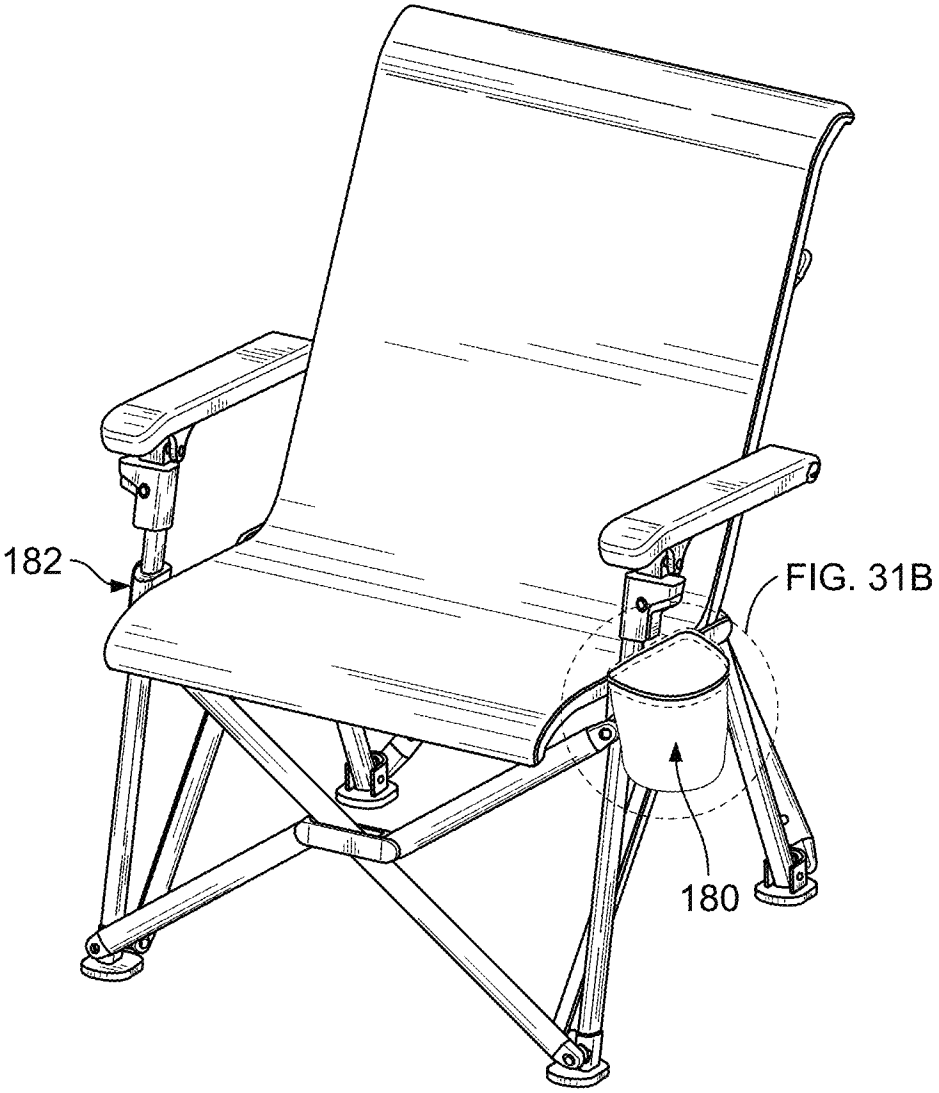
Figure 32C:
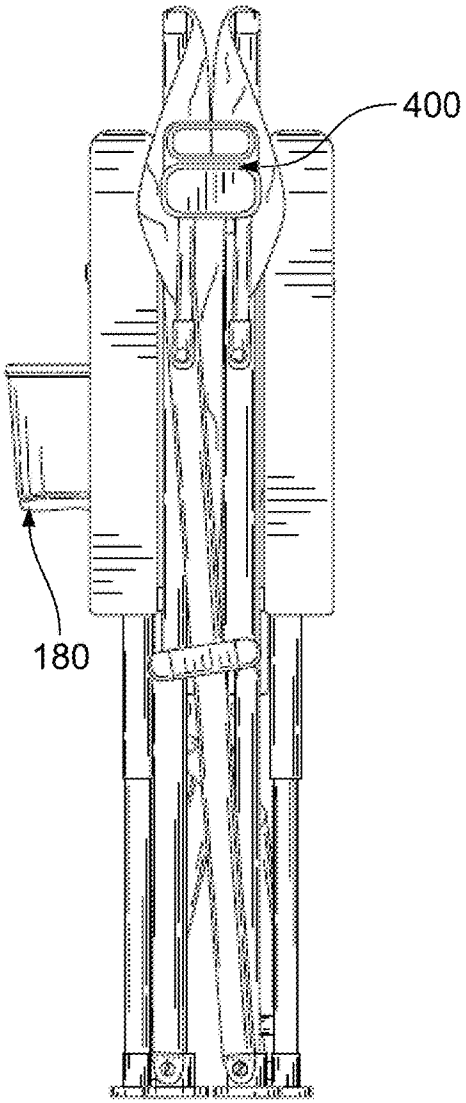
FIGS. 32A-32C show another example folding chair in the folded or stored configuration.
Figure 32B:
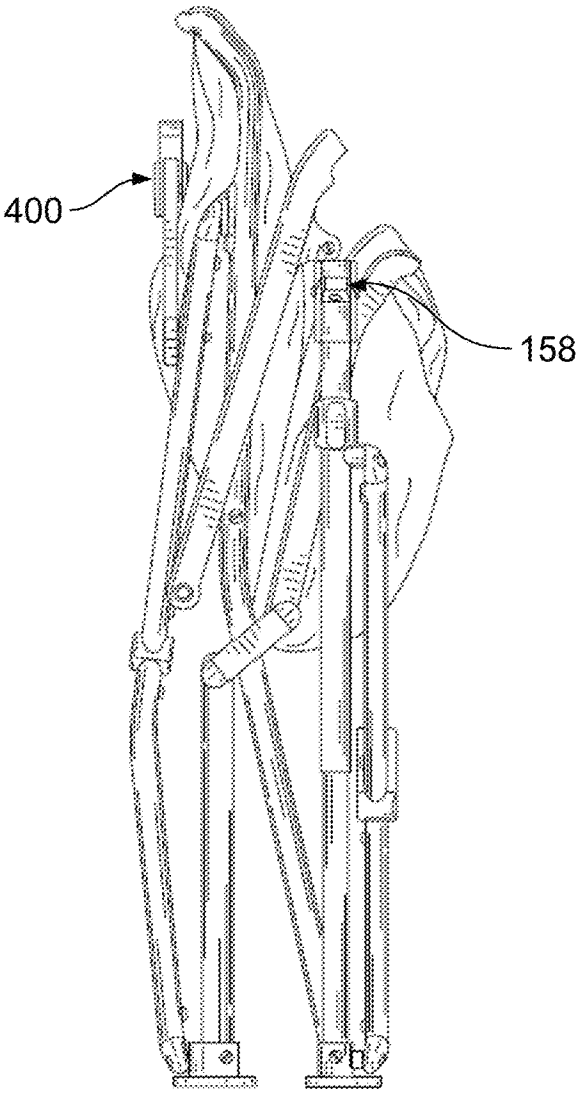
Figure 32A:
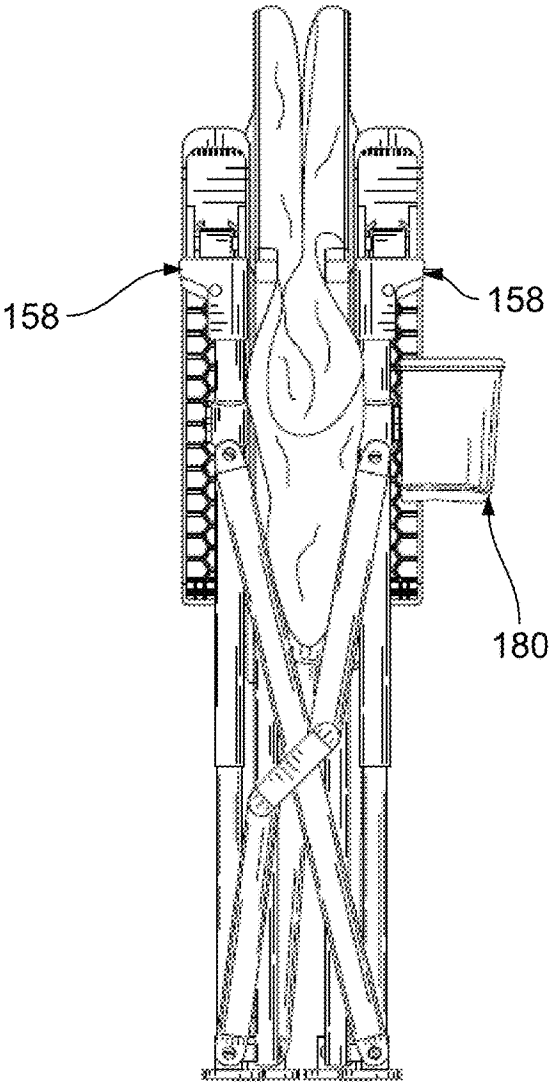

FIG. 31A illustrates another example folding chair with a cup holder 180. In other examples, the folding chair may include a removable cup holder 180 that is reversible or interchangeable from one side of the chair to the other. That is, the cup holder 180 may be swapped from arm rest 112A to 112B, and vice versa. In some examples, as shown in FIG. 31B, the removable cup holder 180 may further include a cup holder support 184 that attaches to a cup holder clip 182, as shown in FIG. 31A. Cup holder support 184 may be upside down u-shaped and may slide on to cup holder clip 182. In certain examples, the cup holder support 184 may include a plurality of guides 186 and a backing 188 that provide stability and are configured to engage cup holder clip 182. The guides 186 may slide into one or more depressions formed in the cup holder clip 182 securing the cup holder 180 to cup holder clip 182. The guides 186 may be elastic and configured to bias into the one or more depressions formed in the cup holder clip 182 to retain the cup holder 180 onto the chair. Yet, other examples are contemplated for securing the cup holder 180 onto the frame of the chair, such as other frictional type fits and mechanical fastening, such as barbed connections, ball and socket connections, threaded, adhesive, hook and loop, as well as other known methods. In other alternative examples, such as the exemplary chair shown in FIG. 14, the cup holder 180 is formed integral with the arm rests 112A and/or 112B.

In some examples, the cup holder support 184 may be sewn to a cup holder 180 or may be secured by adhesive, welding, or other technique well-known to those in the art. In still other examples, the cup holder support 184 may be integrally formed with the cup holder 180. In some examples, the cup holder clip 182 may be on the left or right side of the chair on the vertical leg(s) 106. In still other examples, the folding chair may include a plurality of cup holder clips 182 on each side of the vertical legs 106. In yet other examples, the cup holder 180 may be constructed of a canvas or nylon material. In still other examples, the cup holder 180 may be constructed of a hard molded plastic.

Figure 8:
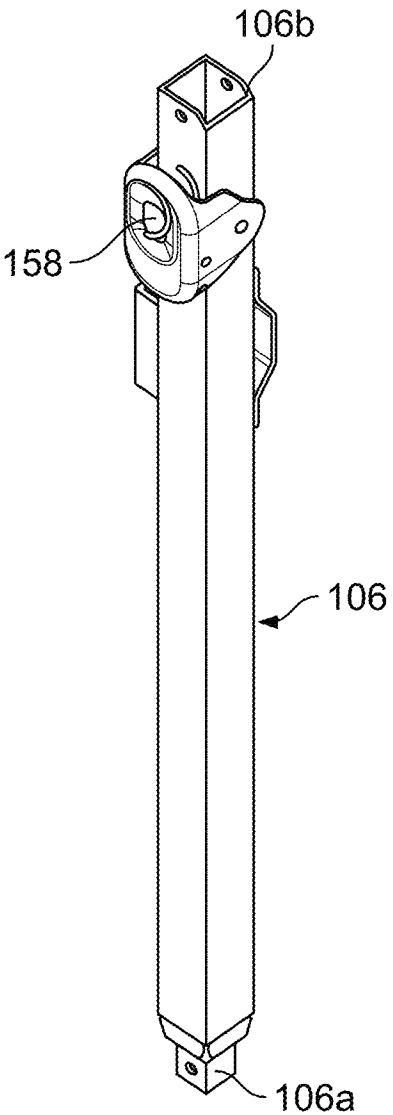
FIGS. 8-12 show various views of the example front leg of FIGS. 7A and 7B.
Figure 35:
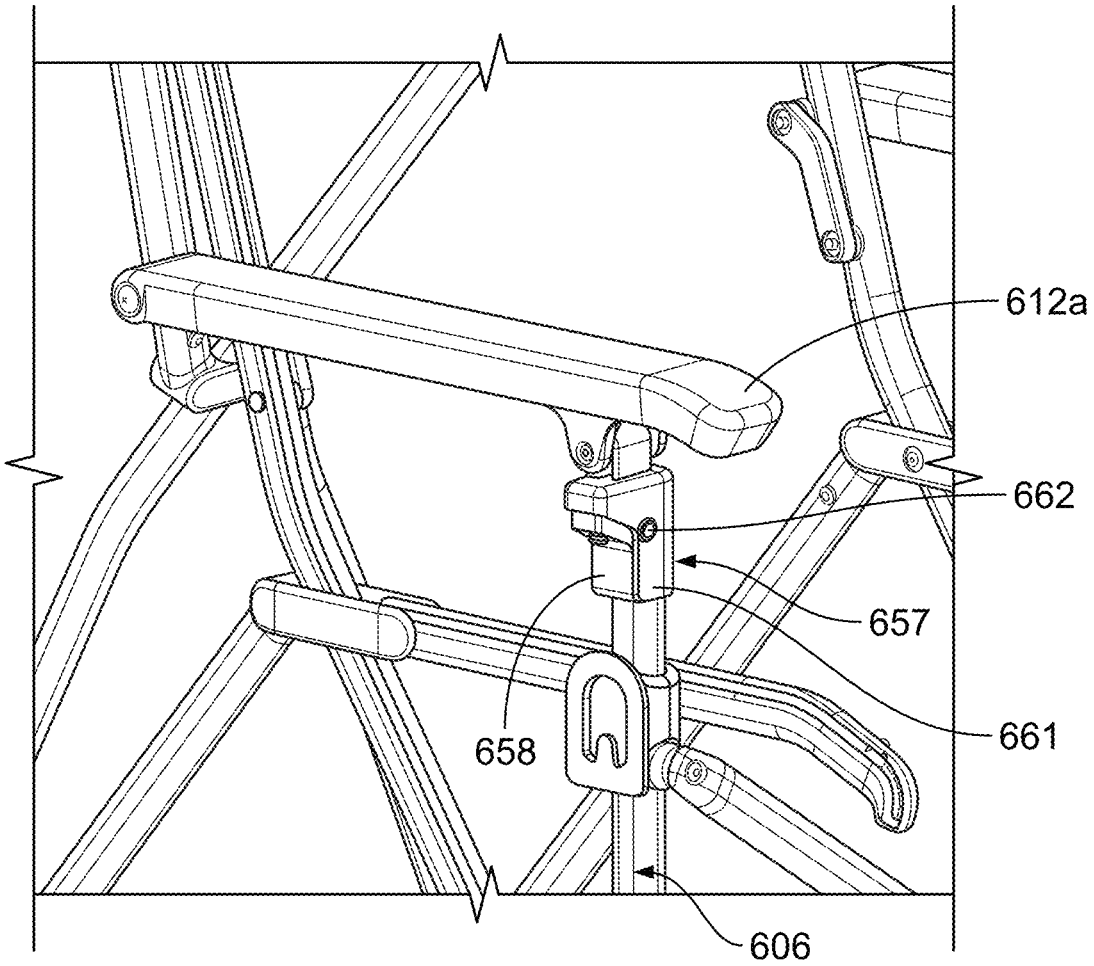
FIG. 35 illustrates an expanded view of the example folding chair of FIG. 34.

FIGS. 34-38 illustrate another example folding chair 601. Similar to the above examples, this example folding chair 601 may include a rear tensioner 600 and leg locking system 657 engaged with vertical leg 606 and configured to secure the outer leg 606*b* to the inner leg 606*a* as shown in FIGS. 35 and 36A to prevent the chair 601 from inadvertently collapsing. Yet in this example, the user may release the locking system 657 by pushing upward on the trigger 658. By pressing upwards on the trigger 658, the latch 610 may rotate and latch projection 611 may rotate out of the slot 608 in the lower leg bushing 660 thereby unlocking the inner leg. In contrast, the user may unlock the leg locking system described in previous embodiments by pressing the rocker 158 in a lateral direction as shown, for example, in FIGS. 7A, 7B, and 8, so the rocker can move the latch 110 out of the slot 108 of the inner leg 106*a* and unlatches the mechanism allowing the inner leg 106*a* to telescope and for the chair to fold. In some examples, the locking system 657 may be integrated with one or both legs of the chair.

As shown in FIG. 35, the locking system 657 may include trigger 658 and trigger housing 661. The top of the locking system 657 is hingedly attached to arm rest 612*a* and/or 612*b*. Trigger housing 661 may be substantially shaped like an upside-down "L" and may be configured to engage the trigger 658. Trigger 658 may also have a shape similar to an upside-down "L" and may fit substantially within, and is configured to pivotally engage, the trigger housing 661 when engaged with each other. The trigger 658 and the housing 661 may define a co-planar angular shape. Trigger 658 may also be secured to the trigger housing 661 by a pin or screw 662. Pin 662 may be a rivet. In some examples, pin 662 is removable. In other instances, pin 662 cannot be removed. The trigger housing 661 and the trigger 658 can be formed of stainless steel for strength and corrosion resistance or other suitable material with similar characteristics such as a plastic, glass filler nylon, carbon fiber, or other rigid composites or laminates. In certain instances, both the trigger 658 and the trigger housing 661 are made out of the same materials. In other instances, the trigger 658 and the trigger housing 661 are made out of different materials.

Figure 36A:
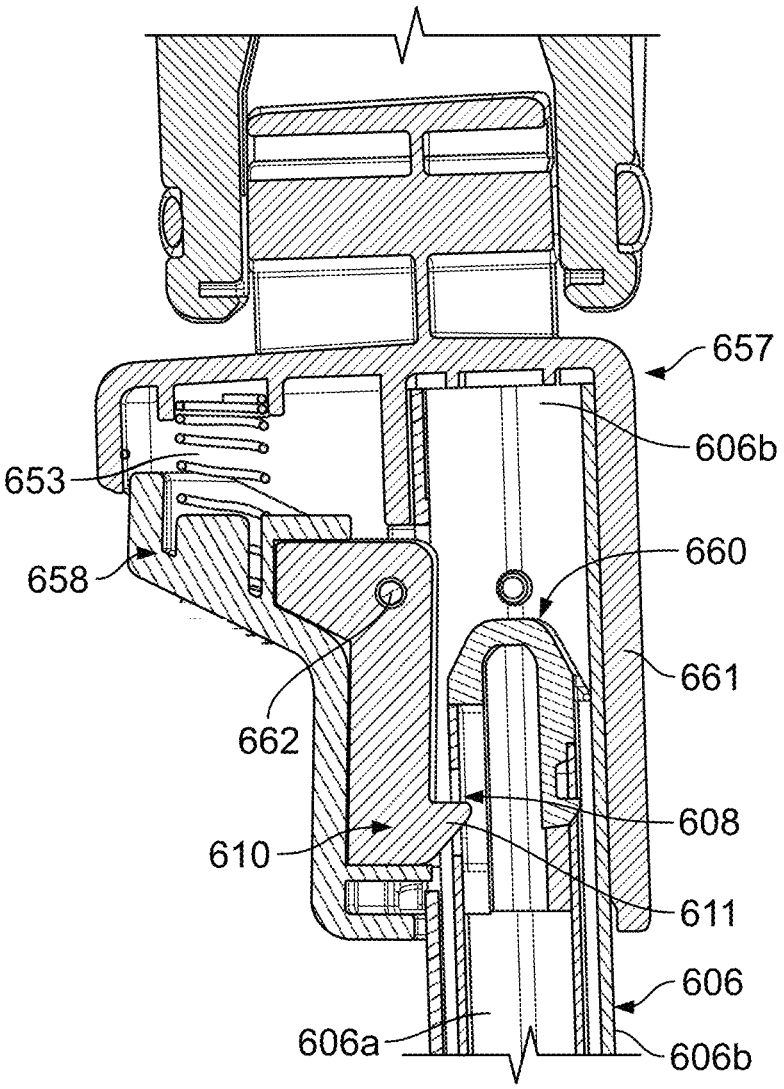
FIGS. 36A-36H illustrate an exploded view of the leg locking system for securing the folding chair outer leg to the inner leg in the example folding chair of FIG. 34.

FIGS. 36A-36H illustrate an exploded view of the locking system 657. As shown in FIG. 36A, the leg locking system 657 may include latch 610 for locking the outer leg 606*b* to the inner leg 606*a*. The upper ends of the inner leg 606*a* may be provided with bushing 660 that prevent the inner leg 606*a* from moving out of the outer leg 606*b* when locked. Lower leg bushing 660 can include a slot 608, and the locking system 657 can include a latch 610 that can be positioned to engage the slot 608 and configured to lock the outer leg 606*b* to the inner leg 606*a* when the chair is fully opened. In some examples, the latch 610 may include a projection 611 configured to engage the slot 608 to lock the outer leg 606*b* to the inner leg 606*a* when the chair is fully opened. In other examples, the latch mechanism may be configured to include the ability to lock the legs in various intermediate positions based upon the user's preference and the desired chair inclined or reclined position. When the user presses upwardly on the trigger 658 below the front of the armrests 612*a*, 612*b*, the latch 610 unlocks the latch projection 611 from the slot 608 by rotating the lower portion of the latch 610 and latch projection 611 out of the slot 608. The latch 610 prevents the inner leg 606*a* from telescoping outward toward the folded position. Because the vertical leg 606 is attached to the top and bottom of the front X frame 614, it expands the X frame 614 to widen the seat pan and tensions the fabric. In some examples, each side of the chair can have the leg locking system 657 to maintain the chair in the unfolded position during use. However, in other examples, only one leg locking system 657 may be provided. The latch 610 is configured to mate with and pivots on the interior of trigger 658 so the trigger can move the latch 610 out of the slot 608 of the lower leg bushing 660 attached to the top of inner leg 606*a* and unlatches the mechanism allowing the inner leg 606*a* to telescope and for the chair to fold. The latch may pivot about a horizontal axis of pin 662. A spring 653 may also be included to bias the trigger 658 such that it holds the latch 610 in place in the slot 608. Any suitable spring may be used to include a tension/extension spring, compression spring, torsion spring, constant spring, variable spring, variable stiffness spring, flat spring, machined spring, serpentine spring, garter spring, cantilever spring, coil spring, helical spring, hollow tubing spring, leaf spring, constant-force spring, gas spring or combinations thereof. It is also contemplated that the spring can be mounted to the latch pivot to bias the trigger 658 and latch 610. Again, to un-latch the vertical leg, the user simply presses the top of the trigger 658.

Figure 36B:
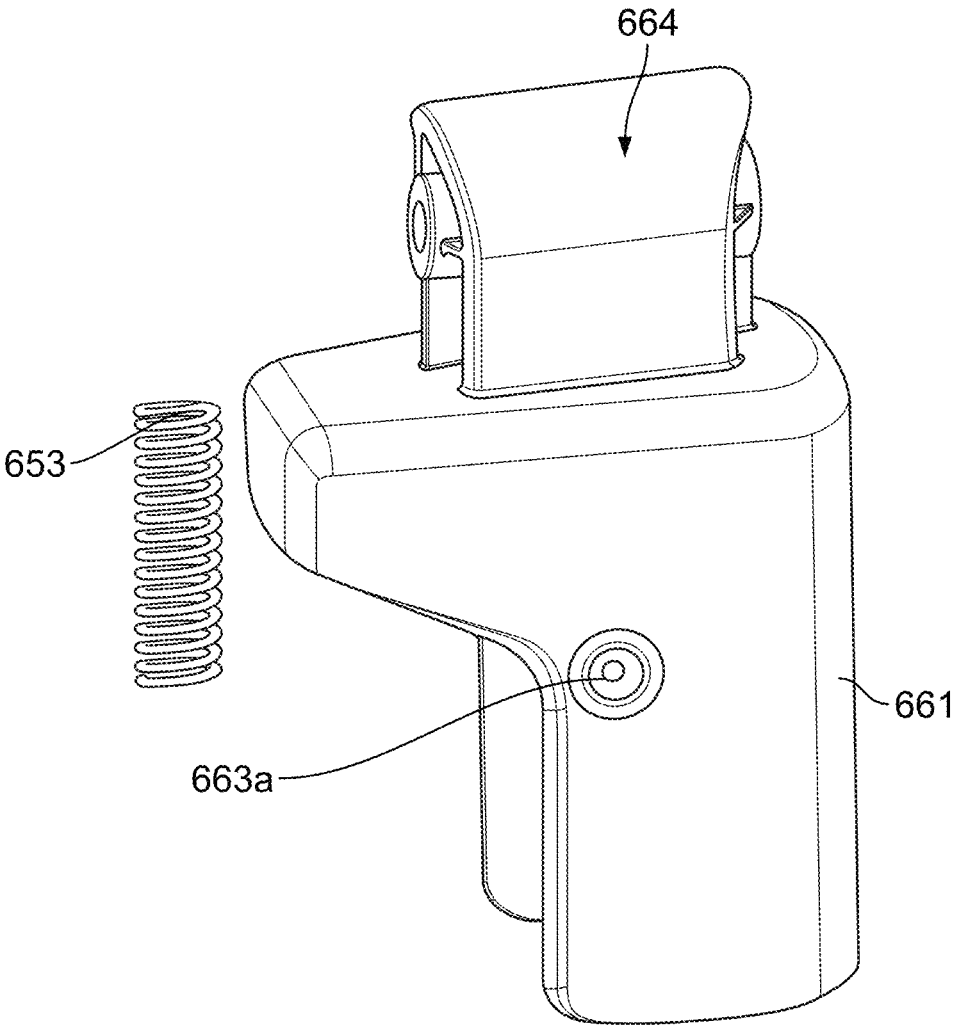
Figure 36C:
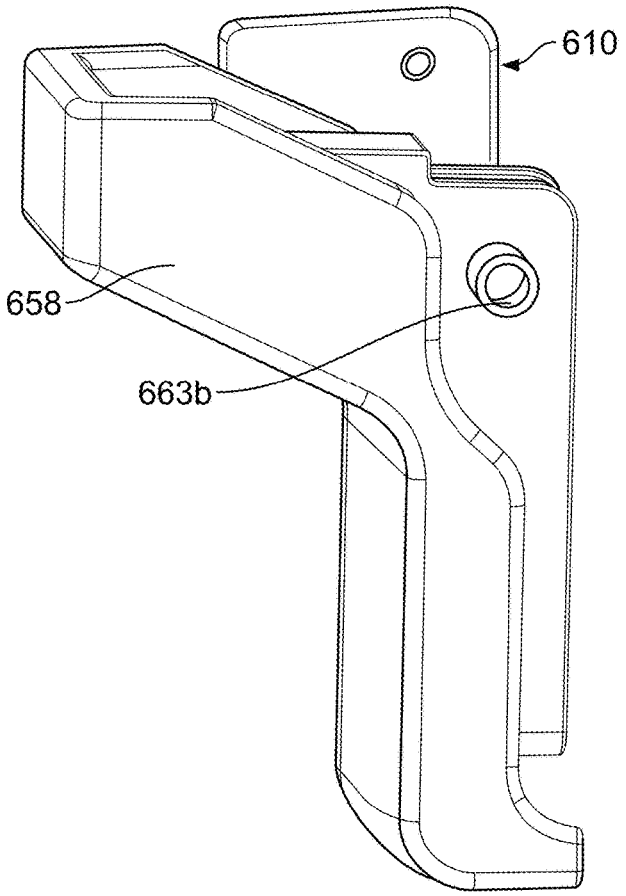
Figure 36D:
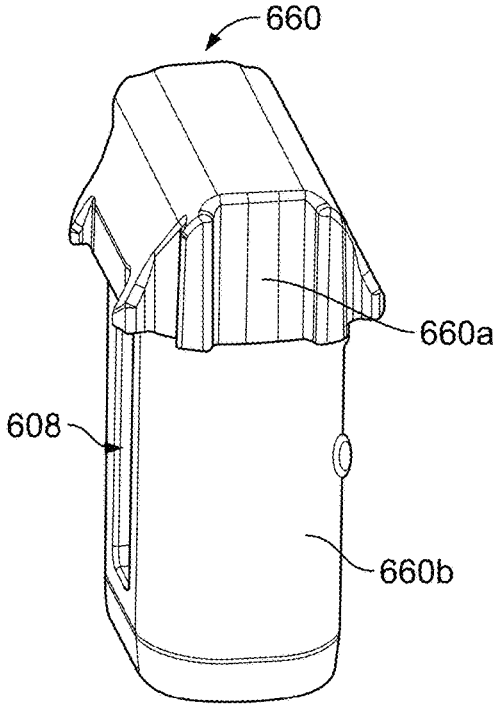

As shown in FIG. 36B, the trigger housing 661 may include biasing spring 653 and the top of the trigger housing 664 which may be configured to hingedly engage arm rest 612*a* and/or arm rest 612*b*. As shown in FIGS. 36A-36C, trigger 658 is configured to engage the trigger housing 661. Trigger 658 may be configured to hingedly attach to trigger housing 661 via pin 662 and pin receptacles 663*a* and 663*b*. Latch 610 may include a projection (not shown) that engages slot 608 of bushing 660. As shown in FIG. 36D, bushing 660 may include a top that is flared and substantially semi-circular. The bushing top 660*a* of the lower leg bushing 660 may extend beyond a circumference and/or the diameter of the lower portion of the bushing 660*b*. In some examples, the bushing 660 may be substantially frustoconical shaped.

Figure 36E:
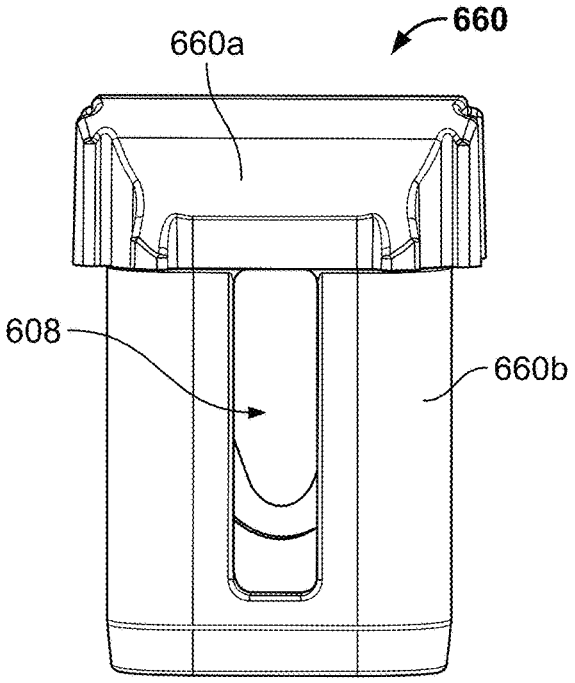

As shown in FIG. 36E, slot 608 may be substantially oval-shaped or racetrack-shaped or rectangular-shaped. The bushing 660 may define a longitudinal axis that is neither parallel nor perpendicular to the actuation surface of the trigger shown in FIG. 36C. Incorporating an extended length to slot 608, as shown in FIG. 36E, provides increased strength to the structure and facilitates a greater ease of locking and unlocking (i.e., engaging and disengaging) projection 611. In other examples, slot 608 may include a plurality of notches or teeth configured to engage latch projection 611. The user can adjust the chair to the desired position based upon the particular slot 608 notch or teeth position chosen by the user. The different notch or teeth position of the slot 608 directly corresponds to a different inclined or reclined position based upon an overall different leg 606 length.

When the user presses upwardly on the trigger 658, the latch 610 unlocks by rotating/pivoting the lower portion 610 and projection 611 out of the slot 608. The inner leg 606*a* is configured, in the unlocked position, to telescope out of the outer leg 606*b* as the chair 100 is folded. This allows the chair to be in a folded or collapsed state where the chair folds into a rectangular or cylindrical profile and can be placed into a bag or case with a corresponding profile.

Figure 36F:
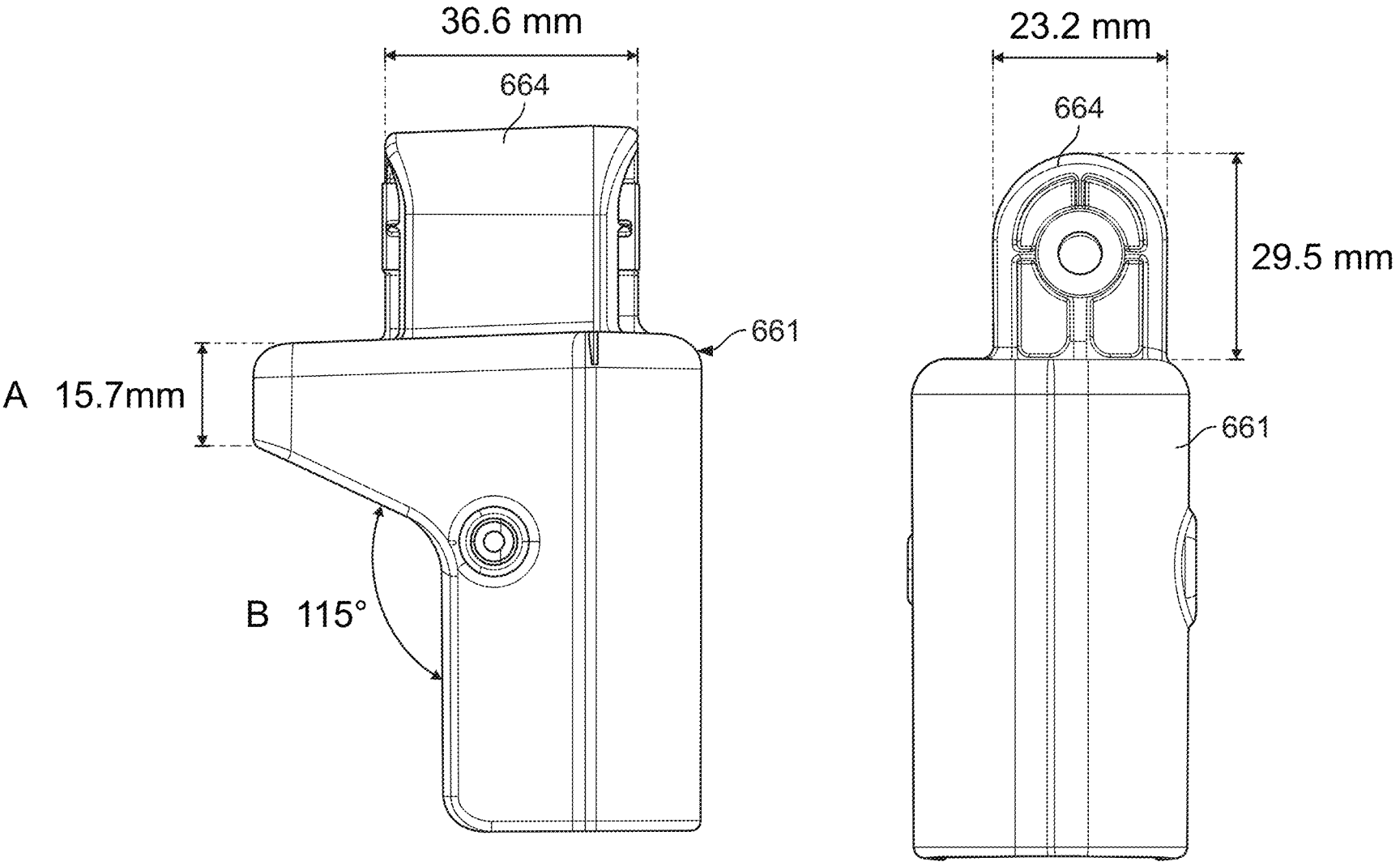

FIG. 36F further illustrates the trigger housing 661 that may include a top of the trigger housing 664 and may be configured to hingedly engage arm rest 612*a* and/or arm rest 612*b*. The top of the trigger housing 664 may include a width. The width of the top of the trigger housing 664 that engages the arm rest may be at least 30 mm, 31 mm, 32 mm, 33 mm, 34 mm, 35 mm, 36 mm, 37 mm, 38 mm, 39 mm, 40 mm, 41 mm, 42 mm, 43 mm, 44 mm, or 45 mm. In other examples, the top of the trigger housing 664 may include a width of 30-40 mm, 34-38 mm, 35-40 mm, or 30-45 mm. The top of the trigger housing 664 may also include a height. The height of the top of the trigger housing 664 that engages the arm rest may be at least 25 mm, 26 mm, 27 mm, 28 mm, 29 mm, 30 mm, 31 mm, 32 mm, 33 mm, 34 mm, or 35 mm. In certain examples, the height of the top of trigger housing 664 may be 25-35 mm, 28-32 mm, 29-30 mm, or 20-40 mm. The top of the trigger housing 664 may also include a thickness. The thickness of the top of the trigger housing 664 that engages the arm rest may be at least 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, or 30 mm. In other examples, the thickness of the top of trigger housing 664 may be 20-25 mm, 22-24 mm, 23-24 mm, or 20-30 mm. The trigger housing 661 may also include an outer portion A configured to house the top portion of the trigger 658. The outer portion A may include a height of at least 10 mm, 11 mm, 12 mm, 13 mm, 14 mm, 15 mm, 16 mm, 17 mm, 18 mm, 19 mm, or 20 mm. The trigger housing may also include angle B. Angle B may be at least 90, 95, 100, 105, 110, 115, 120, 125, 130, 135, 140, 145, or 150 degrees. The design specifications facilitate an efficient and simple means for a user to lock and unlock the legs quickly and easily without needing to generate unnecessary force or moments to actuate the system.

Figure 36G:
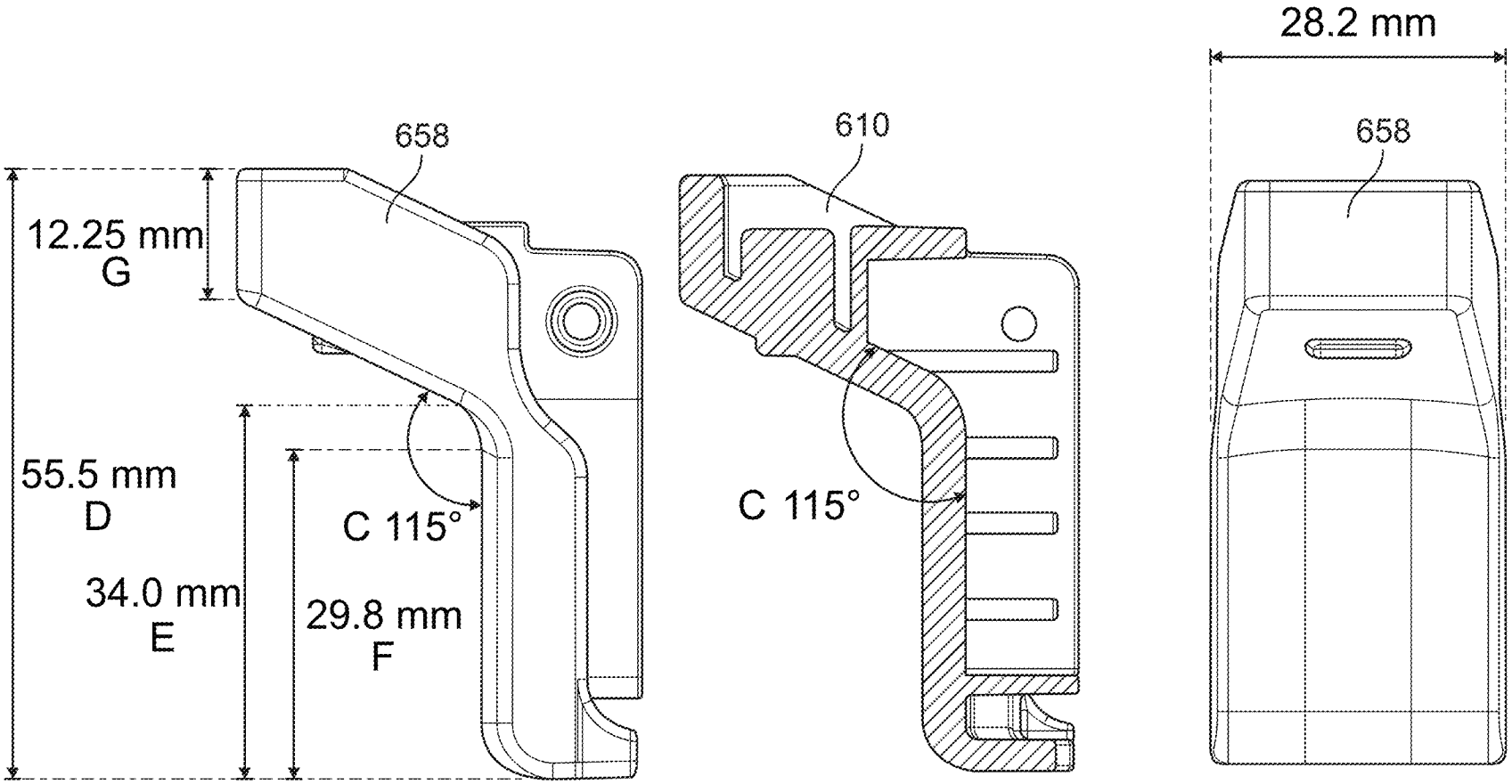

FIG. 36G further illustrates the trigger 658 and the latch 610. Trigger 658 and latch 610 may be shaped like and upside down "L." As noted above, trigger 658 and the housing 661 may define a co-planar angular shape. Trigger 658 and latch 610 may include angle C. Angle C may be at least 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, or 130 degrees. In other examples, Angle C may be 100-130 degrees, 110-120 degrees, or 90-140 degrees. Trigger 658 may also include a first height D. The first height D of trigger 658 may be at least 50 mm, 51 mm, 52 mm, 53 mm, 54 mm, 55 mm, 56 mm, 57 mm, 58 mm, 59 mm, or 60 mm. In certain examples, the first height D of trigger housing 664 may be 50-60 mm, 54-56 mm, 53-57 mm, or 45-65 mm. Trigger 658 may include a second height E. The second height E of trigger 658 may be at least 30 mm, 31 mm, 32 mm, 33 mm, 34 mm, 35 mm, 36 mm, 37 mm, 38 mm, 39 mm, or 40 mm. In certain examples, the second height E of the trigger 658 may be 30-35 mm, 30-40 mm, 35-45 mm, or 33-35 mm. Trigger 658 may include a third height F. The third height F of trigger 658 may be at least 25 mm, 26 mm, 27 mm, 28 mm, 29 mm, 30 mm, 31 mm, 32 mm, 33 mm, 34 mm, or 35 mm. In certain examples, the third height F of the trigger 658 may be 25-30 mm, 25-35 mm, 20-40 mm, or 28-32 mm. Trigger 658 may include a fourth height G. The fourth height G of trigger 658 may be at least 5 mm, 6 mm, 7 mm, 8 mm, 9 mm, 10 mm, 11 mm, 12 mm, 13 mm, 14 mm, or 15 mm. In certain examples, the fourth height G of the trigger 658 may be 5-15 mm, 10-14 mm, or 5-20 mm. Trigger 658 may also include a width. Trigger 658 width may be at least 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, or 40 mm. In other examples, the trigger 658 width may be 25-30 mm, 20-35 mm, or 20-40 mm. The design specifications facilitate an efficient and simple means for a user to lock and unlock the legs quickly and easily without needing to generate unnecessary force or moments to actuate the system.

Figure 36H:
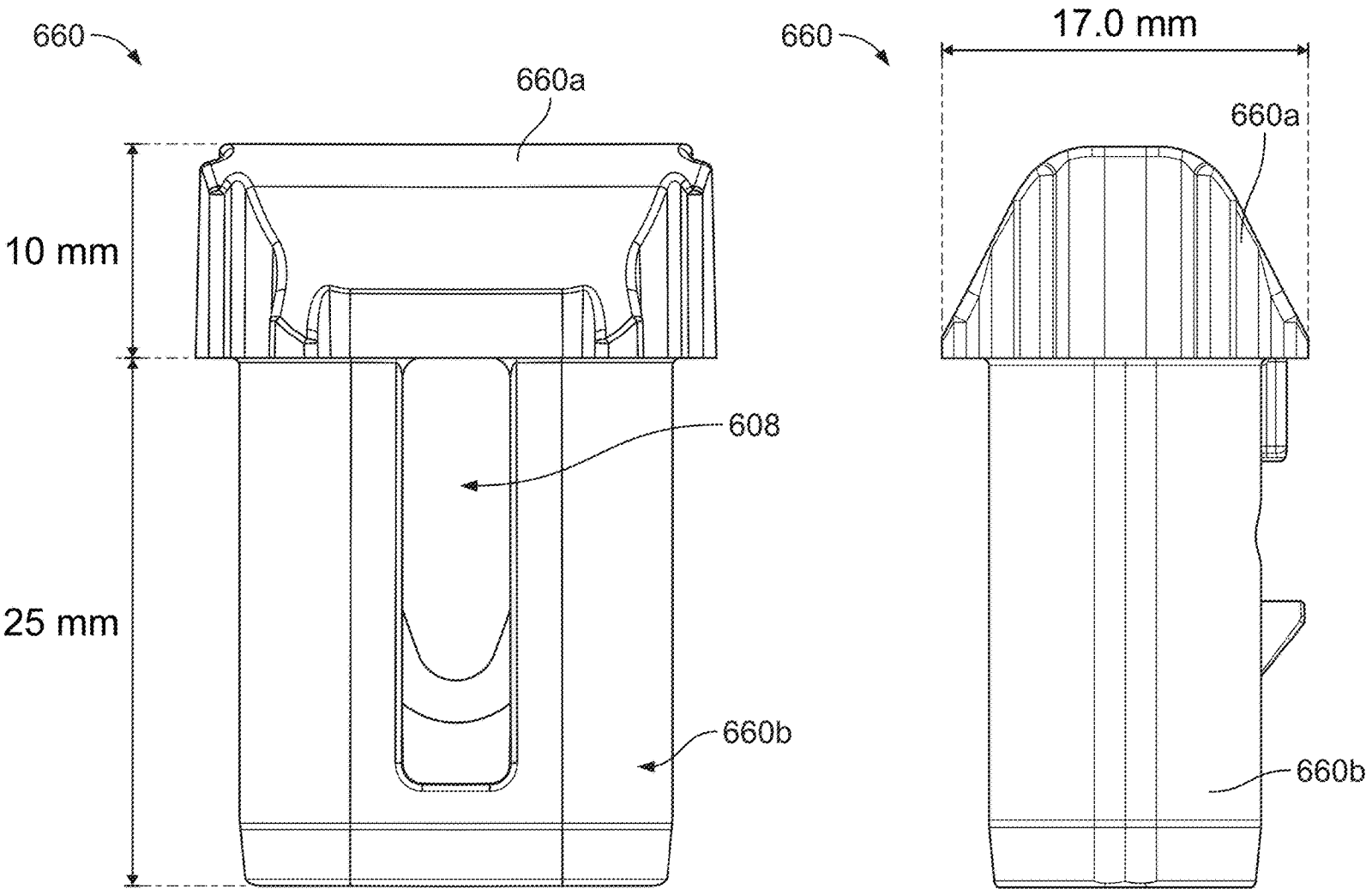

As shown in FIG. 36H, lower leg bushing 660 may include a bushing top 660*a*. Bushing top 660*a* may include a height that may be at least 5 mm, 6 mm, 7 mm, 8 mm, 9 mm, 10 mm, 11 mm, 12 mm, 13 mm, 14 mm, or 15 mm. In some examples, the bushing top 660*a* height may be 5-10 mm, 5-15 mm, or 5-20 mm. The bushing top 660*a* may include a width that is at least 15 mm, 16 mm, 17 mm, 18 mm, 19 mm, or 20 mm. In yet other examples, the width of the bushing top 660*a* may be 15-20 mm, 16-18 mm, or 10-20 mm. The lower portion 660*b* of the bushing 660 may include a height of at least 20 mm, 21 mm, 22 mm, 23 mm, 24 mm, 25 mm, 26 mm, 27 mm, 28 mm, 29 mm, or 30 mm. In other examples, the height of the lower portion 660*b* may be 20-25 mm, 20-30 mm, or 15-35 mm. The particular design specifications of the top portion 660*a* of bushing 660 and lower portion 660*b* facilitate an efficient and simple means for a user to lock and unlock the legs quickly and easily without needing to generate unnecessary force or moments to actuate the system.

Figure 37:
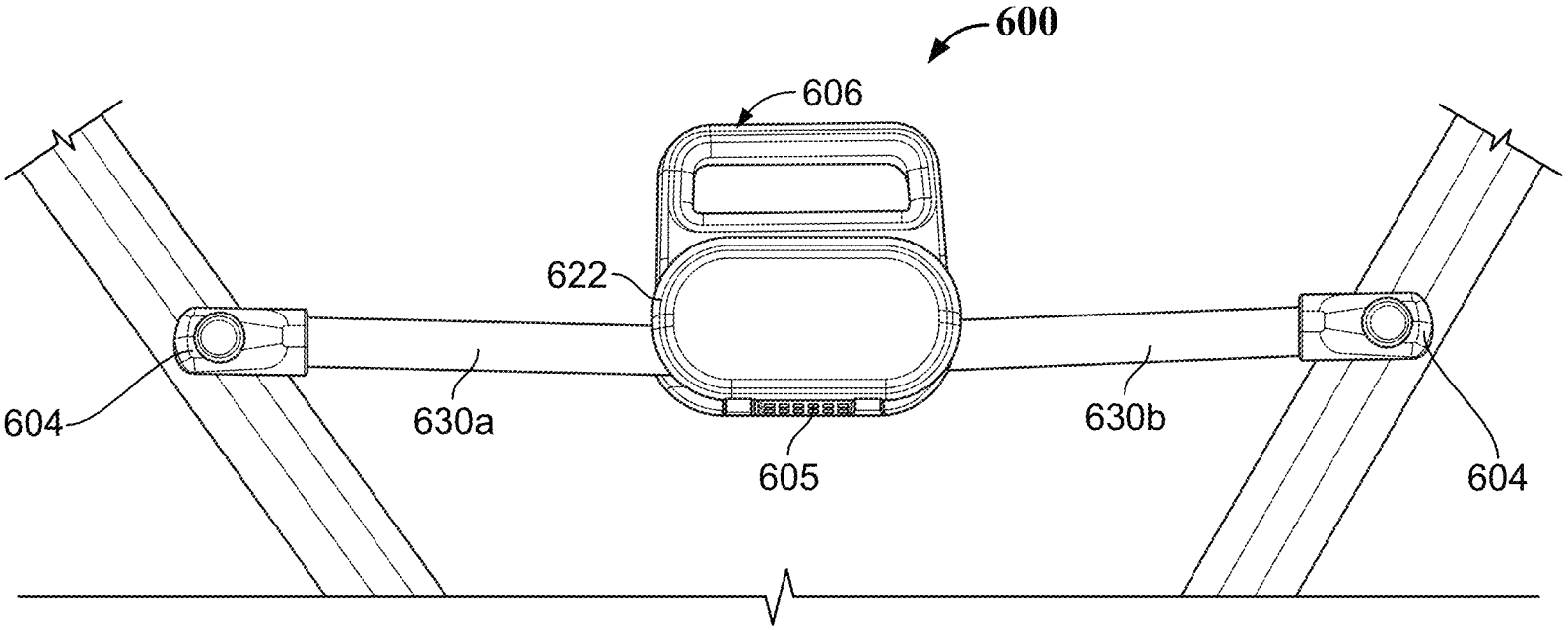
FIG. 37 illustrates another rear tensioner embodiment of the example folding chair of FIG. 34.
Figure 38:
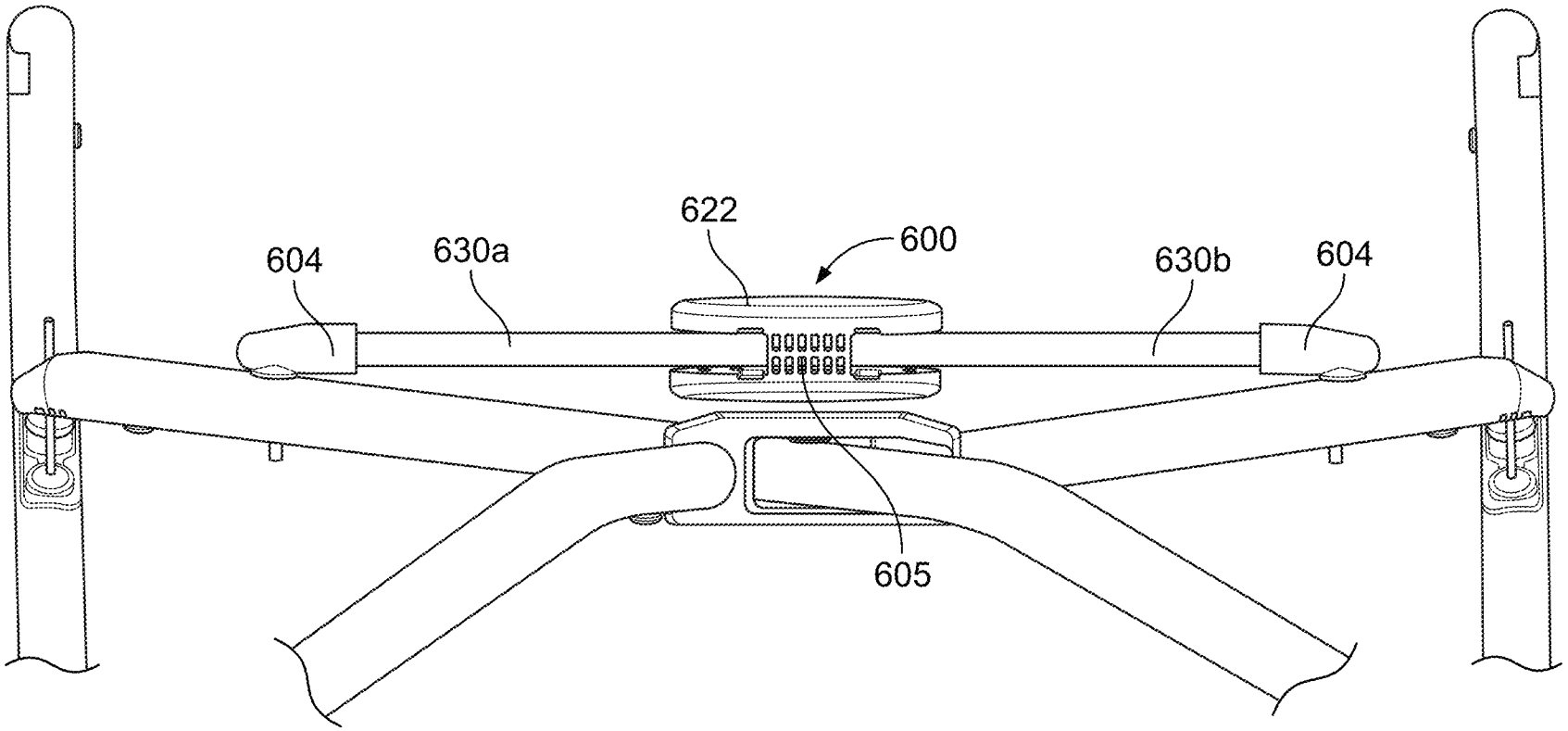
FIG. 38 illustrates a bottom perspective view of the rear tensioner as shown in FIG. 37.

FIGS. 37 and 38 illustrate another example rear tensioning mechanism. The embodiment shown in FIGS. 37 and 38 include a single component internal stop integrally formed with the lower grated portion 605. The rear tensioner 600 may include a handle 606 and housing 622 below the grasping portion of the handle 606, rear tensioner arm 630*a*, rear tensioner arm 630*b*, and rear tensioner caps 604. The rear tensioner caps 604 are configured to pivot in a manner that allows the rear tensioner to move from an unfolded position to a tensioned position. In some examples, the rear tensioner arms 630*a* and 630*b* can be formed of aluminum or any other suitable strong lightweight material. The rear tensioner 600 and handle 606 and housing 622 can, in certain instances, be made out of glass filler nylon for strength, plastic, or other composite. The housing 622 may also include a lower grated portion 605 that reduces the overall weight of the housing 622 and the amount of material used during manufacturing. The reduction in weight provides the user a more portable folding chair compared to other embodiments. The lower grated portion 605 may also include a top portion that forms the internal stop. The internal stop may be concave and configured to engage the rear tensioner arm 630*a* and the rear tensioner arm 630*b*.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

The invention claimed is:

1. A folding chair comprising:
a front frame;
a rear frame;
a seat pan;
a backrest;
a pair of arm rests; and
a pair of vertical legs;
wherein the vertical legs are each provided with an inner leg and an outer leg and the inner leg is configured to telescope out of the outer leg,
wherein each of the vertical legs include a leg locking system for locking the outer leg to the inner leg when the chair is in an unfolded position,
wherein the leg locking system includes a trigger housing, a trigger, and a latch,
wherein the latch is configured to engage a bushing on the inner leg, and
wherein the trigger and the trigger housing are substantially upside-down "L" shaped.

2. The folding chair of claim 1, wherein the bushing on the inner leg further includes a slot, and wherein the latch further includes a lower projection configured to engage the slot in a locked position.

3. The folding chair of claim 2, wherein the trigger is pressed upwards to rotate the lower projection out of the slot in the bushing thereby unlocking the inner leg.

4. The folding chair of claim 3, wherein the slot is generally rectangular shaped and further includes a plurality of notches configured to engage the lower projection, and wherein the plurality of notches corresponds to a plurality of different telescoping leg positions.

5. The folding chair of claim 4, wherein the inner leg telescopes out of the outer leg when the leg locking system is in an unlocked position, and wherein the chair is foldable in the unlocked position.

6. The folding chair of claim 1, wherein the leg locking system is hingedly coupled to an underside of the pair of armrests.

7. The folding chair of claim 1 further comprising a cup holder engaged with a vertical leg.

8. The folding chair of claim 1, wherein the seat pan and the backrest are formed of a suspension fabric comprising a first yarn, a second yarn, and a thermoplastic polyurethane film, wherein the first yarn is a polymer and the second yarn is more elastomeric than the first yarn, and wherein the thermoplastic polyurethane film is heat pressed to the first yarn and second yarn.

9. The folding chair of claim 7, wherein the backrest includes a tensioner configured to maintain the backrest in a tensioned position, the tensioner comprising a rear tensioner handle, and a pair of rear tensioner arms.

10. The folding chair of claim 9, wherein the tensioner further comprises at least one internal stop and a plurality of pivot points.

11. A method of forming a folding chair comprising:
forming a seat pan comprising a pair of seat bars, a pair of vertical legs configured to tension the seat pan, a locking system, a backrest comprising a pair of diagonally extending backrest bars, a front frame comprising a pair of cross bars, a rear frame comprising rear cross bars, and a pair of armrests;
wherein the seat pan and the backrest are formed of a suspension fabric having an overlap and a core placed into a hollow section created by the overlap,
wherein the core in the hollow section is secured in a notch asymmetrically located in a top portion of the pair of diagonally extending backrest bars,
wherein the vertical legs further comprise an inner leg and an outer leg,
wherein the inner leg is configured to telescope out of the outer leg, and wherein each of the vertical legs include the leg locking system configured to lock the outer leg to the inner leg when the chair is in an unfolded position.

12. The method of claim 11 further comprising forming a cup holder configured to engage a vertical leg.

13. The method of claim 12, wherein the cup holder is formed from a canvas or a hard molded plastic.

14. The method of claim 11 further comprising forming the seat pan and the backrest from a first yarn, a second yarn, and a thermoplastic polyurethane film.

15. The method of claim 14, wherein the first yarn is a polymer and the second yarn is more elastomeric than the first yarn.

16. The method of claim 14, wherein the first yarn and the second yarn are weaved.

17. The method of claim 14, wherein the thermoplastic polyurethane film is heat pressed to the first yarn and second yarn.

18. The method of claim 17, wherein the thermoplastic polyurethane film includes a thickness of at least 0.1 mm.

19. The method of claim 17, wherein the thermoplastic polyurethane film includes a melting point lower than melting points of the first yarn and second yarn.

20. A folding chair comprising:

a front frame;

a rear frame;

a seat pan;

a backrest;

a pair of arm rests;

a pair of vertical legs; and a rear tensioner;

wherein the vertical legs are each provided with an inner leg and an outer leg and the inner leg is configured to telescope out of the outer leg, wherein each of the vertical legs include a leg locking system for locking the outer leg to the inner leg when the chair is in an unfolded position, wherein the rear tensioner is configured to maintain the backrest in a tensioned position, the tensioner comprising a rear tensioner handle, and a pair of rear tensioner arms.

* * * * *